US005902099A

United States Patent [19]

Rowlette et al.

[11] Patent Number: 5,902,099

[45] Date of Patent: May 11, 1999

[54] COMBINED FAN AND IGNITION CONTROL WITH SELECTED CONDITION SENSING APPARATUS

[75] Inventors: Mitchell R. Rowlette, Berea; Ronald E. Garnett, Lexington; Mark A. Eifler, Frankfort, all of Ky.

[73] Assignee: Texas Instruments Incorporated, Dallas, Tex.

[21] Appl. No.: 08/742,236

[22] Filed: Oct. 31, 1996

[51] Int. Cl.[6] ..... F23N 5/00

[52] U.S. Cl. ..... 431/22; 431/25; 431/18; 431/75; 126/116 A

[58] Field of Search ..... 431/24, 25, 21, 431/22, 75, 78; 126/307 A, 116 A

[56] References Cited

U.S. PATENT DOCUMENTS 3,652,195 3/1972 Macintosh et al. ..... 431/21
5,197,664 3/1993 Lynch ..... 431/18
5,506,569 4/1996 Rowlette ..... 431/24
5,722,822 3/1998 Wilson et al. ..... 431/24

FOREIGN PATENT DOCUMENTS 0123915 5/1989 Japan ..... 431/22

*Primary Examiner*—Carl D. Price
*Attorney, Agent, or Firm*—Russell E. Baumann; Richard L. Donaldson; Rene'E. Grossman

[57] ABSTRACT

An electric control is shown adapted for use with gas furnaces which controls fan motors, ignition controls and a gas valve based on inputs from a room thermostat, limit switches, a flame probe, a flame roll-out probe, and a condensate sensor. A roll-out detection circuit utilizing flame rectification includes a multidirectional roll-out probe 16 coupled to a microcontroller (U2) through an inverter (U3) to provide both fault both protection and fault identification. A condensate sensor (20) in the form of a conductive condensate sensor member is also coupled to the microcontroller (U2) through an inverter (U3) to detect the presence of condensate build-up.

12 Claims, 17 Drawing Sheets

NO FLAME: LOW LINE 90 VAC
LOW CAPACITANCE+.013uF

COMBINED FAN AND IGNITION CONTROL WITH SELECTED CONDITION SENSING APPARATUS

BACKGROUND OF THE INVENTION

This invention relates generally to the sensing of certain conditions associated with the operation of gas furnaces and more specifically to the sensing of condensate and flame roll-out conditions.

Integrated or combined hot surface ignition and fan controls are common in the heating, ventilating and air conditioning (HVAC) industry. Conventional controls employ thermal sensors in the form of bimetal thermostatic sensors for the detection of flame escaping the confines of the combustion chamber in a gas furnace. This flame escaping the combustion chamber is known as "flame roll-out". These thermostatic sensors are normally closed manual reset (or one-shot) type devices. They are located such that when flame escapes the combustion chamber, the thermostatic sensors are heated which causes the normally closed contacts to open. The contacts of the thermostat are wired in series with the gas valve circuit of the control. Thus the gas valve will be de-energized if the flame escapes the combustion chamber. With the advent of multiposition furnaces, as many as four thermostatic sensors must be employed (one for each of the four directions that the escaping flame may rise) to detect the flame roll-out condition. However, the use of four sensors is expensive. Another draw back to the use of thermal sensors is the inherent time delay involved with the heating of the sensors, typically, 30 seconds.

On the other hand, thermostatic sensors provide a desirable characteristic in that all failure modes with the wiring and connections result in safe conditions. In fact, these failures result in an equivalent to the opening of the flame roll-out thermostat's contacts. In the case of one (or both) of the wires connected to the thermostat "broken", the current path for the gas valve is opened (thus the valve is de-energized). If one of the wires to the thermostats is shorted to the chassis of the furnace, power for the gas valve is shorted out and again the gas valve is de-energized. Thus safe operation is achieved in all of the failure modes with thermostat sensors.

Another problem associated with high efficiency gas furnaces presently in use relates to the fact that such furnaces are so efficient that water vapor is condensed from the by products of combustion. This presents additional problems for furnace manufacturers. Condensate must be drained from the vent and the combustion chamber. This is accomplished through a so called collection box which encloses the outlet from the combustion chamber and the inlet to the vent system. The collection box is constructed of a polymer material due to a number of factors such as cost, odd shape and the corrosive nature of condensate. In such a system if the drain becomes clogged, the furnace will begin filling with fluid and its operation will become unsafe. Furnace manufacturers normally solve this problem by adding an extra pressure switch to detect the build up of fluid in the vent (vent pressure changes due to partial blockage and fan restriction).

SUMMARY OF THE INVENTION

It is an object of the present invention to provide an inexpensive, reliable sensor system for multiposition flame roll-out detection in a gas furnace control. Another object is the provision of such a sensor system which results in safe conditions. Yet another object is the provision of a flame roll-out detection system which identifies a fault condition. Still another object of the present invention is an inexpensive, reliable sensor system for detecting the presence of an undesirable accumulation of condensate. Another object of the invention is to overcome the above noted prior art limitations.

Briefly, in accordance with the invention, conventional thermostatic sensors for the flame roll-out detection are replaced with a flame rectification sensor and circuitry. The flame rectification sensor and circuitry detect the presence of the flame via the unidirectional current flow that occurs in a flame. The detection of this physical phenomenon (known as flame rectification) is rapid, less than 0.5 seconds. In accordance with the invention, the inlet to the combustion chamber is surrounded with a single wire or rod to detect flame in multiple directions.

Power for the flame rectification process is obtained through a 120 VAC source and a serial connection to a capacitor. This path is connected through a resistor to the roll-out sensor at a first terminal. A second roll-out terminal, shorted to the first terminal is connected to a low pass filter. Under normal circumstances, with no broken wires going to the sensor, current will flow from the 120 VAC source to the input of an inverter. The capacitor of the low pass filter is selected so that the 60 Hz component of the 120 VAC signal is not filtered but is phase shifted. The inverted output of the inverter follows the 60 Hz signal and is connected to a microcontroller. If the connection between the two sensor connection is open due to a broken wire or the failure of serially connected components, the 60 Hz signal will not be present. This will be detected by the microcontroller as a broken wire fault. If the capacitor of the low pass filter fails by drifting in value or opens this is also detected by the microcontroller. If either of the wires to the sensor is shorted to the chassis of the furnace, the power source for the detection circuit will be shorted and the low pass filter will charge to +5 vdc. This will cause the output of the inverter to go to 0 vdc which is detected by the microcontroller as a possible broken wire fault.

In If no faults exist and a flame roll-out occurs, the filter capacitor will be completely discharged through the flame and the positive portion of the 120 VAC, 60 Hz signal will be shunted to ground (chassis of the furnace). This results in the input to the micro to be +5 vdc. The software again detects this and identifies this to be a "ROLL-OUT" condition.

If the input to the inverter becomes shorted to +5 vdc or ground the software will detect this condition. However, proper identification is not possible in this case since each of these failures is identical to a broken wire or a roll-out condition.

Proper response will nevertheless still be conducted by the software in either case as described before for these two conditions.

According to another feature of the invention relating to the sensing of condensate, a more reliable and less expensive means of control is provided than that obtained using a conventional pressure switch by detecting the physical properties associated with the presence of condensate rather than its symptom (vent pressure change). As condensate builds up within the collection box it is in contact with the chassis of the furnace, i.e., the combustion chamber. By properly locating a single corrosion resistant metal rod or condensate probe in the collection box a conduction path is created between the rod and the chassis of the furnace. As a result, condensate build-up can be sensed and unsafe operation avoided without the use of a of pressure switch. A circuit similar to the flame roll-out sensing circuit is used in conjunction with the condensate probe but is modified by using 24 VAC for power and by a diode placed in series with the sense line. A low pass filter is used to remove the 60 Hz component from the 24 VAC current source. When no condensate is present a capacitor is charged to a 5 vdc source which causes the output of an inverter to be 0 dc which is sensed by the microcontroller software as a no condensate condition. When condensate builds up a conduction path occurs between the condensate probe and the chassis of the furnace which allows the positive portion of the 24 VAC power source to be shunted to ground causing the output of the inverter to go to +5 vdc which is detected by the software of the microcontroller as a condensate build up condition.

Additional objects and advantages of the invention will be set forth in part in the description which follows and in part will be obvious from the description. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention and, together with the description, serve to explain the objects, advantages and principles of the invention. In the drawings:

FIGS. 7*a*–7*h* are software flow charts used in conjunction with the microcontroller shown in FIG. 1.

Referring to FIGS. 1*a*–1*d*, operation of the preferred embodiment of the invention will be described. As shown in FIG. 1*c*, power (24 VAC) is applied to the logic circuitry through connector P1 pin 3 (signal SEC) and P1 pins 6, 8, and 9 (signal C). Screw terminal Pin 3 pin 1 acts as an additional field connection point for the common signal of the 24 VAC power. Capacitor C20 acts as a noise filter for the 24 VAC power. Fuse F1 which is attached to terminals FT1 and FT2 acts to protect the 24 VAC connections from accidental short circuits. FT2 is connected to the signal 24 VAC and P1 pin 5 and the anode of CR1 and the cathode of CR2. The anode of CR3 and the cathode of CR4 are connected to the C signal. These four diodes rectify the 24 VAC power to a DC power source RLAY-PWR (Cathode of CR1 and CR3) and GND (anode of CR4 and CR2). This is the power source for all the relays on the assembly (K1, K2, K3, K5). The anode of diode CR5 is connected to RLAY_PWR and the cathode is connected to 24LOGIC. Diode CR5 acts to isolate the filter capacitor C1 (attached to 24LOGIC and GND) from $RLAY_{13}$ PWR. Capacitor C1 filters the rectified DC power. Resistor R31 is connected across the capacitor C1 to discharge the capacitor during power interruption. One side of resistor R1 is attached to 24LOGIC while the other side of the resistor is connected to the cathode of zener diode CR7. The anode of CR7 is connected to GND. Resistor R1 limits current flow to the zener diode while the zener regulates 24LOGIC to five volts DC (VDD). Capacitors C11 and C2 act to filter the five volt DC power. Resistor R16 is placed across the zener diode to discharge capacitors C11 and C2 during power interruption. The signal VDD supplies power to all the logic circuitry (U3 pin 14 and U2 pin 28).

The oscillator for the microcontroller (U2) consists of OSC1, a ceramic resonator, and resistor R10. Pin 1 of OSC1 is connected to pin 27 of U2 and one side of R10. Pin 2 of OSCI is connected to pin 26 of U2 and the other side of R10. Pin 3 of OSCI is connected to VDD. OSC1 is stimulated by the microcontroller and resonates at a high frequency (e.g., 2.00 MHz). This provides the high frequency clock for the operation of the microcontroller. Resistor R10 provides feedback across the resonator to assure stability.

Figure 1A:
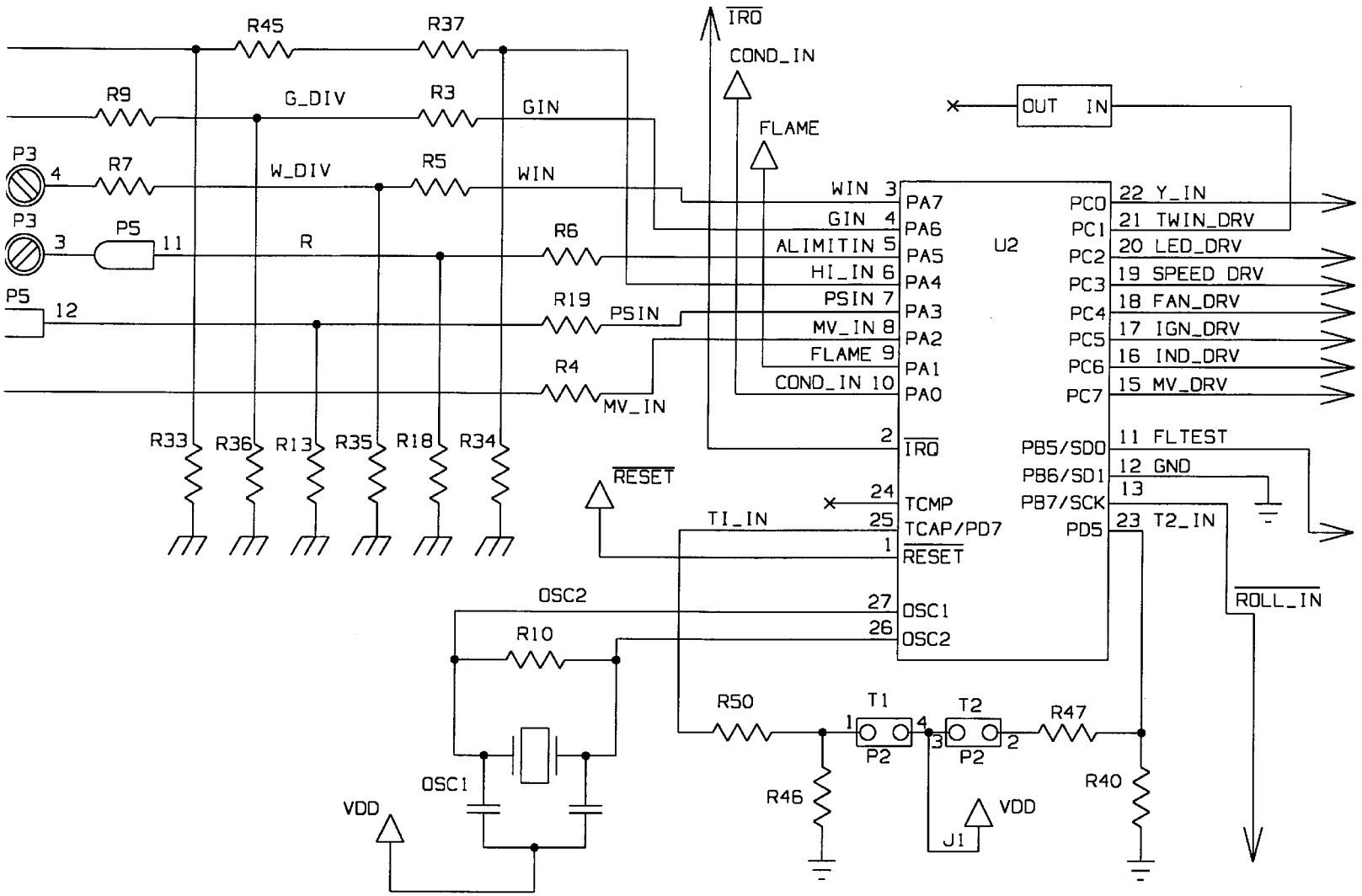
FIGS. 1*a*–1*d* together comprise a schematic circuit diagram of a control made in accordance with the invention.
Figure 1B:
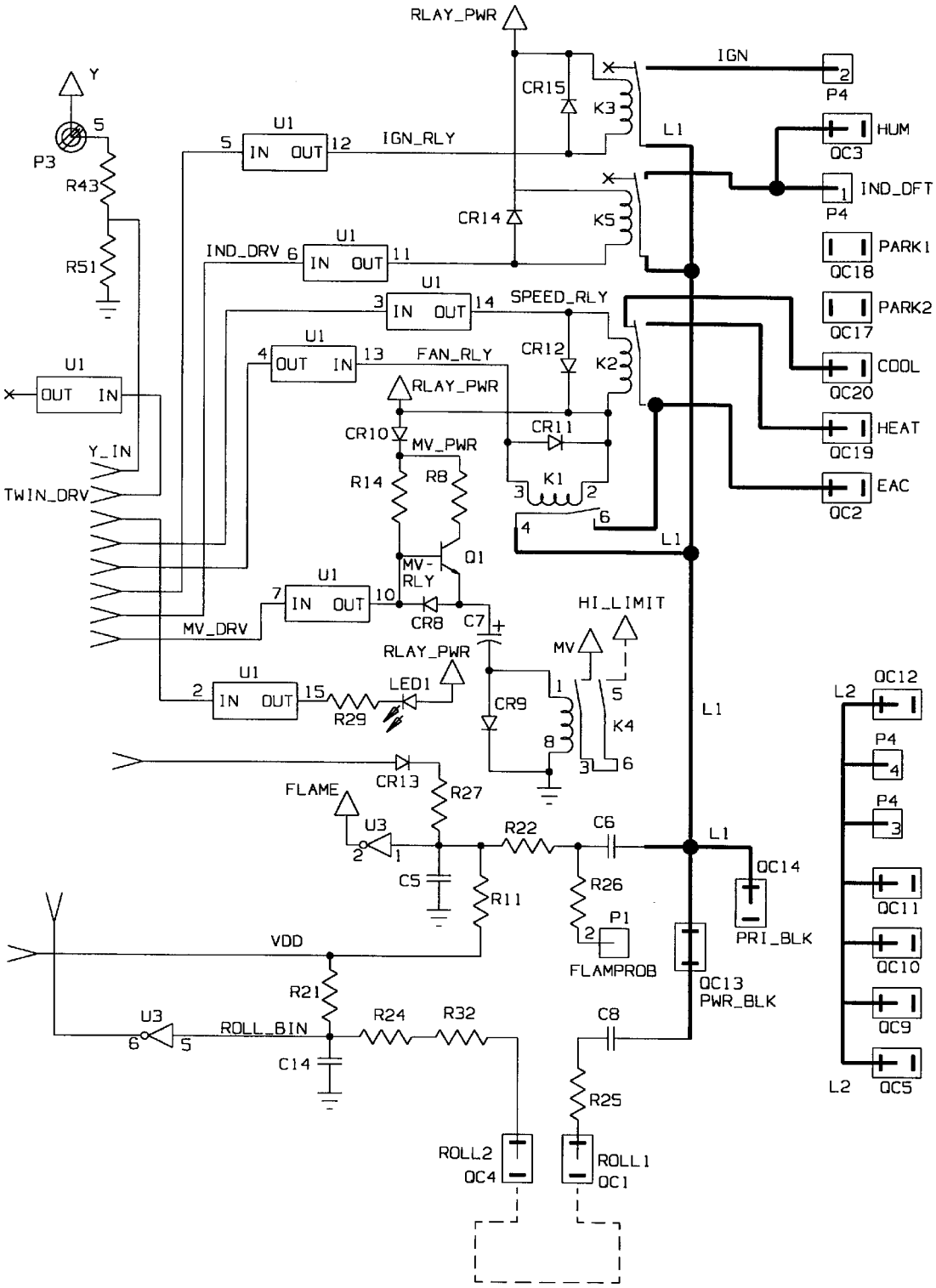
Figure 1C:
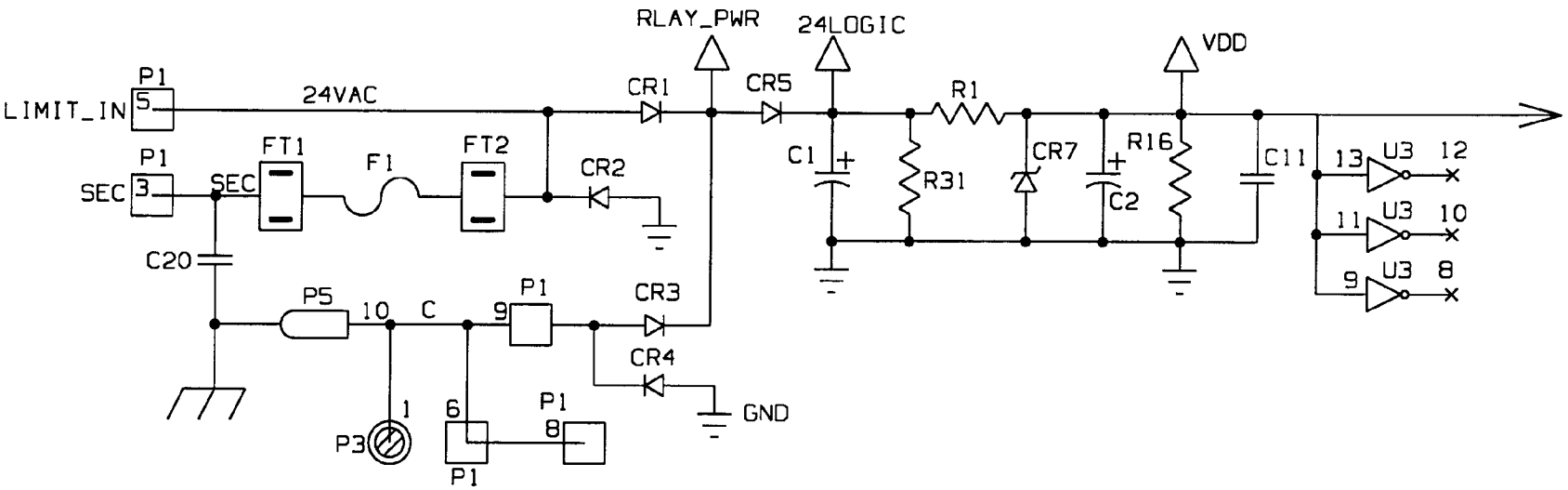
Figure 1D:
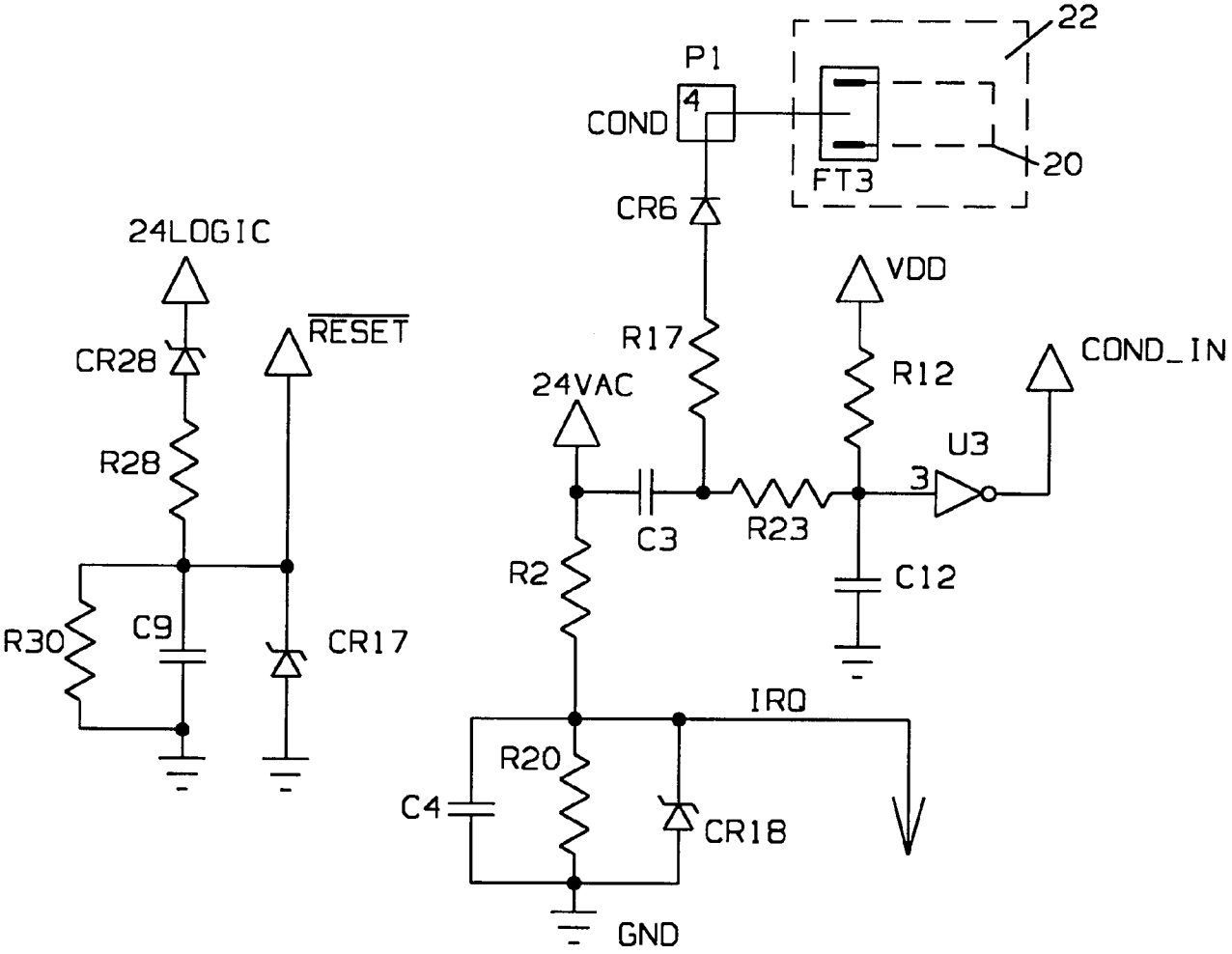

With reference to FIG. 1*d*, the signal 24LOGIC is also connected to the cathode of zener diode CR28. The anode of zener CR28 is connected to resistor R28. Zener CR28 acts as a voltage discriminator so that no current can flow through resistor R28 until the zener voltage is reached by the 24LOGIC signal. The other side of resistor R28 is connected to capacitor C9 (signal RESET') and the reset pin of the microcontroller U2 pin 1. The other side of capacitor C9 is connected to GND. The serial connection of resistor R28 and capacitor C9 create a delay in the RESET' signal at power up of the control. Zener CR17 and resistor R30 are connected across capacitor C9. Zener CR17 acts as a voltage limit to protect the microcontroller. Resistor R30 discharges capacitor C9 during power interruption.

Resistor R2 is connected to 24VAC and the interrupt pin of the microcontroller U2 pin 2 (signal IRQ'). Capacitor C4 is connected between IRQ' and GND and acts to filter the IRQ' signal. Zener diode CR18 is connected across capacitor C4 and protects the microcontroller from excessive voltage. Resistor R20 is also connected across capacitor C4 and acts to discharge capacitor C4 during power interruption. Signal IRQ' is a 5 volt DC, 60 Hz square wave (with 60 Hz, 24 VAC applied to the control). This signal forms the time base for all operations of the microcontroller.

Figure 2:
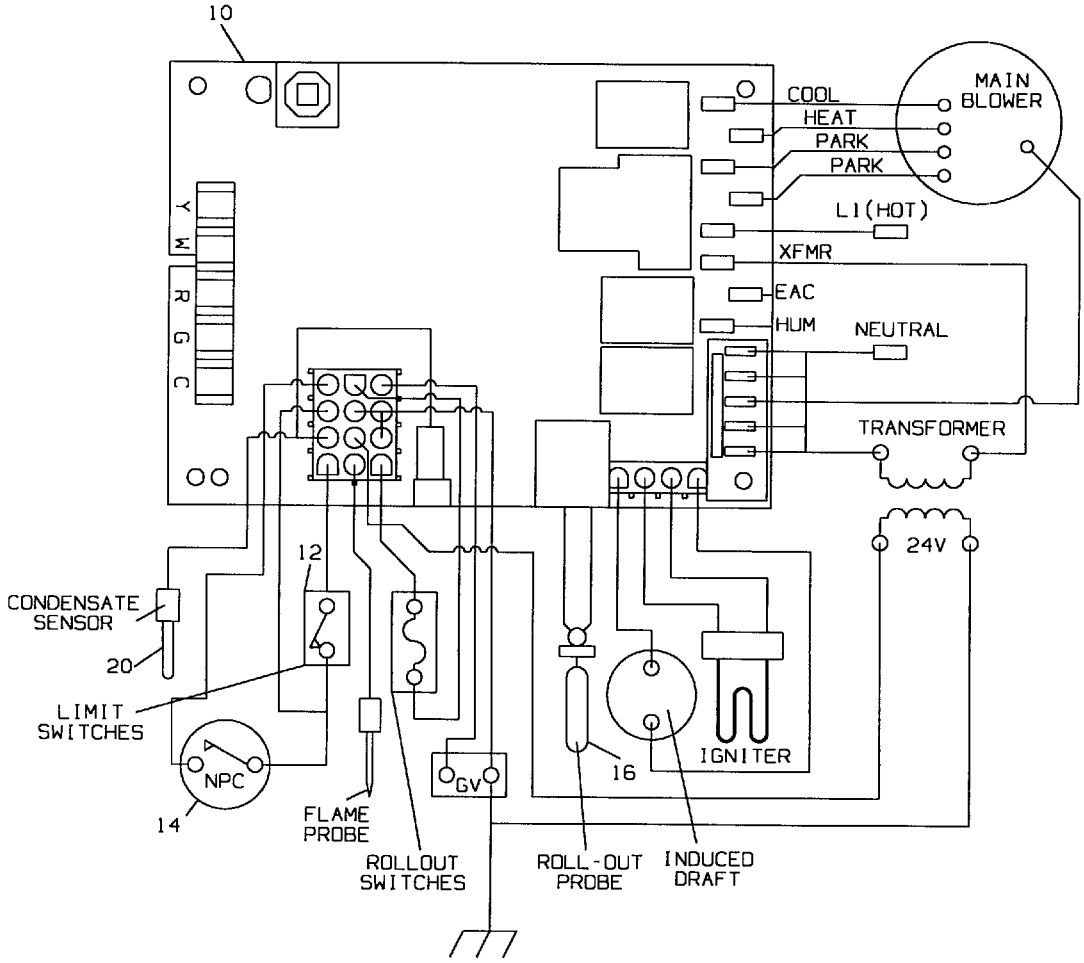
FIG. 2 is a schematic diagram showing system components and their connection to the control shown in FIG. 1.

Signal 24 VAC is output via pin 5 of connector p1 (FIG. 1*c*). This is connected to an external temperature limit (see switch 12, FIG. 2). The other side of the external limit is input to the control through pin 11 of P1 (signal R—FIG. 1*a*). The signal is pulled to Common through resistor R18 (when the limit switch is open, R is in phase with Common and when the limit is closed, R is in phase with 24 VAC). Resistor R6 is connected between R and pin 5 of U2 and limits the current flow into the microcontroller (signal RLIMITIN). Screw terminal P3 pin 3 outputs R to the room thermostat.

Signal W is generated by the room thermostat when the temperature falls below the set point. W is input to the control via screw terminal P3 pin 4. W is connected to resistor R7. The other side of resistor R7 is connected to resistor R35 while the other side of R35 is connected to Common. This connection creates a voltage divider w_DIV. This divider acts to discriminate voltages below 11 VAC. Resistor R5 is connected between W_DIV and pin 3 of U2 (signal WIN). Resistor R5 acts to limit current flow into the microcontroller.

Signal W is output to an external pressure switch (see switch 14, FIG. 2) via pin 1 of P1. The other side of the pressure switch is connected to one side of the thermally actuated high limit switch 12. This point is also routed into the control at P1 pin 10 (signal PS). This signal is pulled down by resistor R13 to Common such that if the pressure switch is open PS will be in phase with Common. If the pressure switch is closed PS will be in phase with W. Resistor R19 is connected between PS and pin 7 of U2 (signal PSIN). Thus the microcontroller is able to sense the condition of the pressure switch.

The other side of the high limit is input to the control via pin 7 of P1 (signal HI_LIMIT). This point is pulled down to Common through resistor R33. Again, if the high limit switch is open the HI_LIMIT will be in phase with Common but if it is closed then HI_LIMIT will be in phase with W.

Signal G is generated by the room thermostat when the fan is to be turned on. Signal G is input to the control via screw terminal P3 pin 2. Signal G is connected to resistor R9. The other side of resistor R9 is connected to resistor R36 while the other side of resistor R36 is connected to Common. This connection creates a voltage divider G_DIV. This divider acts to discriminate voltages below 11 VAC. Resistor R3 is connected between G_DIV and pin 4 of U2 (signal GIN). Resistor R3 acts to limit current flow into the microcontroller.

The condition of the gas valve is input via pin 12 of P1 (signal MV). Capacitor C10 is connected between MV and Common and acts to filter noise from the signal MV. Resistor R4 is connected between MV and pin 8 of U2 (signal MV_IN). Resistor R4 acts to limit current flow into the microcontroller. This allows the microcontroller to sense if voltage is applied to the gas valve.

Signal Y is generated by the room thermostat when the room temperature rise above the set point and the cooling unit is energized. Y is input to the control via screw terminal P3 pin 5 (FIG. 1*b*). Y is connected to resistor R43. The other side of resistor R43 is connected to Resistor R51 while the other side of resistor R51 is connected to common. This connection creates a voltage divider Y_IN connected to pin 22 of U2. This divider acts to discriminate voltages below 18 VAC. Resistor R43 acts to limit current flow into the microcontroller. This connection allows the microcontroller to sense the condition of the room thermostat signal Y.

Blower time delays (when the fan is being de-energized) in the heating mode may be selected by use of a two pin jumper J1 (FIG. 1*a*) and a four pin header connector P2. Pins 3 and 4 of P2 are connected to VDD. Pin 2 of P2 is connected to resistor R47 and pin 1 of P2 is connected to resistor R50. The other side of resistor R47 is connected to pin 23 of U2 (signal T2_IN). Resistor R40 is connected between T2_IN and GND to act as a ground reference for the signal to the microcontroller. The other side of resistor R50 is connected to pin 25 of U2 (signal Ti_IN). Resistor R46 is connected between pin 1 of P2 and GND. This references the signal Ti_IN to ground. The position of jumper J1 on the connector P2 may be detected by the microcontroller through the two signals Ti_IN and T2_IN.

U1 is a relay driver which is connected between the microcontroller and the relays. U1 amplifies the signals and interfaces the five volt signals of the microprocessor to the rectified relay power source RLAY_PWR. Pin 16 of U2 (signal IND_DRV) is connected to pin 6 of U1. The output of U1 (pin 11) is connected to one side of the K5 relay coil. The other side of the relay coil is connected to RLAY_PWR. Diode CR14 is connected across the coil to suppress back inductive flyback energy when the relay is turned off. The common terminal K5 is connected to the 120 VAC source (quick connects QC13 and QC14). The normally open terminal of K5 is connected to pin 1 of P4 (signal IND_DFT). This is output to an external motor which is used to force the venting of the combustion products of the gas furnace. Thus the microcontroller U2 is able to control the induced draft of the furnace. The neutral connection to the induced draft motor is provided via P4 pin 3 which is also connected to QC11, QC5, QC9, QC10, QC12 (signal L2). Signal IND_DFT is also connected QC3 (named HUM). QC3 provides an external connection to the humidifier of the heating system such that whenever combustion is occurring (i.e., the induced draft motor is operating) the humidifier will be energized.

Pin 17 of U2 (signal IGN_DRV) is connected to pin 5 of U1. The output of U1 (pin 12) is connected to one side of the K3 relay coil. The other side of the K3 relay coil is connected to RLAY_PWR. Diode CR15 is connected across the coil and acts to suppress back inductive flyback energy when the relay is turned off. The common terminal K3 is connected to L1 the 120 VAC source (quick connects QC13 and QC14). The normally open terminal of K3 is connected to pin 2 of P4 (signal IGN). This is output to an external silicon carbide igniter which is used to ignite the natural gas during a heating cycle of the gas furnace. Thus the microcontroller (U2) is able to control the HSI (hot surface igniter) of the furnace.

Pin 18 of U2 (signal FAN_DRV) is connected to pin 4 of U1. The output of U1 (pin 13) is connected to one side of the K1 relay coil. The other side of the K1 relay coil is connected to RLAY_PWR. Diode CR11 is connected across the coil to suppress back inductive flyback energy when the relay is turned off. The common terminal K1 is connected to L1 the 120 VAC source. The normally open terminal of K1 is connected to QC2 (signal EAC). QC2 is connected to an external electronic air cleaner such that whenever the relay Ki is energized the air cleaner will be energized also. The normally open terminal of K1 is also connected to the common terminal of K2. This allows 120 VAC to be connected to relay K2 when relay K1 is energized. Pin 19 of U2 (signal SPD_DRV) is connected to pin 3 of U1. The output of U1 (pin 14) is connected to one side of the K2 relay coil. The other side of the K2 relay coil is connected to RLAY_PWR. Diode CR12 is connected across the coil to suppress back inductive flyback energy when the relay is turned off.

The normally open terminal of K2 is connected to QC19 (signal HEAT). The normally closed contact of K2 is connected to QC20 (signal COOL). QC19 and QC20 are connected to motor speed taps of an external motor which acts as the main blower for the furnace. Thus microcontroller U2 is able to control the main blower and the speed at which the motor operates through energizing K1 and (or) K2. The neutral connection to the main blower is provided through one of the quick connectors QC11, QC5, QC9, CQ10, QC12 (signal L2).

Pin 20 of U2 (signal LED_DRV) is connected to pin 2 of U1. The output of U1 (pin 15) is connected to resistor R29 which is serially connected to the cathode of the light emitting diode LED1. The anode of LED1 is connected to RLAY_PWR. Resistor R29 limits current flow through the led. This enables microcontroller U2 to control LED1 to indicate various operating conditions of the gas furnace.

Pin 15 of U2 (signal NV_DRV) is connected to pin 7 of U1. The output of U1 (pin 10) is connected to the base of the transistor Q1 (signal NV_RLY). The anode of diode CR10 is connected to RLAY_PWR while the cathode is connected to MV_PWR. Diode CR10 acts to isolate the power from the gas valve relay circuit. The signal MV_PWR is connected to resistors R8 and R14. The other side of resistor R8 is connected to the collector of Q1 and provides current limiting to the transistor Q1. The other side of resistor R14 is connected to the base of Q1 (signal NV_RLY) and provides bias current for the transistor. The cathode of diode CR8 is connected to base of Q1 while the anode is connected to the emitter of Q1. This diode prevents excessive reverse bias voltage from occurring across the base emitter junction of Q1 when the transistor is turned on and off by the microcontroller. The emitter of Q1 is also connected to capacitor C7. The other side of capacitor C7 is connected to the coil of relay K4. The other side of the K4 relay coil is connected to GND. Diode CR9 is connected across the coil to suppress back inductive flyback energy when the relay is turned off. Capacitor C7 acts to store energy and provide filtering of the current flowing though the coil of relay K4 when the transistor Q1 is turned on and off. The connection and values of diodes CR10, CR8, CR9, transistor Q1, resistor R8, R14, and capacitor C7 create a negative charge pump which is applied to the coil of relay K4. This charge pump is selected so that a voltage sufficient to energize relay K4 will occur if transistor Q1 is turned on and off at a rate between 400 Hz and 2000 Hz. If the transistor is driven at any other frequency (including 0 Hz, i.e., DC) then insufficient voltage will be generated across the relay coil to energize relay K4. This scheme insures that if the microcontroller stops executing its microcode properly that the gas valve relay K4 will be de-energized. The common terminals (pins 3 and 6) of relay K4 are connected together. This places the two normally open contacts of the K4 relay in series to further improve the reliability and safety of the gas valve relay. One normally open terminal of relay K4, pole 1, is connected to HI_LIMIT and is the 24 VAC power source for the gas valve when relay K4 is energized. This insures that if the high temperature limit opens due to excessive temperature in the gas furnace that the gas valve must be de-energized. The other normally open terminal of relay K4, pole 2, is connected to pin 12 of P1 (FIG. 1*a*). Pin 12 of P1 is connected to an external gas valve of the gas furnace. Thus, the microcontroller is able to control the gas valve through the described components and connections.

On one side of capacitor C6 is connected to signal L1 (120 VAC). The other side of the capacitor is connected to resistors R26 and R22. The other side of the R26 (signal FLAMPROB) is connected to pin 2 of P1 which is attached to an external flame probe. Capacitor C6 provides DC isolation for the flame sense circuitry and coupling of the AC to the flame probe. Resistor R26 acts to limit current flow in case of a short of the flame probe to ground. The other side of resistor R22 is connected to the input of U3 (pin 1) which is a CMOS inverter (e.g., MC14069UB). The input of U3 is also connected to resistor R11 and the other side of resistor R11 is connected to VDD. Resistors R11 and R22 set the bias level and sensitivity for the input to inverter U3. Capacitor C5 is also connected to the input of inverter U3. The other side of capacitor C5 is connected to ground GND. Capacitor C5 filters the AC component of the flame signal. When the flame probe which is attached to pin 2 of P1 is immersed in a flame, a DC current will flow from C6 through the flame to earth ground (which is connected to Common of the 24 VAC supply in the furnace). If this DC current is of sufficient magnitude (such as 1 microamp), capacitor C5 will be discharged and the input to inverter U3 will be low. This will cause the output of inverter U3 (pin 2 signal FLAME) to go to VDD. The output of inverter U3 is connected to microcontroller U2 pin 9. This allows the microcontroller to sense the presence of a flame in the gas furnace.

Pin 11 of microcontroller U2, output (signal FLTEST), is connected to the anode of diode CR13. The cathode of diode C13 is connected to resistor R27. The other side of resistor R27 is connected to the input of inverter U3 (pin 1). These connections allow the microcontroller to measure the flame quality and test the flame sense circuitry described above. A detailed description of this technique is contained in commonly assigned U.S. Pat. No. 5,506,569, the subject matter of which is incorporated herein by this reference.

The flame roll-out detection circuit is described as follows. One side of capacitor C8 is connected to signal L1 (120 VAC) with the other side connected to resistor R25. The other side of resistor R25 is serially connected to connector QC1 (signal ROLL1). Capacitor C8 acts to provide DC isolation from the 120 VAC and coupling of the AC current from 120 VAC. Resistor R25 acts to limit current flow from the 120 VAC. Capacitor QC1 is connected externally to flame roll-out probe 16 shown in dashed lines which surrounds the inlet to the combustion chamber of the furnace. Connector QC4 (signal ROLL2) is also connected to flame probe 16. The significance of these two external connections will be presently discussed. Connector QC4 is further connected to the serial combination of resistors R32 and R24. The other side of resistor R24 is connected to resistor R21, capacitor C14 and the input of inverter U3 (pin 5). The other side of resistor R21 is connected to VDD. Resistors R21, R32, and R24 set the bias level and the sensitivity of the input to inverter U3. The other side of capacitor C14 is connected to ground GND. Capacitor C14 acts to provide filtering and phase shifting of the AC component of the flame roll-out signal.

These connections and components provide for a circuit such that when connectors QC1 and QC4 are both connected to the flame roll-out probe, AC current flows from connection QC1 to connector QC4 via the flame roll-out probe. This causes capacitor C14 to alternately charge and discharge based on the voltage of the L1 signal. As capacitor C14 charges to a high level the output of inverter U3 (pin 6) will go low. Likewise, when capacitor C14 discharges to a low level the output of inverter U3 will go high. The output of inverter U3 is further connected to pin 13 of U2 (signal ROLL_IN'). Resistors R21, R24, and R32 combined with capacitor C14 produce a time delay in the alternating high-low signal from inverter U3 to the microcontroller. The microcontroller can measure this time delay by referencing it to IRQ' (pin 2 of U2).

Notably, if either of the connections from connector QC1 or QC4 are removed from flame roll-out probe, current will not flow and the output of inverter U3 will no longer alternate high-low but it will remain simply low. This allows the microcontroller to detect the validity of the connections to the flame roll-out probe. Furthermore, if either of the connections from connectors QC1 and QC4 are shorted to earth ground the alternating high-low will be shifted to be in phase with the signal C (note that C is 180 degrees out of phase with IRQ' since IRQ' is generated from 24 VAC).

If the flame roll-out probe is immersed in flame (a condition called a flame roll-out since flame has escaped or rolled out of the inlet to the combustion chamber), DC current will flow from L1 (through the serial connections of capacitor C8, resistor R25, and connector QC1) through the flame to earth ground. This DC current flow will cause a phase shift in the alternating high-low signal at the output pin 6 of inverter U3. The microcontroller can measure this phase shift and detect the presence of the flame. In the presence of a large flame current (5ua or greater) capacitor C14 will completely discharge and the output pin 6 of inverter U3 will go high. This allows the microcontroller to take appropriate action (e.g., turning off the gas valve, energizing the induced draft relay and main blower) to insure maximum safety.

Figure 3:
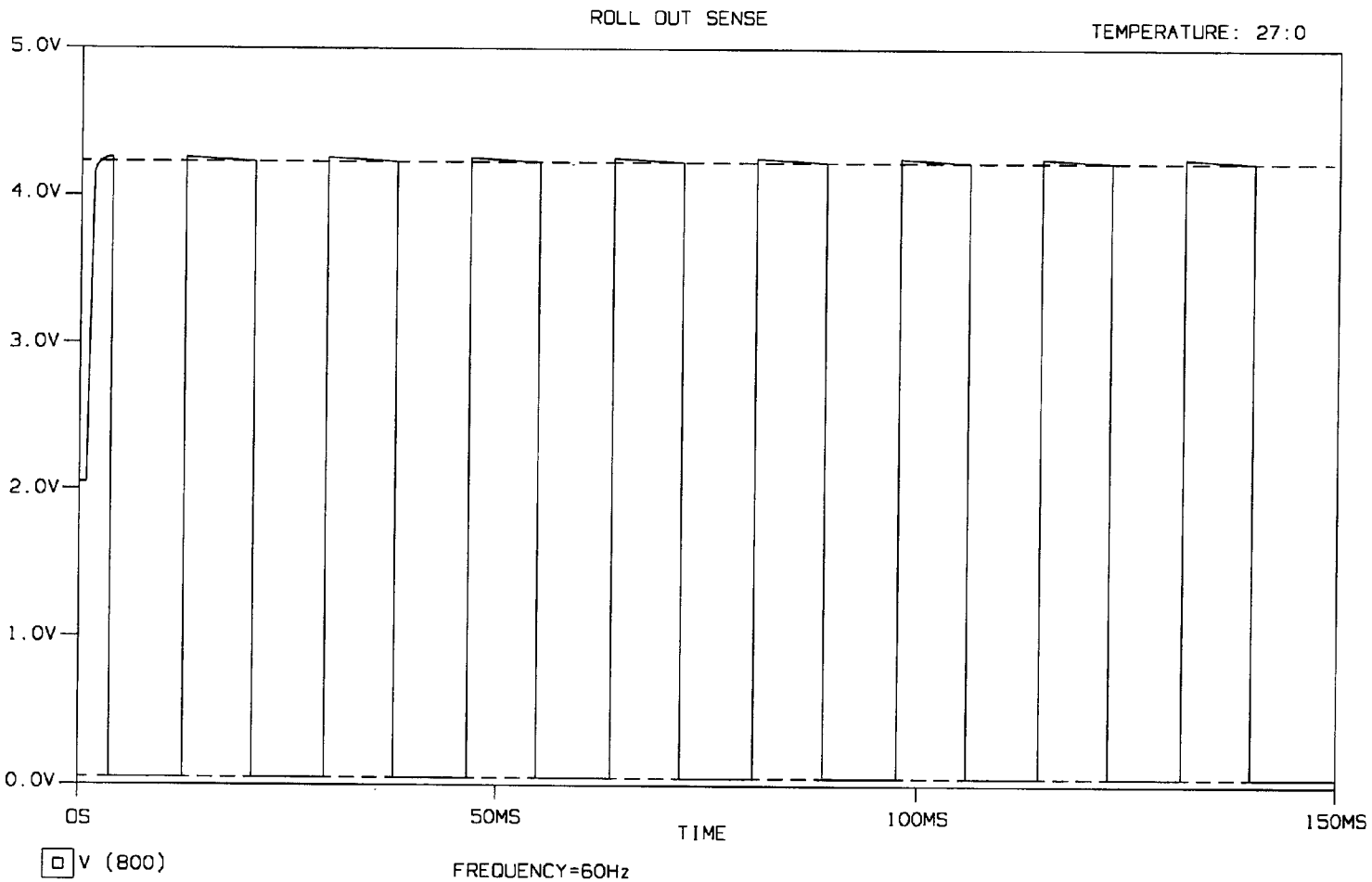
FIGS. 3–6 are diagrams showing voltage wave forms responsive to various conditions including normal (no faults or roll-out)—FIG. 3; roll-out (flame outside the combustion chamber)—FIG. 4; broken sensor wires or probe shorted to chassis ground—FIG. 5; open capacitor in roll-out sense network—FIG. 6.
Figure 4:
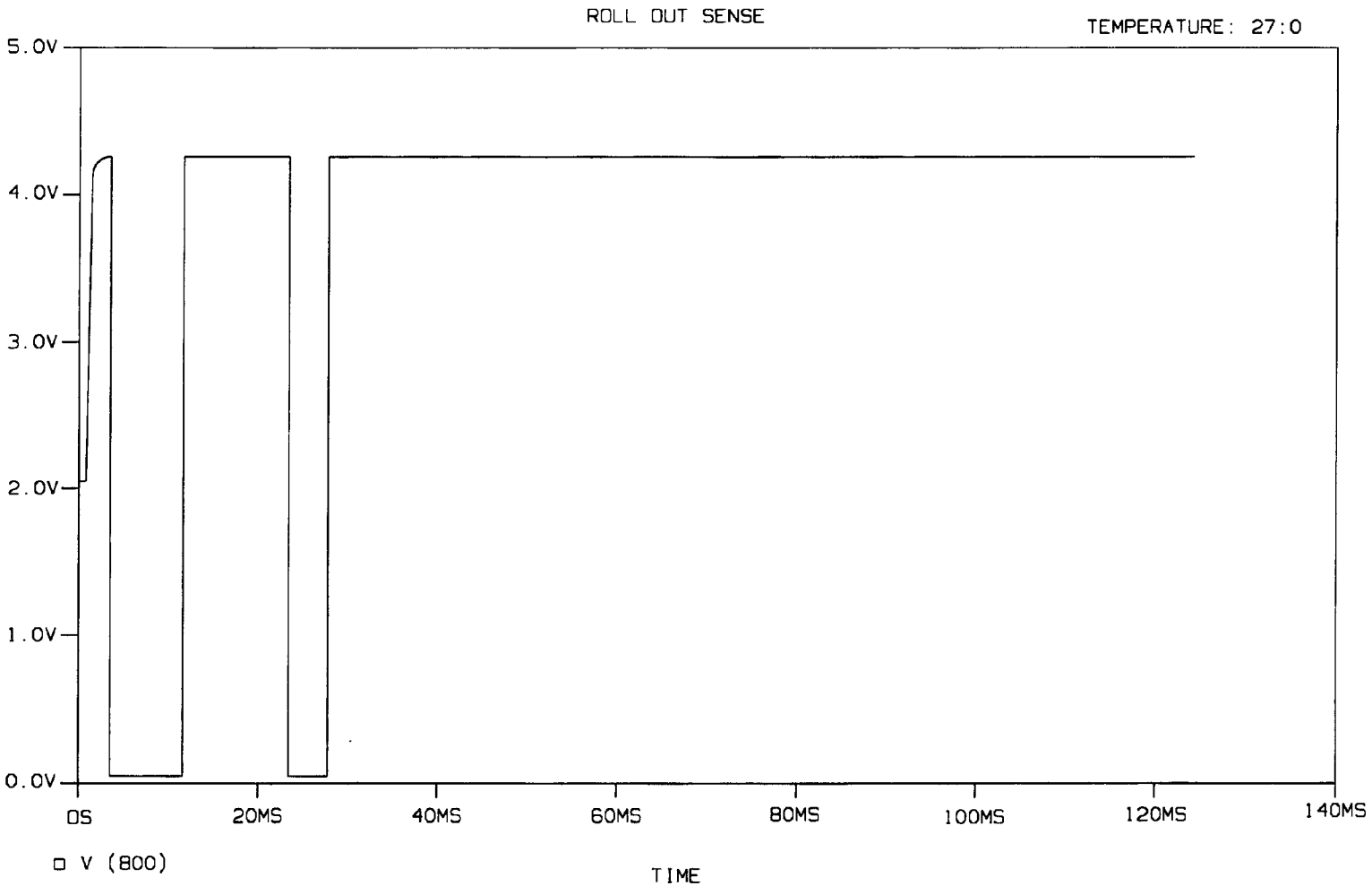
Figure 5:
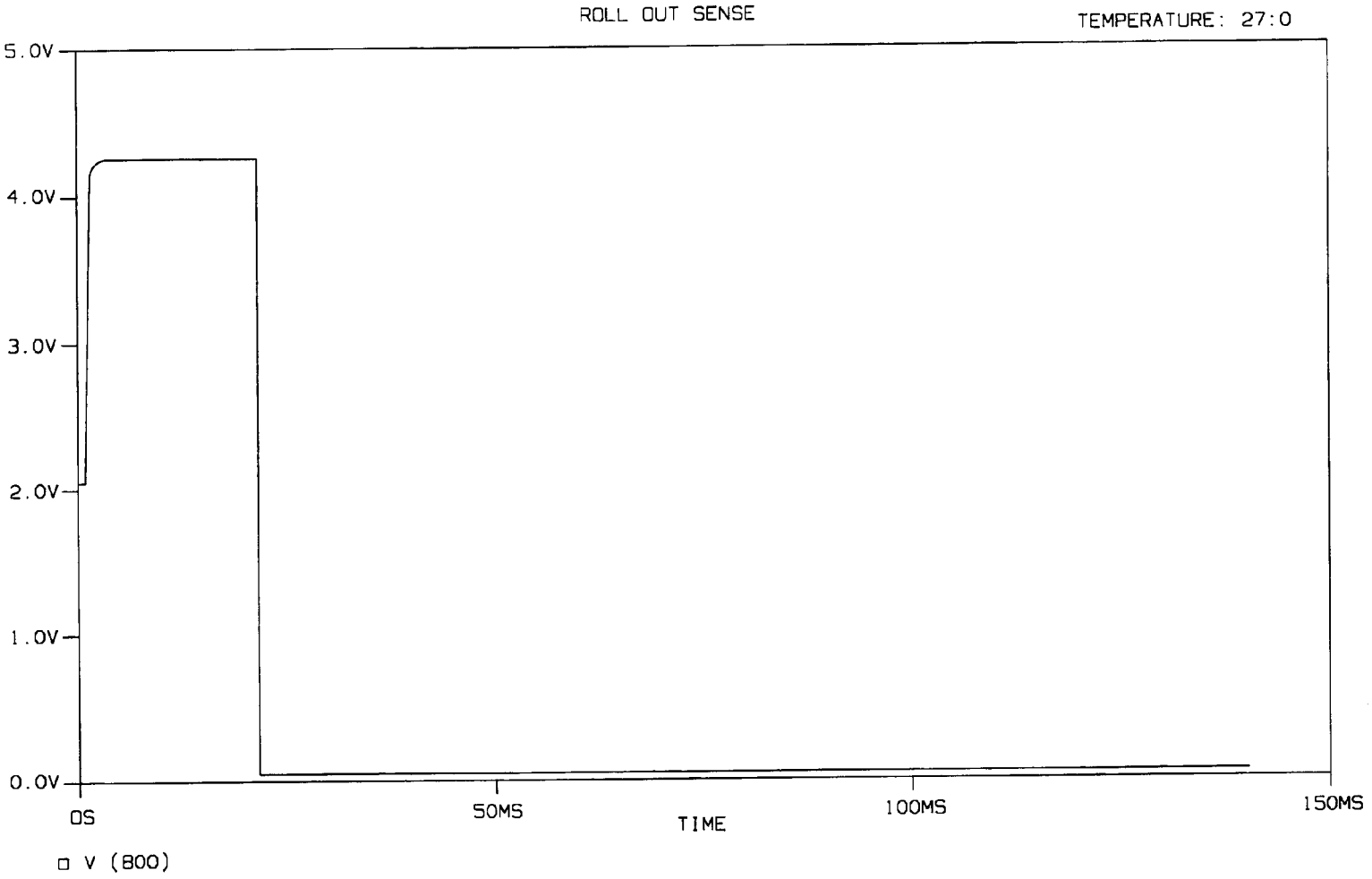
Figure 6:
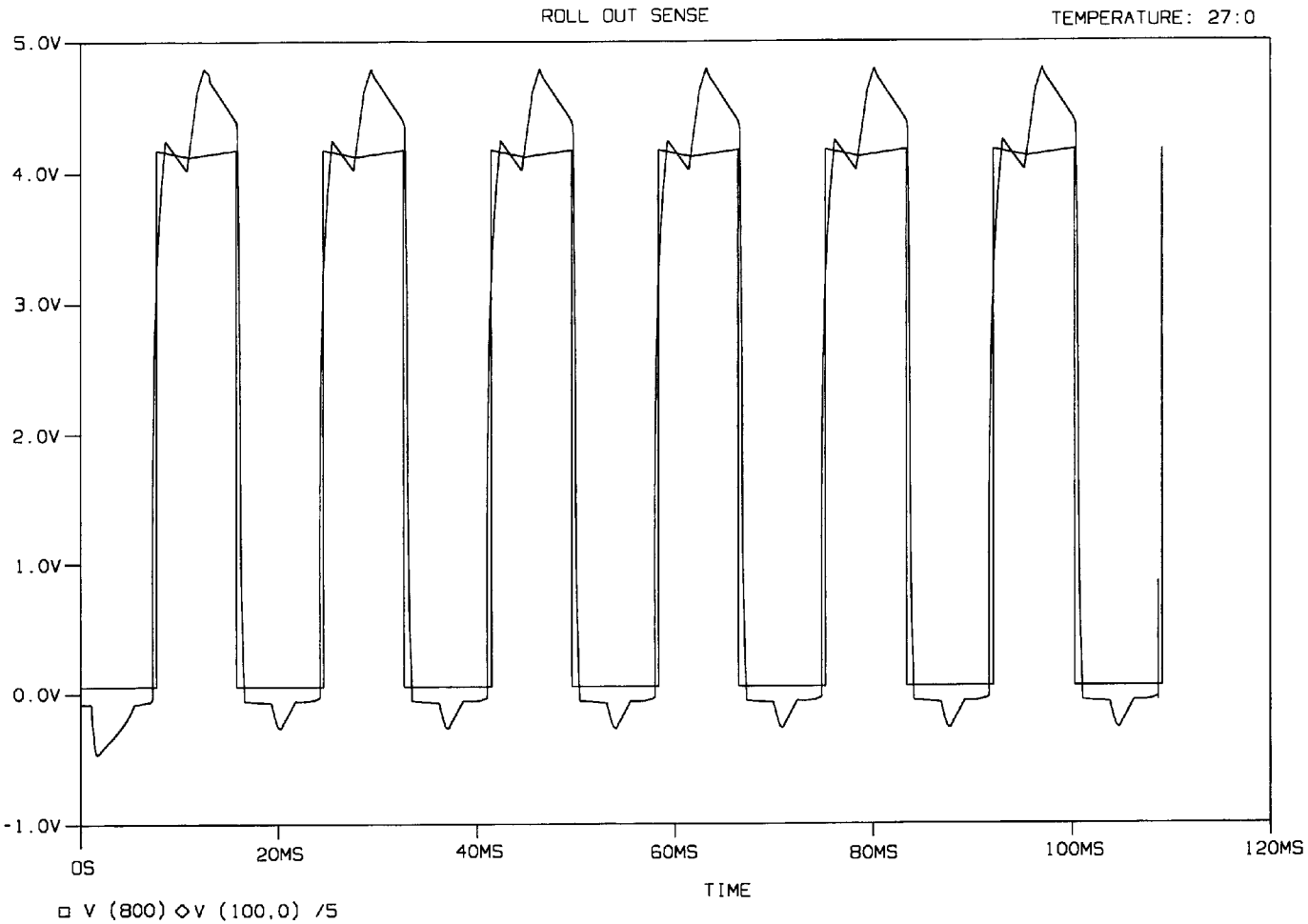

FIGS. 3–6 show wave forms resulting from the response of the flame roll-out detection circuit to various conditions. FIG. 3 shows the output of inverter U3 (pin 6) with no flame roll-out. FIG. 4 shows the output of inverter U3 (pin 6) going high when flame rectification occurs due to flame roll-out. FIG. 5 shows the output of inverter U3 (pin 6) when probe 16 is shorted to ground GND through the furnace chassis. This is the same waveform which results when one or both of the wires to probe 16 is broken. FIG. 6 shows the result of an open capacitor C14 of the detection circuit which causes the inverter output to be in phase with the line voltage.

The condensate sense circuit is described as follows with particular reference to FIG. 1*d*. One side of Capacitor C3 is connected to 24 VAC (P1 pin 5). The other side of the capacitor is connected to resistors R17 and R23. The other side of resistor R17 is connected to the anode of diode CR6. The cathode of diode CR6 is connected to P1 pin 4 and female quick connect FT3 (signal COND). P1 pin 4 and FT3 are externally connected to a condensate probe (a simple stainless steel rod). This rod is placed in the condensate collection box of a condensing gas furnace. Resistor R17 limits current from the 24 VAC source. Capacitor C3 provides DC isolation and AC coupling of the 24 VAC power source. Resistor R23 is further serially connected to the input of inverter U3 (pin 3). The input of inverter U3 is also connected to capacitor C12 and resistor R12. The other side of resistor R12 is connected to VDD and the other side of capacitor C12 is connected to GND. Resistors R12 and R23 set the bias and sensitivity level of the input of the inverter U3. Under normal conditions (i.e., no condensate present), capacitor C12 will be charged to a high level. This causes the output of inverter U3 to go low. The output of inverter U3 is connected to pin 10 of microcontroller U2. If the condensate drain is blocked condensate will build in the condensate box until it comes in contact with the condensate probe. Once contact is made, current will flow from the 24 VAC power source (through the serial connection of capacitor C3, resistor R17, diode CR6, and pin 4 of P1) through the condensate probe into the metal of the combustion chamber which is connected to earth ground. If this DC current flow is of sufficient magnitude, capacitor C12 will be discharged to a low level and the output of inverter U3 (pin 4) will go high. Thus the microcontroller can detect the condensate build-up and take appropriate action (e.g., stopping combustion and energizing the induced draft motor to remove additional moisture from the combustion chamber of the furnace).

A control made as shown in FIGS. 1*a*–1*d* comprised the following components:

| | | |
|---|---|---|
| U2 | microcontroller | 68HC05P7 |
| F1 | fuse | 3 amp |
| Q1 | transistor | MSPA06 |
| R1, R33 | resistors | 1.5K ohm, 1W, 5% |
| R8 | resistor | 47.5K ohm, ¼W, 1% |
| R31 | resistor | 10.0k ohm, ¼W, 1% |
| CR6, CR8, CR10 | diode | 1N4148 |
| CR1–CR5, CR9, CR11, CR12, CR14, CR15 | diode | 1N4007 1 amp |
| CR7, CR17 | diode | 5.1V, 5% |

-continued

| | | |
|---|---|---|
| CR28 | diode | 12V, 5% |
| U1 | IC | ULN2003A |
| K2, K3, K5 | relay | T70 SPDT 22V |
| R14, R18, R27, R29 | resistor | 10K ohm, ⅛W, 5% |
| R2–R6, R17, R19, R20, R24, R37, R40, R43, R45, R46 | resistor | 100K ohm, ⅛W, 5% |
| R12, R25, R26 | resistor | 1M ohm, ⅛W, 5% |
| R32 | resistor | 10M ohm, ⅛W, 5% |
| R23 | resistor | 1.5M ohm, ⅛W, 5% |
| R16 | resistor | 2K ohm, ⅛W, 5% |
| R51 | resistor | 51K ohm, ⅛W, 5% |
| R11 | resistor | 5.1K ohm, ⅛W, 5% |
| R21, R22 | resistor | 7.5M ohm, ⅛W, 5% |
| R28, R30 | resistor | 39K ohm, ⅛W, 5% |
| C4 | capacitor | .01 uF, 50V, 20% |
| C14 | capacitor | .015 uF, 50V, 10% |
| R13 | resistor | 470 ohm, 2W, 5% |
| C2 | capacitor | 10 uF, 16V |
| C1 | capacitor | 47 uF, 50V |
| C7 | capacitor | 100 uF, 50V |
| CR13 | diode | 1N458A |
| LED1 | LED, red | |
| C6, C8 | capacitor | 1000 pF, 1KV, 10% |
| U3 | IC | CD4069 |
| C3, C5 C10, C11, C12, C20 | capacitor | .1 uF, 100V, 10% |
| K1 | relay | T9A, SPST |
| K4 | relay | DPST, 24V |
| C9 | capacitor | .47 uF, 50V |
| R7, R9 | resistor | 560 ohm, 2W, 5% |
| R47, R50 | resistor | 20K ohm, ⅛W, 5% |
| R35, R36 | resistor | 100 ohm, 2W, 5% |
| R10 | resistor | 30K, ⅛W |

Figure 7C:
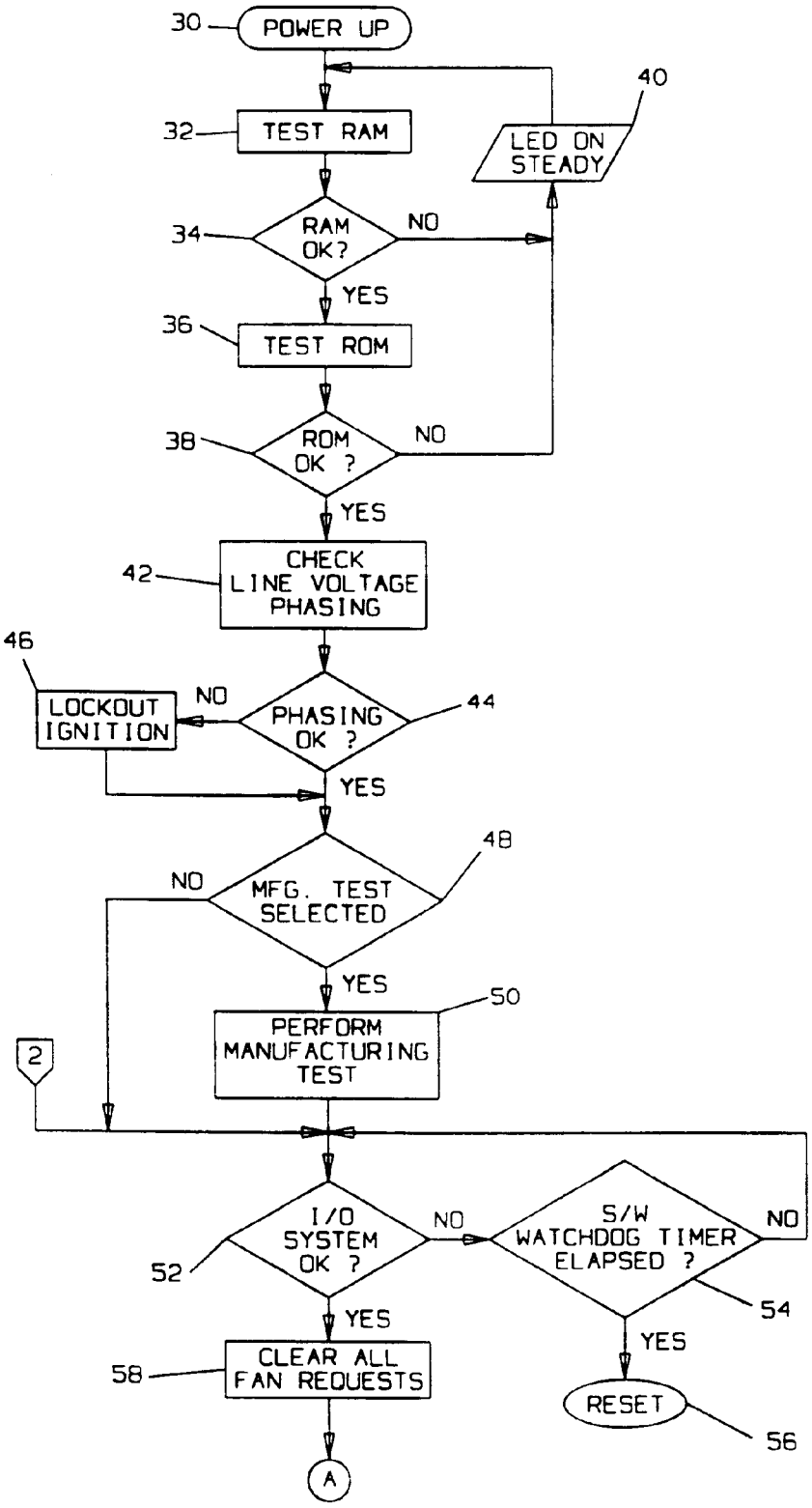
Figure 7B:
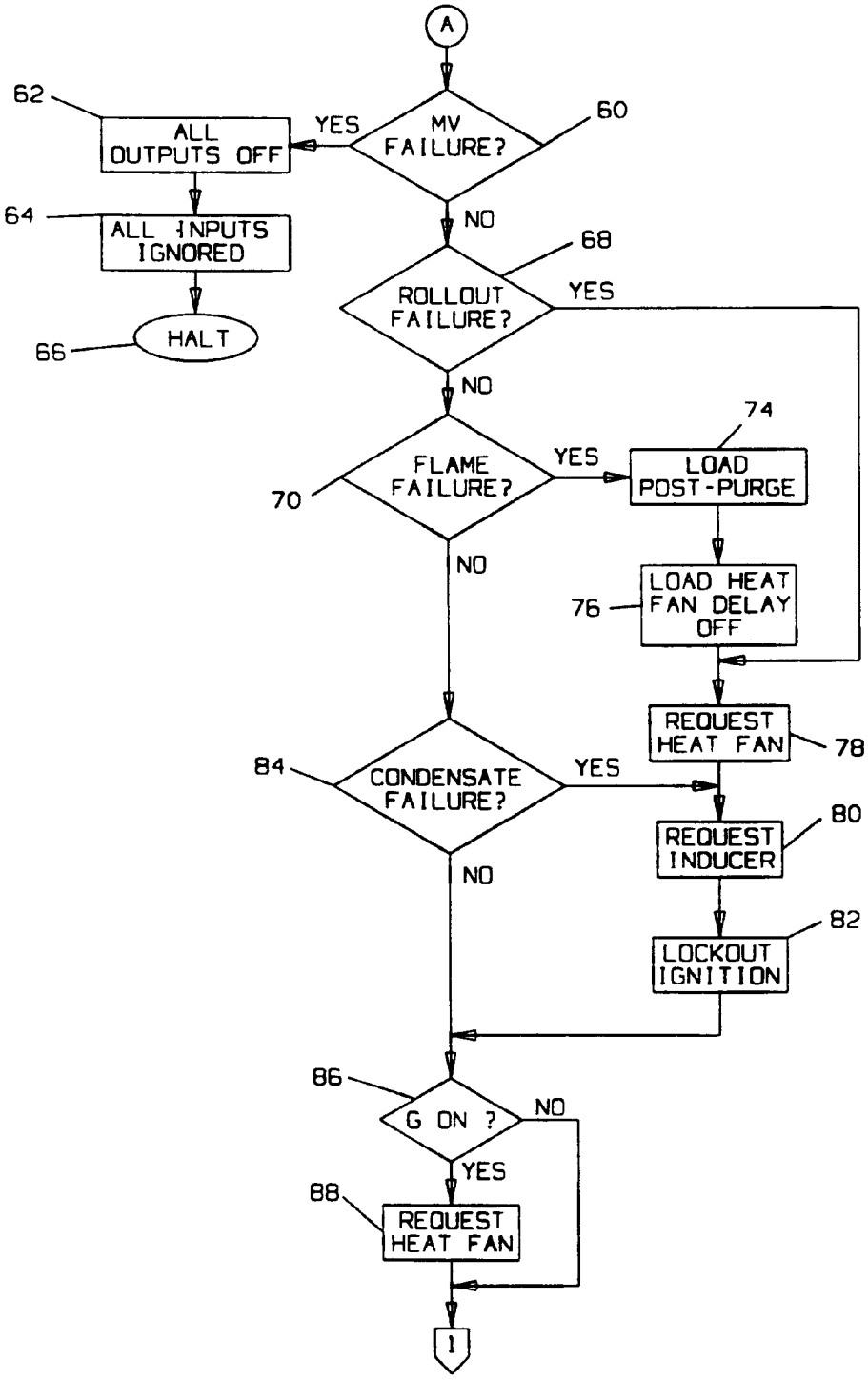
Figure 7C:
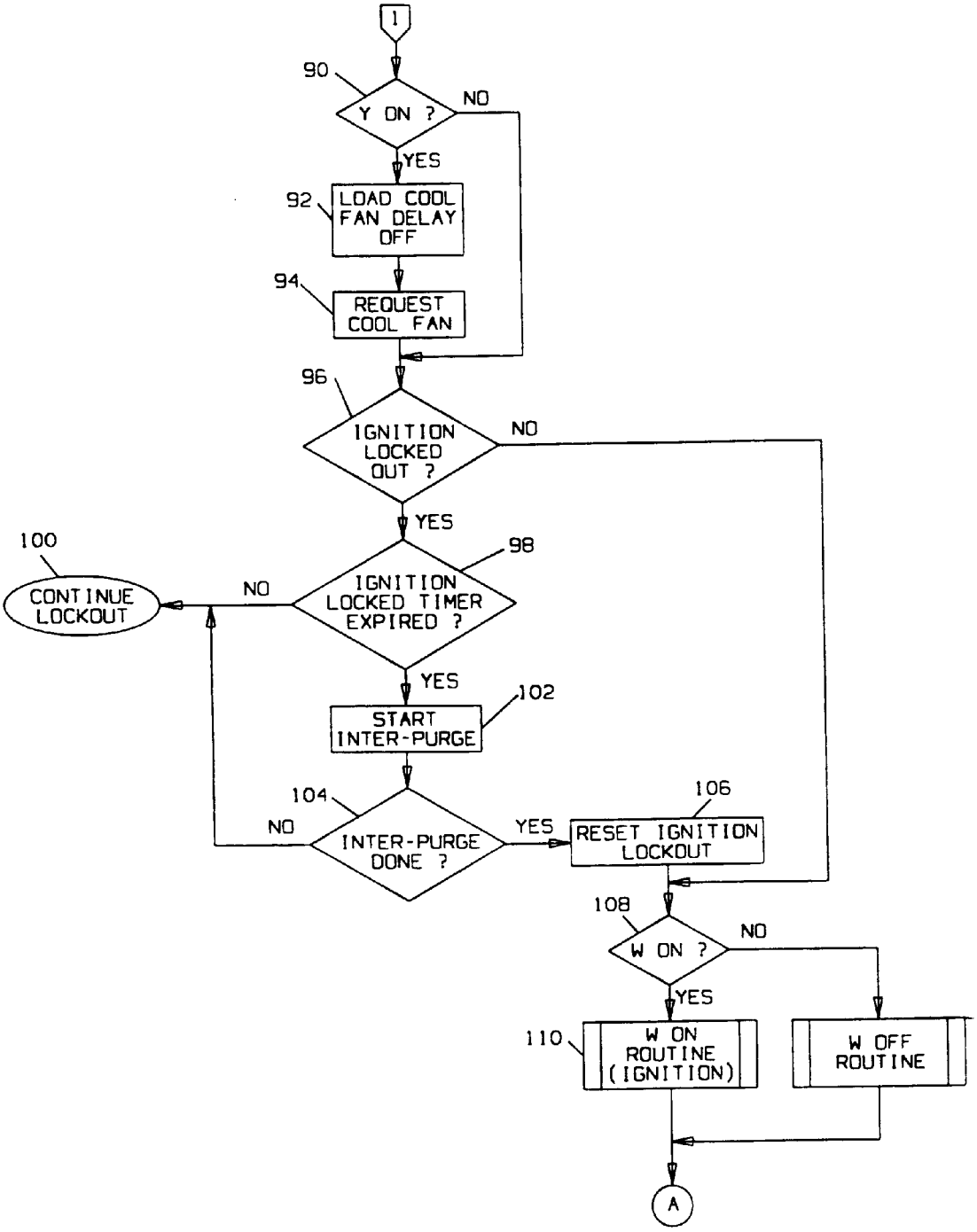

FIGS. 7*a*–7*h* show the software flow charts for operation of microcontroller U2 in accordance with the invention. In FIG. 7*a* upon power-up at 30 The RAM and ROM of microcontroller U2 is tested in steps 32–40. Line voltage phasing and a manufacturing test is performed in steps 42–58 to point A. Continuing on from point A in FIG. 7*b* from steps 60–86 various conditions are checked including main valve failure, roll-out failure, flame failure, and condensate failure. At decision block 86 the routine checks to see if the thermostat signal G is present and if so requests the cool fan at step 88 and goes to point 1. If signal G is not present, the routine skips step 88. As shown in FIG. 7*c* the routine looks for the thermostat signal Y and controls the cool fan accordingly at steps 90–94. Ignition lock-out is checked at decision block 96 and related lock-out steps at steps 98–106. Decision block 108 checks for the presence of thermostat signal W and then goes to the signal W on routine at 110 or the signal W off routine at 112.

Figure 7D:
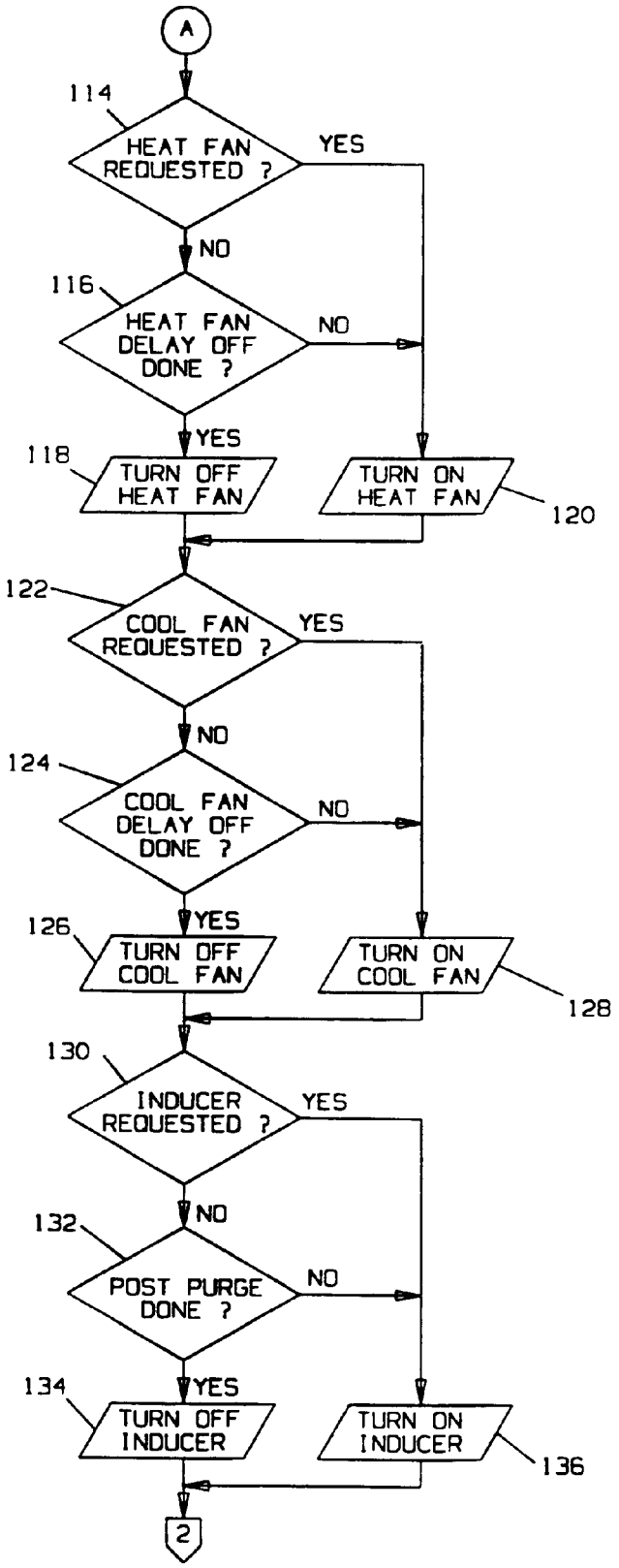

Decision block 114 and related steps 116–120 in FIG. 7*d* checks to see if the heat fan request is present and then at decision block 122 and related steps 124–128 if the cool fan request is present. Steps 130–136 relate to inducer fan request. The routine then returns to point 2 shown in FIG. 7*a* at decision block 52.

Figure 7E:
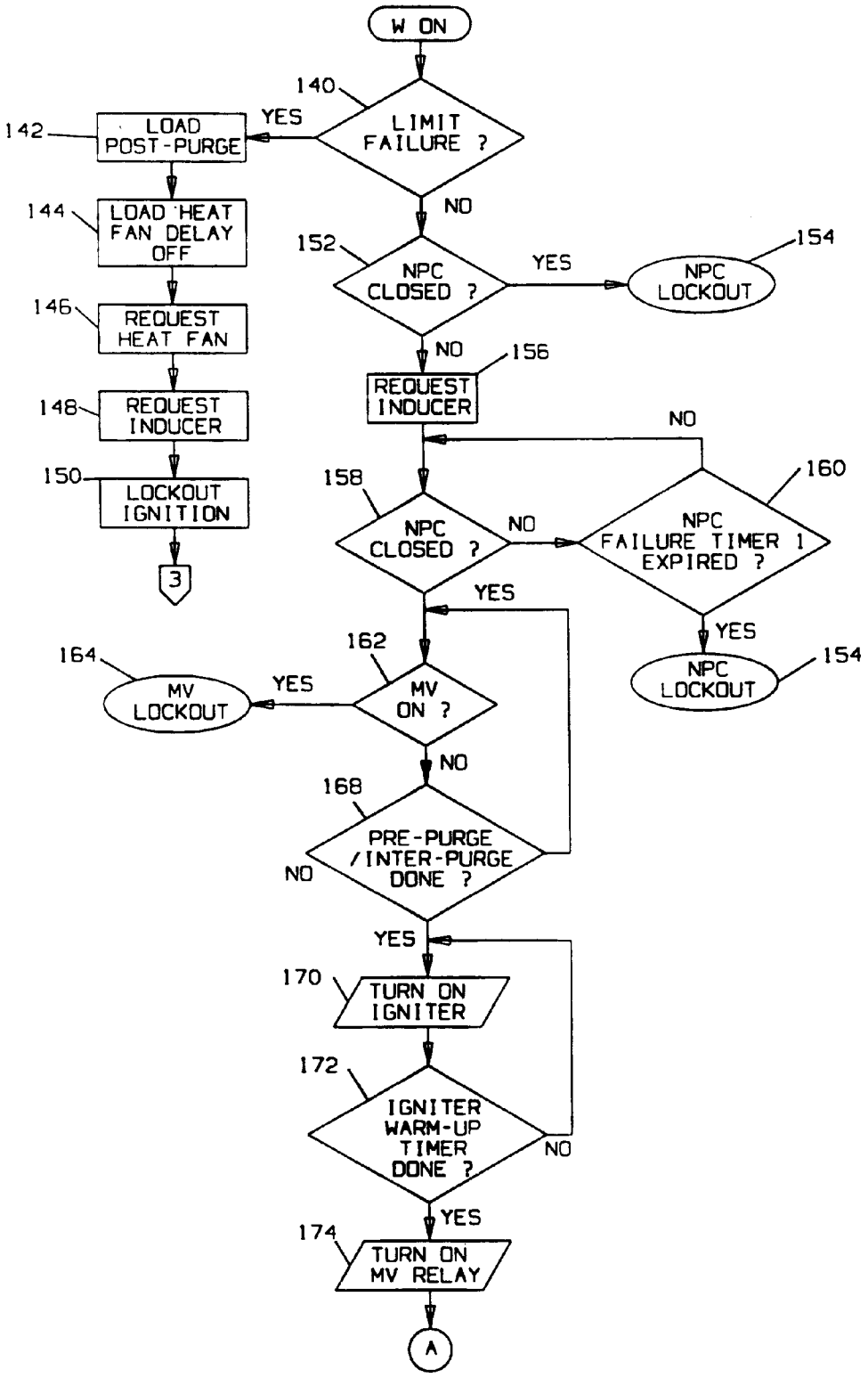

With reference to the W on routine in FIG. 7*e*, decision block 140 checks for a limit switch failure and if there is one, goes through steps 142–150 and if not checks to see if the negative pressure control is closed at decision blocks 152 and 158. If the negative pressure control is closed then the status of the main valve is checked at block 162 and the pre-purge/inter-purge sequence at step 168. If the main valve is not on and step 168 has been completed, the igniter is turned on at step 170 and after the timer of step 172 the main valve relay is turned on at step 174.

Figure 7F:
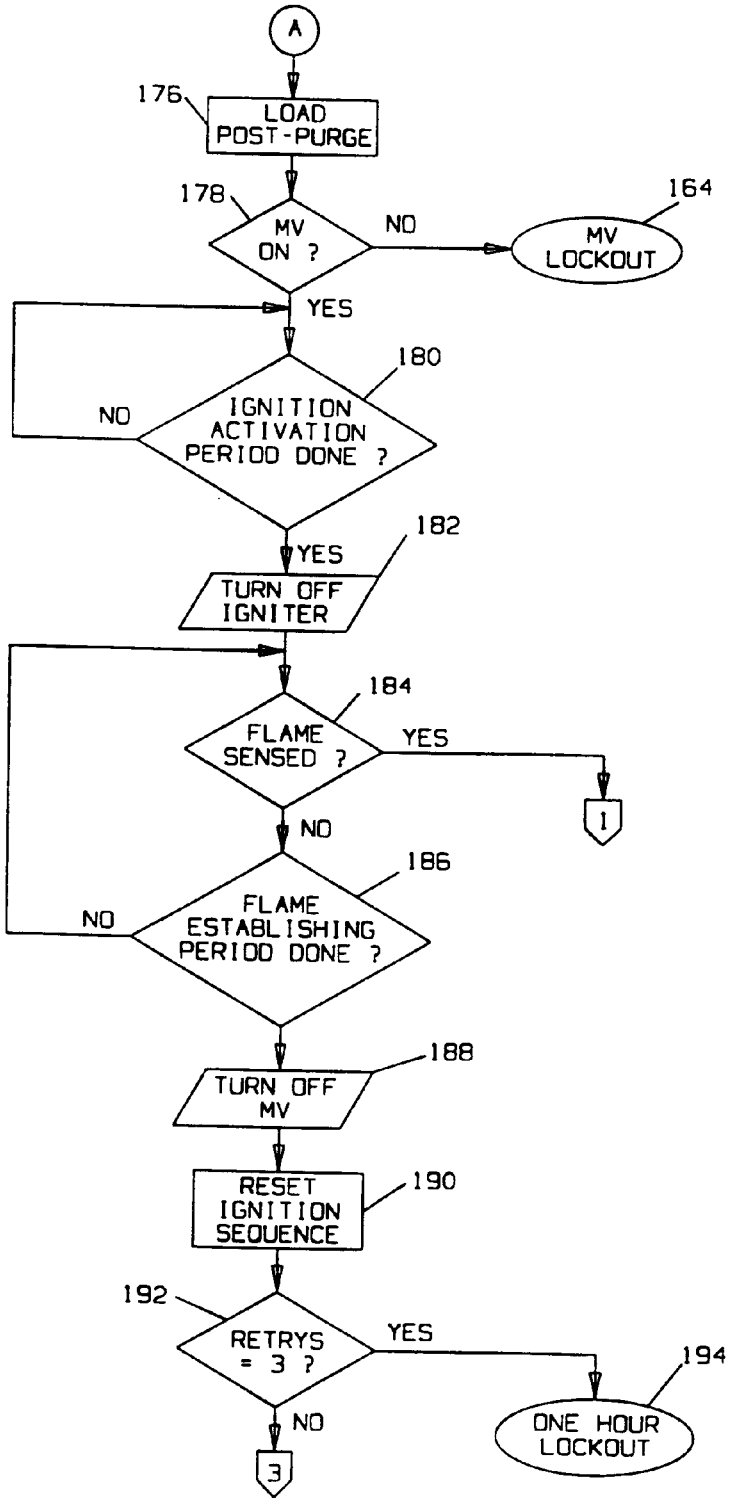

The post purge is loaded at step 176 of FIG. 7*f*, then the status of the main valve is checked at step 178. If the main valve is on, decision block 180 checks to see if the ignition activation period has been completed and when it is completed the igniter is turned off at step 182. Flame sense is checked at step 184 and if it is not present and the flame establishing period is completed (step 186) the main valve is turned off at step 188. The ignition sequence is reset at steps 190–194.

Figure 7G:
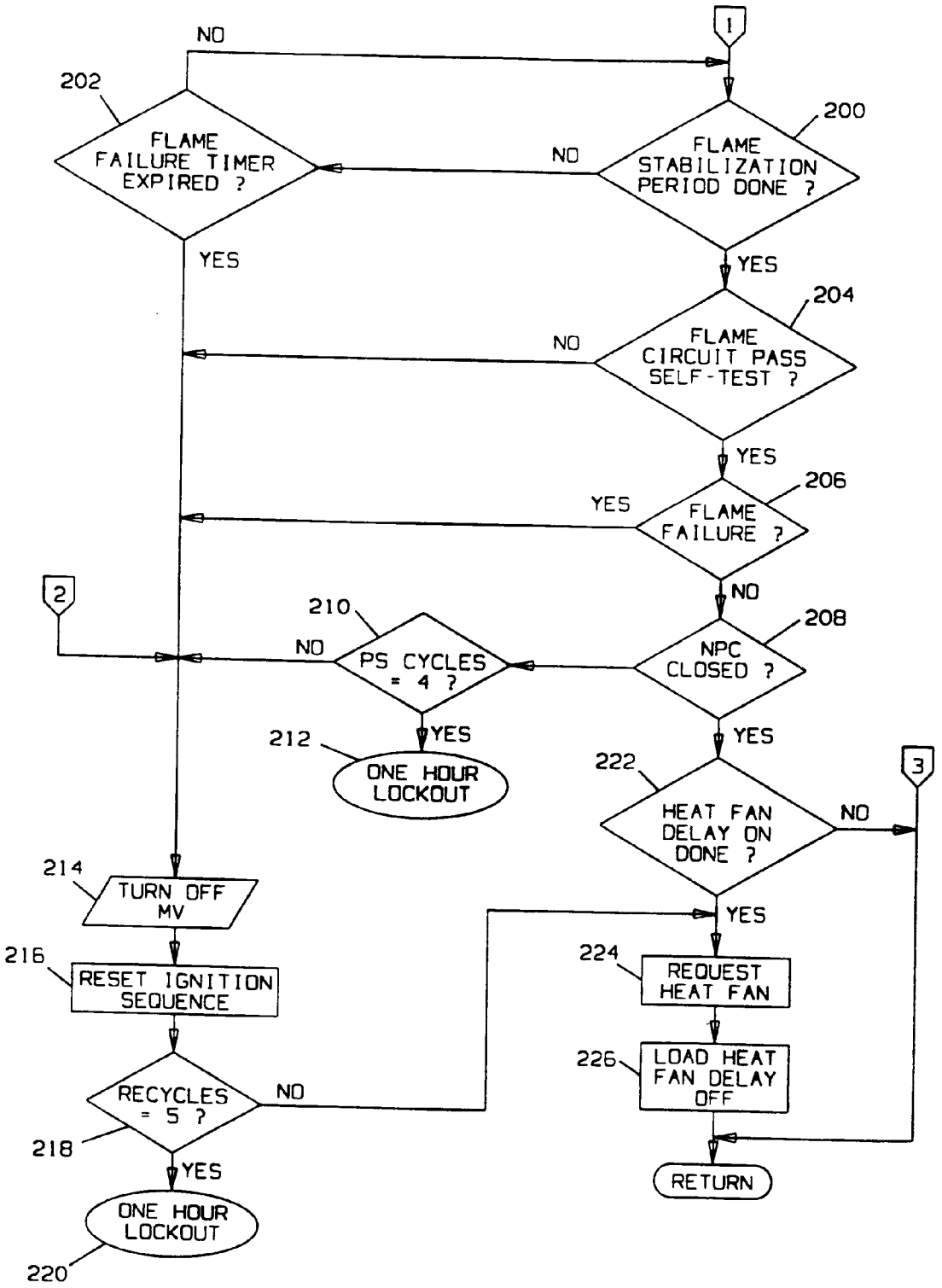

From point 1 shown in FIG. 7*g*, flame characteristics are checked in decision block 200 to 206, the status of the negative pressure control is checked at step 208 and whether the heat fan delay on has been completed in step 222. If the delay is done, step 224 requests the heat fan and step 226 loads heat fan delay off. Going back to decision block 208, if the negative pressure control is not closed step 210 checks to see if a selected number of cycles has occurred. If they have occurred then there is a one hour lock-out at 212 and if they have not occurred then the main valve is turned off at 214 which is also turned off if the flame failure timer of decision block 202 has expired, the flame circuit does not pass self test of decision block 204 or if there is a flame failure in decision block 206. After turning off the main valve the ignition sequence is reset at step 216. Decision block 218 checks to see if 5 cycles have occurred and if not the routines goes to step 224, request heat fan. If 5 cycles have occurred then there is a one hour lock-out at 220.

Figure 7H:
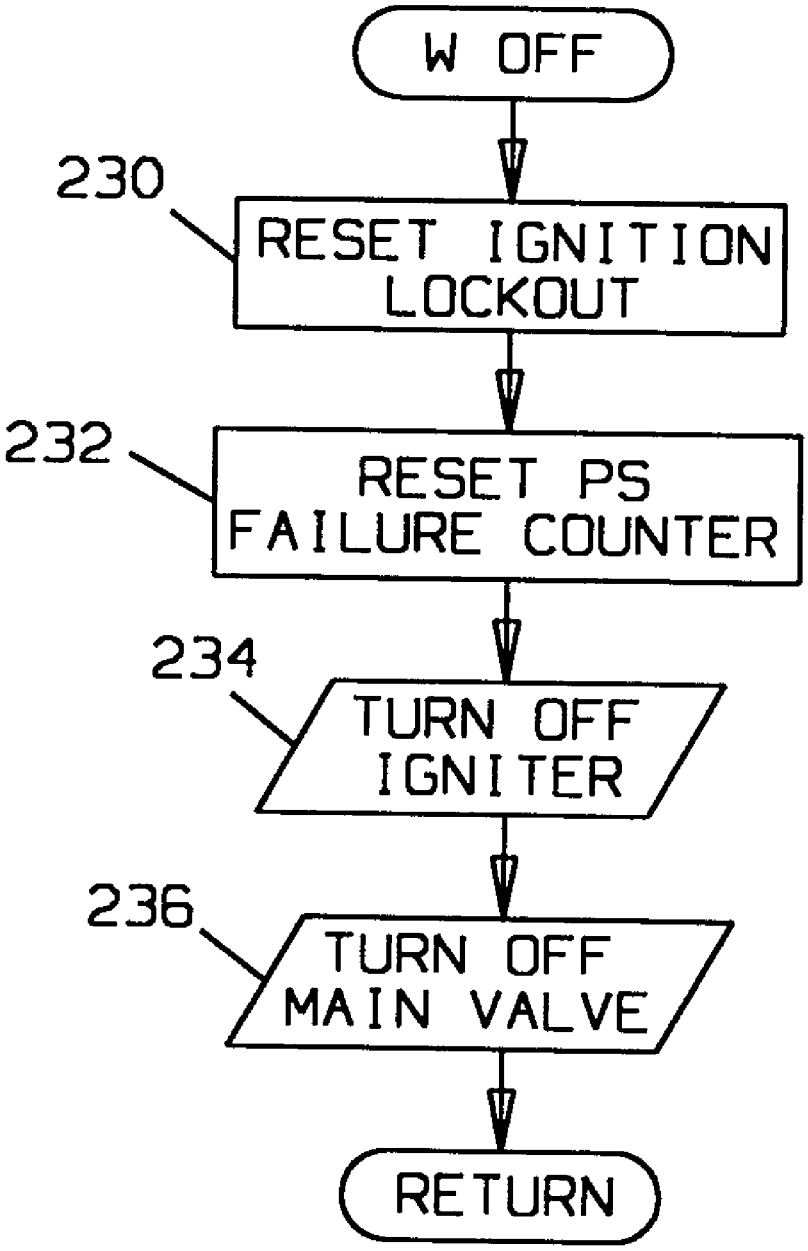

FIG. 7*h* shows the thermostat signal W off routine comprising resetting the ignition lock-out at step 230, resetting the pressure switch failure counter at step 232, turning off igniter at 234, turning off the main valve at 236 and finally returning.

Various additional changes and modifications can be made in the above described details without departing from the nature and spirit of the invention. It is intended that the invention will not be limited to the details except as set forth in the appended claims.

The LST file is set forth below:

```
09/17/96 59527-2.lst page 1
M6805 Portable Cross Assembler  0.05   MS-DOS/PC-DOS  Page 1
 Fri Aug 09 15:30:31 1996
Command line:
 c:\6805\pasm\PASM05.EXE  dxs -l 59527-2.lst 59527-2.asm
Options list:
ON  - b - Printing of macro definitions
ON  - c - Printing of macro calls
ON  - d - Placing of symbolic debugging information in COFF  (changed)
OFF - e - Printing of macro expansions
ON  - f - Printing of conditional directives
OFF - g - Printing of generated constants .list
OFF - q - Expanding and printing of structured syntax
ON  - s   Printing of symbol table  (changed)
OFF - u   Printing of conditional unassembled source
ON  - x   Printing of cross reference table  (changed)
OFF - m - Suppress printing of error messages
ON  - w - Printing of warning messages
OFF - v - Suppress printing of updated status
OFF - y - Enabling of sgs extensions
ON  - o - Create object code
ON  -   - Formatting of source line listing
Create listing file : l - 59527-2.lst

Xdefs:
  NONE

Xrefs:
  NONE

Input file(s): 59527-2.asm (127 lines)
               P7EQU.ASM (80 lines) EQUATES.ASM (166 lines)
               RMBS.ASM (108 lines) CRCVAL.ASM (16 lines)
               PNCRY.ASM (24 lines) SYSINIT.ASM (155 lines)
               RAMCHK.ASM (45 lines) ROMCHK.ASM (76 lines)
               MAIN.ASM (687 lines) MISCSUB.ASM (79 lines)
               IRQ.ASM (216 lines) TIMER.ASM (389 lines)

Output file: 59527-2.o
Listing file: 59527-2.lst
```

```
M6805 Portable Cross Assembler  0.05  59527-2.asm  Page 2
 Fri Aug 09 15:30:31 1996
Options : MD,MC,NOG,NOU,W,NOMEX,CL,PMT,O

LINE   S PC   OPCO OPERANDS S LABEL    MNEMO OPERANDS COMMENT
00001                        ***********************************************************************
00002                        *                                                                     *
00003                        *        MODULE NAME : 6IF-B0.ASM                                     *
00004                        * ORIGINAL AUTHOR(S) : MARK EIFLER                                    *
00005                        *              PURPOSE : THIS IS THE LINKER MODULE FOR THE 6IF-2 BOARD WHICH IS *
00006                        *                        IS A HOT SURFACE IGNITION/FAN CONTROL BOARD FOR YORK *
00007                        *                                                                     *
00008                        *                        TARGET MICRO-CONTROLLER - MOTOROLA MC68HC05P7 *
00009                        *                                                                     *
00010                        *      DATE      REV    REVISOR    CHANGES MADE                       *
00011                        *      ----      ---    -------    ------------                       *
00012                        *                 A       N/A       INITIAL VERSION                    *
00013                        *                                                                     *
00014                        ***********************************************************************
00015
00016                        ***********************************************************************
00017                        ************************                       ************************
00018                        ************************     PASM DIRECTIVES SECTION   ************************
00019                        ************************                       ************************
00020                        ***********************************************************************
00021                        *
00022                        *        NO DIRECTIVES
00023                        *
00024                        ***********************************************************************
00025                        ************************                       ************************
00026                        ************************        EQUATES SECTION        ************************
00027                        ************************                       ************************
00028                        ***********************************************************************
00029
00030                                INCLUDE P7EQU.ASM P7 equates module
00031                                OPT   NOL
00014                                OPT   L
00015
00016                        ***********************************************************************
00017                        *                                P7 EQUATES                           *
00018                        ***********************************************************************
00019
00020  P 0000      0000     A PORTA    EQU   $00      PortA is an I/O port, 8 bits
00021  P 0000      0001     A PORTB    EQU   $01      PortB is an I/O port and SIOP, 3 bits
00022  P 0000      0002     A PORTC    EQU   $02      PortC is an I/O port, 8 bits
00023  P 0000      0003     A PORTD    EQU   $03      PortD has one I/O port(bit 5), and bit 7
00024                        *                                  is used for input or TCAP
00025                        *
00026  P 0000      0004     A DDRA     EQU   $04      Data Direction Reg. for PORTA
00027  P 0000      0005     A DDRB     EQU   $05      Data Direction Reg. for PORTB
00028  P 0000      0006     A DDRC     EQU   $06      Data Direction Reg. for PORTC
00029  P 0000      0007     A DDRD     EQU   $07      Data Direction Reg. for PORTD...
00030                        *                                  ... 1's for outputs & 0's for inputs
00031                        *
00032  P 0000      000a     A SCR      EQU   $0A      SIOP Control Register
00033  P 0000      0004     A MSTR     EQU   4        master(1)/slave(0) mode bit of SCR
00034  P 0000      0006     A SPE      EQU   6        serial port enable bit of SCR
```

09/17/96 S9527-2.lst page 2

M6805 Portable Cross Assembler 0.05 P7EQU.ASM Page 3
Fri Aug 09 15:30:31 1996
Options - MD,MC,NOG,NOU,W,NOMEX,CL,FMT,O

```
LINE   S PC   OPCO OPERANDS S LABEL    MNEMO OPERANDS COMMENT
00035                         *
00036  P 0000      000b      A SSR      EQU   $0B     SIOP Status Register
00037  P 0000      0006      A DCOL     EQU   6       data collision bit of SSR
00038  P 0000      0007      A SPIF     EQU   7       serial transfer complete of SSR
00039                         *
00040  P 0000      000c      A SDR      EQU   $0C     SIOP Data Register
00041                         *
00042  P 0000      0012      A TCR      EQU   $12     Timer Control Register
00043  P 0000      0000      A OLVL     EQU   0       output level compare bit of TCR
00044  P 0000      0001      A IEDG     EQU   1       input capture edge mode bit of TCR...
00045                         *                                  ... 0 - falling, 1 - rising
00046  P 0000      0005      A TOIE     EQU   5       timer overflow interrupt enable bit of TCR
00047  P 0000      0006      A OCIE     EQU   6       output compare interrupt enable bit of TCR
00048  P 0000      0007      A ICIE     EQU   7       input capture interrupt enable bit of TCR
00049                         *
00050  P 0000      0013      A TSR      EQU   $13     Timer Status Register
00051  P 0000      0005      A TOF      EQU   5       timer overflow flag bit of TSR
00052  P 0000      0006      A OCF      EQU   6       output compare flag bit of TSR
00053  P 0000      0007      A ICF      EQU   7       input capture flag bit of TSR
00054                         *
00055  P 0000      0014      A TCAPHI   EQU   $14     Timer Capture Register high bits
00056  P 0000      0015      A TCAPLO   EQU   $15     Timer Capture Register low bits
00057                         *
00058  P 0000      0016      A TCMPHI   EQU   $16     Timer Compare Register high byte
00059  P 0000      0017      A TCMPLO   EQU   $17     Timer Compare Register low byte
00060                         *
00061  P 0000      0018      A TCNTHI   EQU   $18     Timer Counter Register high byte
00062  P 0000      0019      A TCNTLO   EQU   $19     Timer Counter Register low byte
00063                         *
00064  P 0000      001a      A ALTCNTHI EQU   $1A     Alternate Timer Counter Register high byte
00065  P 0000      001b      A ALTCNTLO EQU   $1B     Alternate Timer Counter Register low byte
00066                         *
00067  P 0000      1ff0      A WDOG     EQU   $1FF0   writing a 0 to bit 0 clears Watch Dog
00068  P 0000      0080      A P7RAM    EQU   $0080   P7 RAM locatinns $0080 - $00FF
00069  P 0000      0100      A P7ROM    EQU   $0100   P7 ROM locations $0100 - $08FF
00070  P 0000      0900      A P9MOR    EQU   $0900   P9 MOR byte
00071  P 0000      0020      A AUXROM   EQU   $0020   P7 auxillary ROM locations $0020 - $004F
00072  P 0000      004f      A AUXROMEND EQU  $004F   end of available auxillary ROM
00073  P 0000      1ff8      A P7VCTRS  EQU   $1FF8   P7 Vectors locations $1FF8 - $1FFF
00074  P 0000      00ff      A RAMEND   EQU   $00FF   end of available RAM
00075  P 0000      08ff      A ROMEND   EQU   $08FF   end of available ROM
00076  P 0000      0080      A RAM      EQU   P7RAM   start of RAM, used in RAM check module
00077  P 0000      0100      A ROM      EQU   P7ROM   start of ROM, used in ROM check module
00078  P 0000      0009      A ROMWRAP  EQU   $09     end of ROM MSB, used in ROM check module
00079  P 0000      1ff8      A VECTORS  EQU   P7VCTRS interrupt vectors location
00080  P 0000      0900      A MOR      EQU   P9MOR   MOR location
00081                                    INCLUDE EQUATES.ASM system equates module
00001                                    OPT   NOL
00014                                    OPT   L
00015                         ***********************************************************
00016
```

M6805 Portable Cross Assembler 0.05 EQUATES.ASM Page 4
Fri Aug 09 15:30:31 1996
Options - MD,MC,NOG,NOU,W,NOMEX,CL,FMT,O

```
LINE   S PC   OPCO OPERANDS S LABEL    MNEMO OPERANDS COMMENT
00017                         *                    SYSTEM EQUATES                                  *
00018                         ***********************************************************************
00019
00020                         ****************************************
00021                         * interface modules equates            *
00022                         ****************************************
00023
00024  P 0000      000c      A BADREADS EQU   12      number of bad input reads allowed before...
00025                         *                                   ... sliding input window
00026  P 0000      001a      A GOODREADS EQU  26      number of good input reads before...
00027                         *                                   ... input considered debounced
00028  P 0000      0004      A CONCNT   EQU   4       number of consecutive input reads needed...
00029                         *                                   ... before condsidering as an input change
00030                         ****************************************
00031                         * IPLGS register                       *
00032                         ****************************************
00033
00034  P 0000      0007      A S1STAT   EQU   7       low flame measurement allowed flag
00035  P 0000      0006      A PTSTFL   EQU   6       flame circuit test failure flag
00036  P 0000      0005      A PHSESWAP EQU   5       transformer COM/L1 phasing flag
00037  P 0000      0004      A EXTFLSH  EQU   4       extended flash code flag
00038  P 0000      0003      A TESTDONE EQU   3       manufacturing test performed flag
00039  P 0000      0002      A INITDONE EQU   2       full initialization done flag
00040  P 0000      0001      A QTRSEC   EQU   1       quarter second ticker flag
00041  P 0000      0000      A HIPLSE   EQU   0       flame sense HI/LO transition flag
00042
00043                         ****************************************
00044                         * debounce inputs registers locations  *
00045                         ****************************************
00046                         *         the following equates are the locations of...
00047                         *         ... the registers relative to the start of...
00048                         *         ... an inputs register block
00049  P 0000      0000      A INPUTS   EQU   0       actual debounced inputs
00050  P 0000      0001      A TEMPINS  EQU   1       current inputs read
00051  P 0000      0002      A LASTIN1  EQU   2       previous inputs 1
00052  P 0000      0003      A LASTIN2  EQU   3       previous inputs 2
00053  P 0000      0004      A CYCLEPT  EQU   4       debounce cycles left until inputs valid
00054  P 0000      0005      A NEWCNT   EQU   5       number of input changes allowed before...
00055                         *                   ... sliding input window
00056  P 0000      0006      A NEWSAME  EQU   6       number of inputs needed consecutively...
00057                         *                   ... before calling new state
00058
00059                         ****************************************
00060                         * project specific equates             *
00061                         * NOTE: Some of above equates may      *
00062                         *       need to modified for a         *
00063                         *       specific project               *
00064                         ****************************************
00065
00066                         ****************************************
00067                         * PORT A signals                       *
00068                         ****************************************
```

09/17/96 59527-2.lst page 3

```
M6805 Portable Cross Assembler  0.05  EQUATES.ASM  Page 5
 Fri Aug 09 15:30:31 1996
Options - MD,MC,NOG,NOO,W,NOMEX,CL,FMT,O

LINE   S PC   OPCO OPERANDS S LABEL    MNEMO OPERANDS COMMENT
00069
00070  P 0000      0007     A W        EQU   7        W input signal
00071  P 0000      0006     A G        EQU   6        G input signal
00072  P 0000      0005     A ROLLOUT1 EQU   5        ROLLOUT 1 input signal
00073  P 0000      0004     A LIMIT    EQU   4        LIMIT input signal
00074  P 0000      0003     A PS       EQU   3        pressure switch input signal
00075  P 0000      0002     A MVIN     EQU   2        MV feedback input signal
00076  P 0000      0001     A SI       EQU   1        flame sense input signal
00077  P 0000      0000     A CONDSNSE EQU   0        condensate sensor input signal
00078
00079                         ****************************************
00080                         * PORT B signals                      *
00081                         ****************************************
00082
00083  P 0000      0007     A SERCLK   EQU   7        serial I/O port clock pin
00084  P 0000      0006     A SERIN    EQU   6        serial I/O port input pin
00085  P 0000      0005     A SEROUT   EQU   5        serial I/O port output signal
00086  P 0000      0007     A ROLLOUT2 EQU   SERCLK   ROLLOUT 2 input signal
00087  P 0000      0005     A FTSTPIN  EQU   SEROUT   flame circuit test output signal
00088
00089                         ****************************************
00090                         * PORT C signals                      *
00091                         ****************************************
00092
00093  P 0000      0007     A MV       EQU   7        main valve relay output signal
00094  P 0000      0006     A IDFAN    EQU   6        induced draft fan output signal
00095  P 0000      0005     A HSI      EQU   5        hot surface igniter output signal
00096  P 0000      0004     A HFAN     EQU   4        pseudo heat fan output signal
00097  P 0000      0004     A POWER    EQU   4        fan power relay output signal
00098  P 0000      0003     A CFAN     EQU   3        pseudo cool fan output signal
00099  P 0000      0003     A SPEED    EQU   3        fan speed relay output signal
00100  P 0000      0002     A LED      EQU   2        LED output signal
00101  P 0000      0001     A PC1      EQU   1        unused
00102  P 0000      0000     A Y        EQU   0        Y input signal
00103
00104                         ****************************************
00105                         * PORT D signals                      *
00106                         ****************************************
00107
00108  P 0000      0007     A TCAP     EQU   7        timer capture input signal
00109  P 0000      0007     A DLYJMP2  EQU   7        heat fan delay off jumper 2
00110  P 0000      0005     A DLYJMP1  EQU   5        heat fan delay off jumper 1
00111  P 0000      0005     A TESTMODE EQU   DLYJMP1  manufacturing test mode input signal
00112
00113                         ****************************************
00114                         * lckflgs1 register                    *
00115                         ****************************************
00116
00117  P 0000      0007     A CONDFLG  EQU   7        condensate sensor lockout flag
00118  P 0000      0006     A MVLOCK   EQU   6        MV circuit failure lockout mode flag
00119  P 0000      0005     A PSLOCK3  EQU   5        too many PS failures in an ignition cycle
00120  P 0000      0004     A RECYCPLG EQU   4        too many ignition flameouts (recycles) flag
```

```
M6805 Portable Cross Assembler  0.05  EQUATES.ASM  Page 6
 Fri Aug 09 15:30:31 1996
Options - MD,MC,NOG,NOO,W,NOMEX,CL,FMT,O

LINE   S PC   OPCO OPERANDS S LABEL    MNEMO OPERANDS COMMENT
00121  P 0000      0003     A RETRYFLG EQU   3        too many ignition trials (retrys) flag
00122  P 0000      0002     A PSLOCK2  EQU   2        pressure lockout flag mode 2 (stuck open)
00123  P 0000      0001     A PSLOCK1  EQU   1        pressure lockout flag mode 1 (stuck closed)
00124  P 0000      0000     A ILOCK    EQU   0        ignition lockout flag
00125
00126                         ****************************************
00127                         * lckflgs2  register                   *
00128                         ****************************************
00129
00130  P 0000      0002     A SILOCK   EQU   2        flame sense lockout flag
00131  P 0000      0001     A ROLLFLG  EQU   1        rollout open lockout flag
00132  P 0000      0000     A LMTFLG   EQU   0        limit open lockout flag
00133
00134                         ****************************************
00135                         * lckflgs3  register (interrupt set)   *
00136                         ****************************************
00137
00138  P 0000      0001     A BRKNWIRE EQU   1        rollout wire broken lockout flag
00139  P 0000      0000     A POLLOCK  EQU   0        line polarity reversed lockout flag
00140
00141                         ****************************************
00142                         * psflgs register                     *
00143                         ****************************************
00144
00145  P 0000      0002     A UNTESTD  EQU   2        pressure switch on without testing flag
00146  P 0000      0001     A PSOK     EQU   1        pressure switch tested ok flag
00147  P 0000      0000     A T1DONE   EQU   0        pressure switch test 1 done flag
00148
00149                         ****************************************
00150                         * wflgs register                       *
00151                         ****************************************
00152
00153  P 0000      0005     A FLSHLED  EQU   5        flame detected LED flash flag
00154  P 0000      0003     A MVSAG    EQU   3        MV causes draft pressure to sag flag
00155  P 0000      0001     A IGNFLG   EQU   1        ignition sequence done flag
00156  P 0000      0000     A FSTABFLG EQU   0        flame stabilization in progress flag
00157
00158                         ****************************************
00159                         * miscellaneous constants and masks    *
00160                         ****************************************
00161
00162  P 0000      0000     A ODRASET  EQU   %00000000 set up byte for data direction register A
00163  P 0000      0020     A ODRBSET  EQU   %00100000 set up byte for data direction register B
00164  P 0000      00fc     A ODRCSET  EQU   %11111100 set up byte for data direction register C
00165  P 0000      0000     A ODRDSET  EQU   %00000000 set up byte for data direction register D
00166                         *                                    ... 1=output, 0=input
00033
00034                         ********************************************************************************
00035                         **********************                                **********************
00036                         **********************  RAM STORAGE ORIGINATION POINT **********************
00037                         **********************                                **********************
00038                         ********************************************************************************
```

```
09/17/96 59527-2.lst page 4

M6805 Portable Cross Assembler  0.05  59527 2.asm  Page 7
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00039
00040  A 0080                          ORG   RAM      start of system RAM
00041
00042                        ******************************************************************************
00043                        ************************                              ************************
00044                        ************************        RAM RESERVATION SECTION   ************************
00045                        ************************                              ************************
00046                        ******************************************************************************
00047
00048  A 0080      0080     A ZZRAMBEG EQU   *        log beginning of system RAM
00049
00050                                   INCLUDE RMBS.ASM system RMB's module
00051                                   OPT   NOL
00052                                   OPT   L
00053
00054                        ******************************************************************************
00055                        *                              INTERFACE MODULES RMB's                       *
00056                        ******************************************************************************
00057
00058  A 0080      07       A INPUTS1  RMB   7        inputs buffer 1 for passing to main routine
00059  A 0087      07       A INPUTS2  RMB   7        inputs buffer 2 for passing to main routine
00060  A 008e      01       A EDGECNT  RMB   1        number IRQ's allowed before executing...
00061                        *                                          ... main routine
00062  A 008f      01       A PERIODCNT RMB  1        number RTI's allowed before executing...
00063                        *                                          ... main routine
00064  A 0090      01       A IFLGS    RMB   1        interface module flags register
00065  A 0091      01       A PULSES   RMB   1        pulses left till 1 second is up
00066  A 0092      02       A RAMCRC   RMB   2        CRC check value register, also used to...
00067                        *                                          ... determine if RAM has been scrambled
00068  A 0094      02       A RTCLOCK  RMB   2        1/32 distance of 60 HZ sine wave
00069  A 0096      02       A PREVCAL  RMB   2        previous IRQ timer val for calibration
00070  A 0098      01       A DOGTMR1  RMB   1        software watchdog timer stage 1
00071  A 0099      01       A DOGTMR2  RMB   1        software watchdog timer stage 2
00072  A 009a      01       A DOGTMR3  RMB   1        software watchdog timer stage 3
00073  A 009b      01       A OCPCNT   RMB   1        output compare int. counter
00074  A 009c      01       A OFFTMR   RMB   1        LED flash selectable off time reg.
00075  A 009d      01       A OFFTIME  RMB   1        LED flash selectable off time value reg.
00076  A 009e      01       A FLSHTMR  RMB   1        LED flash timer
00077  A 009f      01       A TOGGLEPNT RMB  1        selectable LED toggle point register
00078  A 00a0      01       A TOGGLEVAL RMB  1        selectable LED toggle point value register
00079  A 00a1      02       A TEMPCSUM RMB   2        temporary check sum value register
00080  A 00a3      02       A PREVCSUM RMB   2        previous check sum value register
00081  A 00a5      02       A TEMP     RMB   2        temp registers
00082  A 00a7      01       A PLSECNT1 RMB   1        pulsed relay duty cycle counter 1
00083  A 00a8      01       A PLSECNT2 RMB   1        pulsed relay duty cycle counter 2
00084  A 00a9      01       A ROLLCNT  RMB   1        rollout broken wire failure counter
00085  A 00aa      01       A LCKFLGS3 RMB   1        lockout flags register 3 (interrupt set)
00086  A 00ab      01       A FTSTCNT  RMB   1        flame circuit test execution counter
00087  A 00ac      01       A FAILCNT  RMB   1        flame circuit test failure counter
00088  A 00ad      01       A TSTTMR   RMB   1        test mode entry timer
00089  A 00ae      01       A PLSECPY  RMB   1        copy register of pulsed outputs
00090  A 00af      01       A PLSEMASK RMB   1        mask register for pulsed outputs
```

```
M6805 Portable Cross Assembler  0.05  RMBS.ASM  Page 8
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00092  A 00b0      01       A TEMPB    RMB   1        temporary copy of PORTB inputs
00093
00094                         ****************************************
00095                         * RAM variables to run a continuous      *
00096                         * checksum on                            *
00097                         ****************************************
00098
00099  A 00b1      00b1     A CSUMSTRT EQU   *        start of RAM area to be checksummed
00100  A 00b1      01       A INCOPY1  RMB   1        inputs copy register 1
00101  A 00b2      01       A INCOPY2  RMB   1        inputs copy register 2
00102  A 00b3      01       A OUTREQ   RMB   1        outputs request register
00103  A 00b4      01       A OUTCOPY  RMB   1        outputs copy register
00104  A 00b5      01       A POLCNT   RMB   1        line voltage polarity check counter
00105  A 00b6      01       A POLTMR   RMB   1        line voltage polarity check test timer
00106  A 00b7      01       A ROLLTMR  RMB   1        rollout failure timer
00107  A 00b8      01       A LCKFLGS1 RMB   1        lockout flags register 1
00108  A 00b9      01       A LCKFLGS2 RMB   1        lockout flags register 2
00109  A 00ba      01       A WFLGS    RMB   1        W on flag register
00110  A 00bb      01       A PSFLGS   RMB   1        PS flags register
00111  A 00bc      02       A ILOCKTMR RMB   2        ignition lockout timer
00112  A 00be      01       A HFDLYON  RMB   1        heat fan delay on register (W switched)
00113  A 00bf      02       A HFDLYOFF RMB   2        heat fan delay off register (W switched)
00114  A 00c1      01       A HFDLYFX  RMB   1        heat fan delay off value register
00115  A 00c2      01       A CFDLYOFF RMB   1        cool fan delay off register (G switched)
00116  A 00c3      01       A SITMR    RMB   1        flame sense failure timer register
00117  A 00c4      01       A MVTMR1   RMB   1        MV feedback failure mode 1 timer register
00118  A 00c5      01       A MVTMR3   RMB   1        MV feedback failure mode 3 timer register
00119  A 00c6      01       A WONTMR   RMB   1        W on proving timer
00120  A 00c7      01       A GONTMR   RMB   1        G on proving timer
00121  A 00c8      01       A YONTMR   RMB   1        Y on proving timer
00122  A 00c9      01       A PSTMR    RMB   1        PS closure/failure timer
00123  A 00ca      01       A PSFLCNT  RMB   1        PS open during ignition count
00124  A 00cb      01       A PREVAL   RMB   1        induced draft fan pre-purge value reg.
00125  A 00cc      01       A PRETMR   RMB   1        induced draft fan pre-purge timer
00126  A 00cd      01       A WARMVAL  RMB   1        igniter warm-up timer value
00127  A 00ce      01       A WARMTMR  RMB   1        igniter warm-up timer
00128  A 00cf      01       A POSTTMR  RMB   1        induced draft fan post-purge timer
00129  A 00d0      01       A IDOFFTMR RMB   1        induced draft fan off timer (clears PSFLGS)
00130  A 00d1      01       A RETRYTMR RMB   1        ignition retry timer
00131  A 00d2      01       A RETRYCNT RMB   1        ignition retry counter
00132  A 00d3      01       A FSTABTMR RMB   1        flame stabilization period timer
00133  A 00d4      01       A FSFAILTMR RMB  1        flame stabilization failure timer
00134  A 00d5      01       A RECYCCNT RMB   1        ignition recycle counter
00135  A 00d6      01       A CONDTMR1 RMB   1        condensate sensor failure timer 1 (failure)
00136  A 00d7      01       A CONDTMR2 RMB   1        condensate sensor failure timer 2 (ok)
00137  A 00d8      00d8     A CSUMEND  EQU   *        end of RAM area to be checksummed
00138
00139                         ******************************************************************************
00140                         *                              CRC CHECK MODULE RMB's                        *
00141                         *                                                                            *
00142                         *    NOTE: These RMB's are placed at the end so they can be used as stack    *
00143                         *          area after the ROM check is done                                  *
```

```
09/17/96 59527-2.lst page 5

M6805 Portable Cross Assembler  0.05  RMBS.ASM  Page 9
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00104                        ***********************************************************************
00105
00106  A 00d8      01       A BITCNT   RMB   1        bit counter register
00107  A 00d9      0a       A RKOMBYTE RMB   10       ram image of CRC check
00108  A 00e3      00e3     A RMBSEND  EQU   *        end of RMB's
00051
00052  A 00e3      00e3     A ZZRAMEND EQU   *        log end of system RAM
00053
00054                        ***********************************************************************
00055                        ************************                                ************************
00056                        ************************   CRC VALUE/PART NUMBER/REV    ************************
00057                        ************************      AND COPYRIGHT INFO        ************************
00058                        ************************                                ************************
00059                        ***********************************************************************
00060
00061  A 0020                       ORG   AUXROM   ROM LOCATIONS $0020   $004F
00062
00063  A 0020      0020     A ZZAUXBEG EQU   *        log beginning of system AUXROM
00064
00065                        INCLUDE CRCVAL.ASM system CRC value
00001                        OPT   NOL
00014                        OPT   L
00015
00016  A 0020      627e     A ROMCRC   FDB   $627E   CRC value
00066
00067                        INCLUDE PNCPY.ASM system part number and copyright module
00001                        OPT   NOL
00014                        OPT   L
00015
00016                        ***********************************************************************
00017                        *                     PART NUMBER AND COPYRIGHT INFORMATION           *
00018                        ***********************************************************************
00019
00020  A 0022      35       A PNCPY    FCC   5,59527      part number
00021  A 0027      32       A          FCC   1,2                revision level
00022  A 0028      20       A          FCC   10, COPYRIGHT    copyright notice
00023  A 0032      20       A          FCC   18, TEXAS INSTRUMENTS
00024  A 0044      20       A          FCC   5, 1996
00068
00069  A 0049      0049     A ZZAUXEND EQU   *        log end of system AUXROM
00070
00071  A 0049      07       A          UCB   AUXROMEND-*+1,$83 fill remaining AUX ROM locations with SWI's
00072
00073                        ***********************************************************************
00074                        ************************                                ************************
00075                        ************************    PROGRAM ORIGINATION POINT   ************************
00076                        ************************                                ************************
00077                        ***********************************************************************
00078
00079  A 0100                       ORG   ROM      start of system ROM
00080
00081                        ***********************************************************************
```

```
M6805 Portable Cross Assembler  0.05  59527-2.asm  Page 10
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00082                        ************************                                ************************
00083                        ************************        PROGRAM SECTION         ************************
00084                        ************************                                ************************
00085                        ***********************************************************************
00086
00087  A 0100      0100     A ZZROMBEG EQU   *        log beginning of system ROM
00088
00089                                  INCLUDE SYSINIT.ASM system initialization module
00001                                  OPT   NOL
00014                                  OPT   L
00015
00016                        ***********************************************************************
00017                        *                          INITIALIZE THE SYSTEM                      *
00018                        ***********************************************************************
00019
00020  A 0100 9b                     RESETV  SEI            insure interrupts are disabled
00021  A 0101 9c                             RSP            reset the stack pointer
00022  A 0102 cd   0535     A                JSR   PET_DOG  reset the watchdog timer
00023
00024                        ****************************************
00025                        * check reset conditions section       *
00026                        ****************************************
00027
00028  A 0105 b6   92       A                LDA   RAMCRC   get RAM version of CRC value
00029  A 0107 b1   20       A                CMP   ROMCRC   compare it to ROM version
00030  A 0109 26   0c    0117                BNE   FULL_INI if not equal then full init needed
00031  A 010b b6   93       A                LDA   RAMCRC+1 else check second RAM byte
00032  A 010d b1   21       A                CMP   ROMCRC+1
00033  A 010f 26   06    0117                BNE   FULL_INI if not equal then full init needed
00034  A 0111 05   9003  0117                BRCLR INITDONE,IFLGS.FULL_INI if full init did not finish try again
00035  A 0114 cc   01fb     A                JMP   PRTL_INI else only partial init needed
00036
00037                        ****************************************
00038                        * full initialization section          *
00039                        ****************************************
00040
00041  A 0117      0117     A FULL_IN1 EQU   *
00042
00043                        ****************************************
00044                        * turn all I/O into known state       *
00045                        ****************************************
00046
00047  A 0117 3f   00       A                CLR   PORTA    clear port A prior to setting I/O state
00048  A 0119 3f   01       A                CLR   PORTB    clear port B prior to setting I/O state
00049  A 011b 3f   02       A                CLR   PORTC    clear port C prior to setting I/O state
00050  A 011d 3f   03       A                CLR   PORTD    clear port D prior to setting I/O state
00051  A 011f 3f   04       A                CLR   DDRA     turn all I/O into inputs except LED
00052  A 0121 3f   05       A                CLR   DDRB
00053  A 0123 a6   06       A                LDA   #%00000110 LED defaults to on during init and stays...
00054  A 0125 b7   06       A                STA   DDRC     ... on if a failure occurs, PC1 is used...
00055  A 0127 14   02       A                BSET  LED,PORTC ... to indicate polarity test done
00056  A 0129 3f   07       A                CLR   DDRD
```

```
09/17/96 59527-2.18t page 6

M6805 Portable Cross Assembler  0.05  SYSINIT.ASM  Page 11
 Fri Aug 09 15:30:31 1996
Options   MD,MC,NOG,NOU,W,NOMEX,CL,FMT,O

LINE   S PC   OPCO OPERANDS S LABEL    MNEMO OPERANDS COMMENT
00057
00058                        ****************************************
00059                        * RAM check section      *
00060                        ****************************************
00061
00062                                 INCLUDE RAMCHK.ASM include the RAM check module
00001                                 OPT   NOL
00016                                 OPT   L
00017
00018                        ******************************************************************************
00019                        *                                RAM VERIFICATION ROUTINE                    *
00020                        ******************************************************************************
00021
00022  A 012b ae   80       A          LDX   #RAM      put RAM start address in index register
00023
00024  A 012d a6   aa       A RAM_CHK  LDA   #%10101010 start check with $AA
00025  A 012f f7                       STA   0,X       store ACCA in RAM address n
00026  A 0130 f1                       CMP   0,X       is the RAM value equal to the ACCA value
00027  A 0131 26   0e    0141          BNE   CHK_FAIL if not go to RAM check fail
00028
00029  A 0133 44                       LSRA            walk ACCA bits to right
00030  A 0134 74                       LSR   0,X       walk RAM location bits to right
00031  A 0135 f1                       CMP   0,X       is the RAM value equal to the ACCA value
00032  A 0136 26   09    0141          BNE   CHK_FAIL if not go to RAM check fail
00033
00034  A 0138 7f                       CLR   0,X       clear the RAM location
00035  A 0139 f6                       LDA   0,X       get the RAM location
00036  A 013a 26   05    0141          BNE   CHK_FAIL if clear fails go to RAM check fail
00037
00038  A 013c 5c                       INCX            get next address
00039  A 013d 26   ee    012d          BNE   RAM_CHK   if index does not reset to $00 then...
00040                        *                          ... go check next address
00041  A 013f 20   03    0144          BRA   END_CHK   else end RAM check
00042
00043  A 0141 cc   01d7     A CHK_FAIL JMP   TST_FAIL  else go to test failure section
00044
00045  A 0144      0144     A END_CHK  EQU   *         end RAM check
00063                        ****************************************
00064                        * line voltage phasing check section   *
00065                        ****************************************
00066
00067
00068  A 0144 3d   13       A          TST   TSR       reset timer overflow flag
00069  A 0146 3d   19       A          TST   TCNTLO
00070  A 0148 cd   0535     A LO_WAIT  JSR   PET_DOG   pet the watchdog
00071  A 014b 03   0014  0162          BRCLR S1,PORTA,RST_TST if flame sense LO go reset the test...
00072                        *          ... timer and wait for a HI pulse
00073  A 014e 10   90       A LO_WAIT1 BSET  HIPLSE,IFLGS else set I/O has gone HI flag
00074  A 0150 0b   13f5  0148          BRCLR TOF,TSR,LO_WAIT if wait time not done then continue waiting
00075  A 0153 3d   19       A          TST   TCNTLO   else reset the timer overflow flag
00076  A 0155 3c   b6       A          INC   POLTMR   else inc the max HI timer
00077  A 0157 07   b6ee  0148          BRCLR 3,POLTMR,LO_WAIT if not expired continue waiting
```

```
M6805 Portable Cross Assembler  0.05  SYSINIT.ASM  Page 12
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00078
00079  A 015a 12   00       A          BSET  S1,INPUTS else I/O continuous HI so force control...
00080  A 015c a6   06       A          LDA   #6        ... into a flame sesnse lockout
00081  A 015e b7   c3       A          STA   S1TMR
00082  A 0160 20   12    0174          BRA   POL_OK    polarity check invalid
00083
00084  A 0162 3f   b6       A RST_TST  CLR   POLTMR    reset the test timer
00085
00086  A 0164 cd   0535     A HI_WAIT  JSR   PET_DOG   pet the watchdog
00087  A 0167 03   000e  0178          BRCLR S1,PORTA,HI_WAIT1 if flame sense LO go check max LO timer
00088  A 016a 3f   b6       A          CLR   POLTMR    reset the test timer
00089  A 016c 3c   b5       A          INC   POLCNT    else a HI/LO pulse occurred so count it
00090  A 016e b6   b5       A          LDA   POLCNT    get the polarity pulse counter
00091  A 0170 a1   06       A          CMP   #6        compare to desired number of pulses
00092  A 0172 25   d4    0148          BLO   LO_WAIT   if less continue to check for more pulses
00093
00094  A 0174 12   02       A POL_OK   BSET  PC1,PORTC turn on PC1 to signal tester test OK
00095  A 0176 20   0f    0187          BRA   CHK_ROM   go check ROM
00096
00097  A 0178 0b   13e9  0164 HI_WAIT1 BRCLR TOF,TSR,HI_WAIT if wait time not done then continue waiting
00098  A 017b 3d   19       A          TST   TCNTLO    else reset the timer overflow flag
00099  A 017d 3c   b6       A          INC   POLTMR    else inc the max LO timer
00100  A 017f 07   b6e2  0164          BRCLR 3,POLTMR,HI_WAIT if not expired continue waiting
00101
00102  A 0182 01   90ef  0174 CHK_HIX  BRCLR HIPLSE,IFLGS,POL_OK else if no HI pulses then I/O stuck lo...
00103                        *                          ... polarity check invalid
00104  A 0185 10   aa       A PH_LCK1  BSET  POLLOCK,LCKFLGS3 else set line polarity reversed lockout
00105
00106                        ****************************************
00107                        * ROM check section      *
00108                        ****************************************
00109
00110                        CHK_ROM   INCLUDE ROMCHK.ASM include the ROM check module
00001                                  OPT   NOL
00016                                  OPT   L
00017
00018                        ******************************************************************************
00019                        *                                ROM CRC CHECK ROUTINE                       *
00020                        ******************************************************************************
00021
00022                        ****************************************
00023                        *  routine to copy ROM image into RAM  *
00024                        ****************************************
00025
00026  A 0187 5f                       CLRX
00027  A 0188 d6   0194     A NXT_BYTE LDA   RAM_IMG,X get a ROM byte
00028  A 018b e7d9                     STA   RROMBYTE,X copy to RAM
00029  A 018d 5c                       INCX            prepare to get next byte
00030  A 018e a3   0a       A          CMPX  #10
00031  A 0190 25   f6    0188          BLO   NXT_BYTE if not all copied get next byte
00032  A 0192 20   0a    019e          BRA   GEN_CRC   else start generating the CRC
00033
```

```
09/17/96 59527 2.1st page 7

M6805 Portable Cross Assembler  0.05  ROMCHK.ASM  Page 13
 Fri Aug 09 15:40:31 1996
Options - MD,MC,NOG,NOU,W,NOMEX,CL,PMT,O

LINE   S PC   OPCO OPERANDS S LABEL    MNEMO OPERANDS COMMENT
00034  A 0194 c6   0100     A RAM_IMG  LDA   ROM      ROM routine to be copied into RAM and...
00035  A 0197 3c   db       A          INC   RROMBYTE+2 ... executed in RAM
00036  A 0199 26   02    019d          BNE   RAM_IMG1
00037  A 019b 3c   da       A          INC   RROMBYTE+1
00038  A 019d 81              RAM_IMG1 RTS
00039
00040                         ****************************************
00041                         * routine to calc CRC value            *
00042                         ****************************************
00043
00044  A 019e 3f   92       A GEN_CRC  CLR   RAMCRC   CRC=0
00045  A 01a0 3f   93       A          CLR   RAMCRC-1
00046  A 01a2 bd   d9       A GEN_CRC1 JSR   RROMBYTE get a byte of ROM
00047  A 01a4 b8   92       A          EOR   RAMCRC   CRC=CRC^(ROMBYTE<<8)
00048  A 01a6 b7   92       A          STA   RAMCRC
00049  A 01a8 a6   08       A          LDA   #8       for(i=8,i=0,--i)
00050  A 01aa b7   da       A          STA   BITCNT
00051  A 01ac cd   0535     A          JSR   PET_DOG  reset the watch dog timer
00052
00053  A 01af 38   93       A CRC_GEN2 ASL   RAMCRC+1 CRC=CRC<<1
00054  A 01b1 39   92       A          ROL   RAMCRC
00055  A 01b3 24   0c    01c1          BCC   CRC_GEN3 was the MSB of old CRC=1?
00056  A 01b5 a6   21       A          LDA   #$21     yes,CRC=CRC^$1021
00057  A 01b7 b8   93       A          EOR   RAMCRC+1
00058  A 01b9 b7   93       A          STA   RAMCRC+1
00059  A 01bb a6   10       A          LDA   #$10
00060  A 01bd b8   92       A          EOR   RAMCRC
00061  A 01bf b7   92       A          STA   RAMCRC
00062
00063  A 01c1 3a   da       A CRC_GEN3 DEC   BITCNT   done for all 8 bits of new input?
00064  A 01c3 26   ea    01af          BNE   CRC_GEN2 no, continue
00065  A 01c5 b6   da       A          LDA   RROMBYTE+1 yes
00066  A 01c7 a1   09       A          CMPA  #ROMWRAP have we generated a CRC for entire ROM?
00067  A 01c9 26   d7    01a2          BNE   GEN_CRC1 no, continue
00068
00069  A 01cb b6   20       A          LDA   ROMCRC   load 1st byte of CRC value
00070  A 01cd b1   92       A          CMP   RAMCRC   compare to calculated CRC
00071  A 01cf 26   06    01d7          BNE   CRC_FAIL if equal check second byte
00072  A 01d1 b6   21       A          LDA   ROMCRC+1 load 2nd byte of CRC value
00073  A 01d3 b1   93       A          CMP   RAMCRC+1 compare to calculated 2nd byte
00074  A 01d5 27   04    01db          BEQ   NO_FAIL  if equal ROM good
00075
00076  A 01d7      01d7     A CRC_FAIL EQU   *        CRC test failed
00111
00112                         ****************************************
00113                         * RAM/ROM check test failure section   *
00114                         ****************************************
00115
00116  A 01d7 9d              TST_FAIL NOP            used for debug purposes only, may be removed
00117
00118  A 01d8 3f   92       A GO_RESET CLR   RAMCRC   do a full reset
00119  A 01da 83                      SWI
```

```
M6805 Portable Cross Assembler  0.05  SYSINIT.ASM  Page 14
 Fri Aug 09 15:30:31 1996
Options - MD,MC,NOG,NOU,W,NOMEX,CL,PMT,O

LINE   S PC   OPCO OPERANDS S LABEL    MNEMO OPERANDS COMMENT
00120
00121                         ****************************************
00122                         * full-reset start-up section          *
00123                         ****************************************
00124
00125  A 01db a6   20       A NO_FAIL  LDA   #%00100000 initialize the inputs pass register...
00126  A 01dd b7   80       A          STA   INPUTS1   ... ROLLOUT1 on, all others off
00127  A 01df a6   0c       A          LDA   #BADREADS initialize the number of bad reads...
00128  A 01e1 b7   85       A          STA   INPUTS1+NEWCNT ... allowed before ignoring the input
00129  A 01e3 b7   8c       A          STA   INPUTS2+NEWCNT
00130  A 01e5 a6   04       A          LDA   #CONCNT  initialize the number of consecutive...
00131  A 01e7 b7   86       A          STA   INPUTS1+NEWSAME ... reads before considering a new input
00132  A 01e9 b7   8d       A          STA   INPUTS2+NEWSAME
00133  A 01eb a6   1a       A          LDA   #GOODREADS initialize the number of reads left...
00134  A 01ed b7   84       A          STA   INPUTS1+CYCLEFT ... before input is considered debounced
00135  A 01ef b7   8b       A          STA   INPUTS2+CYCLEFT
00136  A 01f1 a6   02       A          LDA   #2       init the initial pre-purge time
00137  A 01f3 b7   cb       A          STA   PREVAL
00138  A 01f5 a6   44       A          LDA   #68      init the initial igniter warm-up time
00139  A 01f7 b7   cd       A          STA   WARMVAL
00140  A 01f9 14   90       A          BSET  INITDONE,IFLGS set the full init completed flag
00141
00142                         ****************************************
00143                         * partial reset start-up section       *
00144                         ****************************************
00145
00146  A 01fb cd   0523     A PRTL_INI JSR   SYS_FRESH set/refresh data direction registers
00147  A 01fe b6   02       A          LDA   PORTC    get status of LED
00148  A 0200 a4   04       A          AND   #%00000100
00149  A 0202 ba   b4       A          ORA   OUTCOPY  maintain LED status
00150  A 0204 b7   02       A          STA   PORTC    restore the outputs state
00151  A 0206 a6   60       A          LDA   #%01100000 initialize the TCR - TOFE enabled
00152  A 0208 b7   12       A          STA   TCR      TOFI = 131 ms
00153  A 020a cd   0535     A          JSR   PET_DOG  reset the watchdog timer
00154  A 020d 9c                       RSP            reset the stack pointer
00155  A 020e 9a                       CLI            enable interrupts
00090
00091                                  INCLUDE MAIN.ASM system main program module
00015                                  OPT   NOL
00016                                  OPT   L
00017
00018                         ****************************************************************************
00019                         *                          MAIN PROGRAM LOOP                               *
00020                         ****************************************************************************
00021  A 020f cd   053a     A START_1  JSR   RD_JMPRS continuously read heat fan delay off...
00022                         *            ... and go calculate/update check sum...
00023                         *            ... for all main loop variables and...
00024                         *            ... constants, prior to 1/4 sec. loop...
00025                         *            ... and since last main loop run
00026  A 0212 b7   a4       A          STA   PREVCSUM+1 save check sum contained in A:X registers
00027  A 0214 bf   a3       A          STX   PREVCSUM
```

```
09/17/96 59527 2.18L page 8

M6805 Portable Cross Assembler  0.05  MAIN.ASM  Page 15
 Fri Aug 09 15:30:31 1996
Options - MD,MC,NOG,NOU,W,NOMEX,CL,FMT,O

LINE   S PC   OPCO OPERANDS S LABEL     MNEMO OPERANDS COMMENT
00028
00029  A 0216 3f   98       A           CLR   DOGTMR1  clear stage 1 of software watchdog timer
00030  A 0218 3f   99       A           CLR   DOGTMR2  clear stage 2 of software watchdog timer
00031  A 021a 3f   9a       A           CLR   DOGTMR3  clear stage 3 of software watchdog timer
00032
00033  A 021c 3c   98       A START_2   INC   DOGTMR1  inc software watchdog timer stage 1
00034  A 021e 26   0c    022c           BNE   START_3  if not rolled over go check flags
00035
00036  A 0220 3c   99       A INC_T2    INC   DOGTMR2  inc software watchdog timer stage 2
00037  A 0222 26   08    022c           BNE   START_3  if not rolled over go check flags
00038
00039  A 0224 3c   9a       A INC_T3    INC   DOGTMR3  inc software watchdog timer stage 3
00040  A 0226 b6   9a       A           LDA   DOGTMR3  get software watchdog timer stage 3 count
00041  A 0228 a1   02       A           CMP   #2       compare to desired value
00042  A 022a 24   ac    01d8           BHS   GO_RESET if exceeded go reset
00043
00044  A 022c 9a               START_3  CLI            continuously clear the interrupt bit and...
00045  A 022d cd   0523     A           JSR   SYS_FRESH ... refresh the DDR's for noise immunity...
00046                        *            ... and pet watchdog
00047  A 0230 03   90e9  021c           BRCLR QTRSEC,IFLGS,START_2 wait a 1/4 second before entering main loop
00048
00049                        ***********************************************************************
00050                        *                                MAIN CONTROL LOOP                    *
00051                        ***********************************************************************
00052
00053  A 0233 13   90       A MAIN_LOOP BCLR QTRSEC,IFLGS clear 1/4 second ticker
00054  A 0235 3f   81       A           CLR   PERIODCNT clear the periodic int. S/W watchdog counter
00055
00056                        ***********************************************************************
00057                        *                          CONTINUOUS MEMORY INTEGRITY TEST    *
00058                        ***********************************************************************
00059
00060  A 0239 cd   0559     A MEM_CHK   JSR   CALC_CSUM go calculate a check sum for all main...
00061                        *                          ... variables and constants
00062  A 023a b1   a4       A           CMPA  PREVCSUM+1 compare calced check sum in A:X registers...
00063                        *            ... to value calced at end of last main run
00064  A 023c 26   9a    01da           BNE   GO_RESET if not equal, reset
00065  A 023e b3   a3       A           CMPX  PREVCSUM
00066  A 0240 26   96    01d8           BNE   GO_RESET
00067
00068  A 0242 3f   b3       A COPY_IN   CLR   OUTREQ   clear the outputs request register
00069  A 0244 b6   b3       A           LDA   OUTREQ   read back the outputs request register
00070  A 0246 26   90    01d8           BNE   GO_RESET if not cleared then go reset
00071  A 0248 b6   80       A           LDA   INPUTS1  else get a current copy of the inputs 1
00072  A 024a b7   b1       A           STA   INCOPY1  save in temporary input register 1
00073  A 024c b6   87       A           LDA   INPUTS2  get a current copy of the inputs 2
00074  A 024e b7   b2       A           STA   INCOPY2  save in temporary input register 2
00075
00076                        ***********************************************************************
00077                        *                          SAFETY CONTROLS OVERRIDE SECTION            *
00078                        ***********************************************************************
00079
```

```
M6805 Portable Cross Assembler  0.05  MAIN.ASM  Page 16
 Fri Aug 09 15:30:31 1996
Options - MD,MC,NOG,NOU,W,NOMEX,CL,FMT,O

LINE   S PC   OPCO OPERANDS S LABEL     MNEMO OPERANDS COMMENT
00080  A 0250      0250     A SAFTY_OVR BEQ   *
00081
00082                          ****************************************
00083                          * condensate sensor failure test       *
00084                          ****************************************
00085
00086  A 0250 01   b10e  0261 COND_CHK BRCLR CONDSNSE,INCOPY1,COND_OK if condensate not sensed then OK
00087  A 0253 b6   d6       A           LDA   CONDTMR1 else get failure timer
00088  A 0255 a1   3b       A           CMP   #59      compare to max on time
00089  A 0257 24   04    025d           BHS   RST_TMR2 if exceeded then fail
00090  A 0259 3c   d6       A           INC   CONDTMR1 else inc the failure timer
00091  A 025b 20   13    0270           BRA   RST_COND go reset failure flag
00092
00093  A 025d a6   3b       A RST_TMR2 LDA   #59      load reset timer
00094  A 025f b7   d7       A           STA   CONDTMR2
00095
00096  A 0261 b6   d7       A COND_OK   LDA   CONDTMR2 get reset failure timer
00097  A 0263 27   09    026e           BEQ   RST_TMR1 halt ignition until done
00098  A 0265 3a   d7       A           DEC   CONDTMR2 dec the timer
00099  A 0267 1e   b9       A           BSET  CONDFLG,LCKFLGS1 else set condensate sensed flag
00100  A 0269 cd   050c     A           JSR   SAFE_B   go to safe mode B (IDFAN on only)
00101  A 026c 20   04    0272           BRA   LMT_CHK  go check HI LIMIT
00102
00103  A 026e 3f   d6       A RST_TMR1 CLR   CONDTMR1 reset failure timer
00104
00105  A 0270 1f   b8       A RST_COND BCLR  CONDFLG,LCKFLGS1 reset condensate sensed flag
00106
00107                          ****************************************
00108                          * LIMIT control section                *
00109                          ****************************************
00110
00111  A 0272 01   b10a  027f LMT_CHK  BRCLR W,INCOPY1,LMT_CHK1 if W off check LIMIT status
00112  A 0275 08   b10a  0282           BRSET LIMIT,INCOPY1,LMT_OK else if W on and LIMIT closed then OK
00113
00114  A 0278 10   b9       A LMT_FAIL BSET  LMTFLG,LCKFLGS2 else set LIMIT open flag
00115  A 027a cd   04f1     A           JSR   SAFE_A   go to IDFAN & HFAN on w/delays
00116  A 027d 20   05    0284           BRA   S1_TST   go check flame sense status
00117
00118  A 027f 08   b1f6  0278 LMT_CHK1 BRSET LIMIT,INCOPY1,LMT_FAIL if W off and LIMIT closed then...
00119                          *                    ... LIMIT circuit bad
00120  A 0282 11   b9       A LMT_OK    BCLR  LMTFLG,LCKFLGS2 else LIMIT OK, reset the LIMIT open flag
00121
00122                          ****************************************
00123                          * flame sense (S1) failure test        *
00124                          ****************************************
00125
00126  A 0284 0e   b414  029b S1_TST   BRSET MV,OUTCOPY,RST_S1LK else if main valve on do not test
00127  A 0287 03   b111  029b           BRCLR S1,INCOPY1,RST_S1LK else if flame not sensed reset lockout
00128  A 028a b6   c3       A           LDA   S1TMR    else get the flame sense failure timer
00129  A 028c a1   06       A           CMP   #6       compared to max allowed fail time
00130  A 028e 24   04    0294           BHS   S1_LCK   if expired go to lockout
00131  A 0290 3c   c3       A           INC   S1TMR    else inc the failure timer
```

```
09/17/96 59527-2.lst page 5

M6805 Portable Cross Assembler  0.05  MAIN.ASM  Page 17
 Fri Aug 09 15:30:31 1996
Options - MD,MC,NOG,NOU,W,NUMEX,CL,FMT,O

LINE   S PC   OPCO OPERANDS S LABEL     MNEMO OPERANDS COMMENT
00132  A 0292 20   0b    029f           BRA   ROLL1_CHK go check ROLLOUT
00133
00134  A 0294 14   b9       A S1 LCK    BSET  S1LOCK,LCKFLGS2 set flame sense failure lockout flag
00135  A 0296 cd   04ff     A           JSR   SAFE_A   go to safe mode A (IDFAN and HFAN on)
00136  A 0299 20   06    0291           BRA   ROLL1_CHK go check ROLLOUT
00137
00138  A 029b 3f   c3       A RST_S1LK CLR   S1TMR    reset the flame sense failure timer
00139  A 029d 15   b9       A           BCLR  S1LOCK,LCKFLGS2 reset the flame sense failure lockout flag
00140
00141                          ****************************************
00142                          * Flame ROLLOUT failure test           *
00143                          ****************************************
00144
00145  A 029f 02   b90f  02b1 ROLL1_CHK BRSET ROLLFLG,LCKFLGS2,ROLL_LCK if ROLLOUT has already failed...
00146                          *                    ... then lockout forever
00147  A 02a2 0b   b10c  02b1           BRCLR ROLLOUT1,INCOPY1,ROLL_LCK else if ROLLOUT 1 open then...
00148                          *                    ... lockout immediately
00149  A 02a5 0e   b204  02ac           BRSET ROLLOUT2,INCOPY2,ROLL_FAIL else if ROLLOUT 2 sense then check...
00150                          *                    ... fail timer
00151  A 02a8 3f   b7       A           CLR   ROLLTMR  else reset ROLLOUT 2 failure timer
00152  A 02aa 20   0a    02b6           BRA   POL_CHK  go check line polarity lockout
00153
00154  A 02ac 3c   b7       A ROLL_FAIL INC   ROLLTMR  else inc the failure timer
00155  A 02ae 09   b7c5  02b6           BRCLR 4,ROLLTMR,POL_CHK if not expired then check line...
00156                          *                    ... polarity lockout
00157  A 02b1 12   b9       A ROLL_LCK BSET  ROLLFLG,LCKFLGS2 else set ROLLOUT open flag
00158  A 02b3 cd   04ff     A           JSR   SAFE_A   go to IDFAN & HFAN on w/delays
00159
00160                          ****************************************
00161                          * line polarity check failure test     *
00162                          ****************************************
00163
00164  A 02b6 01   aa03  02bc POL_CHK  BRCLR POLLOCK,LCKFLGS3,ROLL2_CHK if line polarity phasing flag...
00165                          *                    ... clear check if ROLLOUT wire OK
00166  A 02b9 cc   04b0     A           JMP   FAN_SW   lockout COOL/HEAT control forever
00167
00168                          ****************************************
00169                          * ROLLOUT broken wire failure test     *
00170                          ****************************************
00171
00172  A 02bc 03   aa06  02c5 ROLL2_CHK BRCLR BRKNWIRE,LCKFLGS3,MV_TST1 if wires not broken go to MV test
00173  A 02bf cd   04ff     A           JSR   SAFE_A   go to IDFAN & HFAN on w/delays
00174  A 02c2 cc   04b0     A           JMP   FAN_SW   lockout COOL/HEAT control forever
00175
00176                          ****************************************
00177                          * main valve feedback failure test 1   *
00178                          ****************************************
00179
00180  A 02c5 0c   b810  02d8 MV_TST1  BRSET MVLOCK,LCKFLGS1,MV_LCK1 if MV lockout continue lockout
00181  A 02c8 0e   b412  02dd           BRSET MV,OUTCOPY,RST_VLK1 else if main valve on do not test
00182  A 02cb 05   b10f  02dd           BRCLR MVIN,INCOPY1,RST_VLK1 else if no MV feedback signal...
00183                          *                                    ... present then reset lockout
```

```
M6805 Portable Cross Assembler  0.05  MAIN.ASM  Page 18
 Fri Aug 09 15:30:31 1996
Options - MD,MC,NOG,NOU,W,NUMEX,CL,FMT,O

LINE   S PC   OPCO OPERANDS S LABEL     MNEMO OPERANDS COMMENT
00184  A 02ce b6   c4       A           LDA   MVTMR1   else get MV failure timer 1
00185  A 02d0 a1   06       A           CMP   #6       compared to max allowed fail time
00186  A 02d2 24   04    02d8           BHS   MV_LCK1  if expired go to lockout
00187  A 02d4 3c   c4       A           INC   MVTMR1   else inc the failure timer
00188  A 02d6 20   07    02df           BRA   COOL_CTRL go check cooling request
00189
00190  A 02d8 1c   b8       A MV_LCK1  BSET  MVLOCK,LCKFLGS1 set MV lockout mode flag
00191  A 02da cc   34b0     A           JMP   FAN_SW   lockout COOL/HEAT control forever
00192
00193  A 02dd 3f   c4       A RST_VLK1 CLR   MVTMR1   reset the MV lockout timer
00194
00195                          ************************************************************************
00196                          *                          COOLING CONTROL SECTION                     *
00197                          ************************************************************************
00198
00199  A 02df      02df     A COOL_CTRL BQO  *
00200
00201                          ****************************************
00202                          * G control section                    *
00203                          ****************************************
00204
00205  A 02df 0d   b10e  02f0 CHK_G    BRCLR G,INCOPY2,G_OFF if G not on clear G on proving timer
00206
00207                          ****************************************
00208                          * G on section                         *
00209                          ****************************************
00210
00211  A 02e2 b6   c7       A           LDA   GONTMR   else get the G on proving timer
00212  A 02e4 a1   03       A           CMP   #3       compare to desired proving value
00213  A 02e6 24   04    02ec           BHS   GFAN_ON  if expired then request CFAN
00214  A 02e8 3c   c7       A           INC   GONTMR   else inc the G on proving timer
00215  A 02ea 20   08    02f4           BRA   CHK_Y    go check Y input
00216
00217  A 02ec 16   b3       A GFAN_ON  BSET  CFAN,OUTREQ request the cool fan
00218  A 02ee 20   04    02f4           BRA   CHK_Y    go check Y input
00219
00220                          ****************************************
00221                          * G off section                        *
00222                          ****************************************
00223
00224  A 02f0 3f   c7       A G_OFF    CLR   GONTMR   reset the G on proving timer
00225  A 02f2 20   13    0307           BRA   Y_OFF    if no G then no Y possible
00226
00227                          ****************************************
00228                          * Y control section                    *
00229                          ****************************************
00230
00231  A 02f4 01   b210  0307 CHK_Y    BRCLR Y,INCOPY2,Y_OFF if Y not on clear Y on proving timer
00232
00233                          ****************************************
00234                          * Y on section                         *
00235                          ****************************************
```

```
09/17/96 59527-2.lst page 10

M6805 Portable Cross Assembler  0.05  MAIN.ASM  Page 19
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00236
00237  A 02f7 b6   c8       A          LDA   YONTMR   else get the Y on proving timer
00238  A 02f9 a1   03       A          CMP   #3       compare to desired proving value
00239  A 02fb 24   04    0301          BHS   YFAN_ON  if expired then request CFAN
00240  A 02fd 3c   c8       A          INC   YONTMR   else inc the Y on proving timer
00241  A 02ff 20   08    0309          BRA   CFAN_OFF go check if doing a delay off
00242
00243  A 0301 a6   f0       A YFAN_ON  LDA   #240     load the cool fan delay off
00244  A 0303 b7   c2       A          STA   CFDLYOFF
00245  A 0305 20   0a    0311          BRA   IGN_CTRL go to ignition control
00246
00247                          ****************************************
00248                          * Y off section                        *
00249                          ****************************************
00250
00251  A 0307 3f   c8       A Y_OFF    CLR   YONTMR   reset the Y on proving timer
00252
00253                          ****************************************
00254                          * cool fan delay off section           *
00255                          ****************************************
00256
00257  A 0309 b6   c2       A CFAN_OFF LDA   CFDLYOFF else get the CFAN delay off timer
00258  A 030b 27   04    0311          BEQ   IGN_CTRL if = 0 then delay off done
00259  A 030d 3a   c2       A          DEC   CFDLYOFF else dec delay off
00260  A 030f 16   b3       A          BSET  CFAN,OUTREG continue CFAN req.
00261
00262                          ******************************************************************
00263                          *                          IGNITION CONTROL SECTION                *
00264                          ******************************************************************
00265
00266  A 0311       0312     A IGN_CTRL EQU   *
00267
00268                          ****************************************
00269                          * ignition lockout section             *
00270                          ****************************************
00271
00272  A 0311 01   b81c  0330 CHK_ILCK BRCLR ILOCK,LCKFLGS1,CHK_W if no ignition lockout, go check W input
00273
00274  A 0314 b6   bd       A CHK_ITMR LDA   ILOCKTMR+1 else get timer LSB
00275  A 0316 27   04    031c          BEQ   DEC_MSB1 if = 0 then go dec the MSB
00276  A 0318 3a   bd       A          DEC   ILOCKTMR+1 else dec the LSB
00277  A 031a 20   12    032e          BRA   CONT_LOCK go continue the lockout
00278
00279  A 031c b6   bc       A DEC_MSB1 LDA   ILOCKTMR get the timer MSB
00280  A 031e 27   13    0333          BEQ   W_OFF    if = 0 then the lockout is done
00281  A 0320 a1   01       A          CMP   #1
00282  A 0322 26   04    0328          BNE   NO_PRGE
00283  A 0324 a6   ff       A          LDA   #255     load IDFAN post purge
00284  A 0326 b7   cf       A          STA   POSTTMR
00285
00286  A 0328 3a   bc       A NO_PRGE  DEC   ILOCKTMR else dec the MSB
00287  A 032a a6   3c       A          LDA   #60      reset the LSB
```

```
M6805 Portable Cross Assembler  0.05  MAIN.ASM  Page 20
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00288  A 032c b7   bd       A          STA   ILOCKTMR+1
00289
00290  A 032e 3f   c6       A CONT_LOCK CLR  WONTMR   reset the W on timer so we don't ignite
00291
00292                          ****************************************
00293                          * W control section                    *
00294                          ****************************************
00295
00296  A 0330 0e   b122  0355 CHK_W    BRSET W,INCOPY1,W_ON if W on go to W on section
00297
00298                          ****************************************
00299                          * W off section                        *
00300                          ****************************************
00301
00302  A 0333 01   b803  0339 W_OFF    BRCLR ILOCK,LCKFLGS1,NO_HARD if no ignition lockout then do not...
00303  A 0336 cc   01d8     A          JMP   GO_RESET ... force a hard reset, else do
00304
00305  A 0339 3f   d2       A NO_HARD  CLR   RETRYCNT reset the retry counter
00306  A 033b 3f   d5       A          CLR   RECYCCNT reset the recycle counter
00307  A 033d 3f   ca       A          CLR   PSFLCNT  reset the PS failure counter
00308  A 033f b6   b8       A          LDA   LCKFLGS1 reset the retry, recycle and PS
00309  A 0341 a4   c1       A          AND   #%11000001 ... lockout mode flags
00310  A 0343 b7   b8       A          STA   LCKFLGS1
00311  A 0345 a6   32       A          LDA   #2       reset the initial pre purge time
00312  A 0347 b7   cb       A          STA   PREVAL
00313  A 0349 a6   44       A          LDA   #68      reset the initial igniter warm-up time
00314  A 034b b7   cd       A          STA   WARMVAL
00315
00316  A 034d      034d     A NO_PRGE  EQU   *
00317
00318  A 034d 3f   c6       A NO_RST   CLR   WONTMR   reset the W on proving timer
00319
00320  A 034f cd   04ec     A W_OFF1   JSR   RST_WTMRS reset rest of W on timers
00321  A 0352 cc   0469     A          JMP   IFAN_CTRL go to ignition fan control section
00322
00323                          ****************************************
00324                          * W on section                         *
00325                          ****************************************
00326
00327  A 0355 b6   c6       A W_ON     LDA   WONTMR   get the W on proving timer
00328  A 0357 a1   03       A          CMP   #3       compare to desired proving value
00329  A 0359 24   04    035f          BHS   W_ON1    if exceeded go to W on section
00330  A 035b 3c   c6       A          INC   WONTMR   else inc the timer
00331  A 035d 20   f0    034f          BRA   W_OFF1   go to W off section 1
00332
00333  A 035f      035f     A W_ON1    EQU   *        W proved on section
00334
00335  A 035f 05   bb03  0365 CHK_IDOFF BRCLR UNTSTD,PSFLGS,PS_TST if PS was on but untested make sure it...
00336  A 0362 cc   0469     A          JMP   IFAN_CTRL ... is off before testing
00337
00338                          ****************************************
00339                          * pressure switch test/monitor section *
```

```
09/17/96 59527 2.18T page 11

M6805 Portable Cross Assembler  0.05  MAIN.ASM  Page 21
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00340                        ****************************************
00341
00342  A 0365 1c   b3       A PS_TST   BSET  IDFAN,OUTREQ request the IDFAN
00343  A 0367 00   bb11  037b          BRSET T1DONE,PSFLGS,PS_MON if PS shorted test done to PS monitor 1
00344  A 036a 07   b107  037e          BRCLR PS,INCOPY1,PS_TST1 else if PS open, pass shorted test
00345  A 036d 1d   b3       A          BCLR  IDFAN,OUTREQ else clear IDFAN req
00346  A 036f 12   b8       A          BSET  PSLOCK1,LCKFLGS1 set PS shorted lockout
00347  A 0371 cc   0469     A          JMP   IFAN_CTRL go to ignition fan control section
00348
00349  A 0374 10   b8       A PS_TST1  BSET  T1DONE,PSFLGS set PS shorted test pass flag
00350  A 0376 13   b8       A          BCLR  PSLOCK1,LCKFLGS1 reset PS shorted lockout
00351  A 0378 cc   0469     A          JMP   IFAN_CTRL go to ignition fan control section
00352
00353  A 037b 06   b134  03b2 PS_MON   BRSET PS,INCOPY1,PS_OK if PS closed then pass PS closes test
00354  A 037e 03   bb21  03a2          BRCLR PSOK,PSFLGS,PS_MON1 else if test already done once go monitor
00355  A 0381 06   ba2e  03b2          BRSET MVSAG,WFLGS,PS_OK if this is the MV sag period then ignore
00356  A 0384 b6   c9       A          LDA   PSTMR    else get PS failure timer
00357  A 0386 a1   07       A          CMP   #7       compare to max allowed fail time
00358  A 0388 25   14   039e           BLO   INC_PS1  if less inc timer
00359  A 038a 13   18       A          BCLR  PSOK,PSFLGS else failure, clear PS ok flag
00360  A 038c b6   ca       A          LDA   PSFLCNT  get the PS failure counter
00361  A 038e a1   03       A          CMP   #3       compare to max number of failures allowed
00362  A 0390 24   07   0399           BHS   PS_LCK3  if exceeded then lockout ignition
00363  A 0392 3c   ca       A          INC   PSFLCNT  else inc the count
00364  A 0394 14   b8       A          BSET  PSLOCK2,LCKFLGS1 set PS fails to close lockout flag
00365  A 0396 cc   0454     A          JMP   RECYC_1  go recycle ignition
00366
00367  A 0399 1a   b8       A PS_LCK3  BSET  PSLOCK3,LCKFLGS1 set PS failure count lockout flag
00368  A 039b cc   0461     A          JMP   I_LOCK1  go lockout ignition
00369
00370  A 039e 3c   c9       A INC_PS1  INC   PSTMR    inc PS failure timer
00371  A 03a0 20   1b   03b8           BRA   PRE_PRGE go to pre-purge
00372
00373  A 03a2 b6   c9       A PS_MON1  LDA   PSTMR    get the timer
00374  A 03a4 a1   13       A          CMP   #19      compare to max allowed failure time
00375  A 03a6 24   05   03ad           BHS   PS_LCK2  if expired go to PS fails to close lockout
00376  A 03a8 3c   c9       A          INC   PSTMR    else inc PS failure timer MSB
00377  A 03aa cc   0469     A          JMP   IFAN_CTRL go to ignition fan control section
00378
00379  A 03ad 14   b8       A PS_LCK2  BSET  PSLOCK2,LCKFLGS1 set PS fails to close lockout flag
00380  A 03af cc   0469     A          JMP   IFAN_CTRL go to ignition fan control section
00381
00382  A 03b2 12   bb       A PS_OK    BSET  PSOK,PSFLGS set PS closes test passes
00383  A 03b4 15   ba       A          BCLR  PSLOCK2,LCKFLGS1 reset PS open lockout
00384  A 03b6 3f   c9       A          CLR   PSTMR    reset PS failure timer
00385
00386                        ****************************************
00387                        * IDFAN pre-purge timer section        *
00388                        ****************************************
00389
00390  A 03b8 b6   cc       A PRE_PRGE LDA   PRETMR   get IDFAN pre-purge timer
00391  A 03ba b1   cb       A          CMP   PREVAL   compare to desired pre-purge time
```

```
M6805 Portable Cross Assembler  0.05  MAIN.ASM  Page 22
 Fri Aug 09 15:30:31 1996
Options  MD,MC,NOG,NOU,W,NOMEX,CL,FMT,O

LINE   S PC   OPCO OPERANDS S LABEL    MNEMO OPERANDS COMMENT
00392  A 03bc 24   05   03c1           BHS   WARM_UP  if expired then go warm up the igniter
00393  A 03be 3c   cc       A          INC   PRETMR   else inc the timer
00394  A 03c0 cc   0469     A          JMP   IFAN_CTRL go to ignition fan control section
00395
00396                        ****************************************
00397                        * igniter warm-up section              *
00398                        ****************************************
00399
00400  A 03c3 1a   b3       A WARM_UP  BSET  HSI,OUTREQ request HSI
00401  A 03c5 b6   ce       A          LDA   WARMTMR  get the warm-up timer
00402  A 03c7 b1   cd       A          CMP   WARMVAL  compare to desired warm-up time
00403  A 03c9 24   05   03d0           BHS   MV_ON    if timer done then turn MV on
00404  A 03cb 3c   ce       A          INC   WARMTMR  else in the timer
00405  A 03cd cc   0469     A          JMP   IFAN_CTRL go to ignition fan control section
00406
00407                        ****************************************
00408                        * turn on the main valve relay         *
00409                        ****************************************
00410
00411  A 03d0 1e   b3       A MV_ON    BSET  MV,OUTREQ request MV relay
00412  A 03d2 a6   3c       A          LDA   #60      load IDFAN post purge
00413  A 03d4 b7   cf       A          STA   POSTTMR
00414
00415                        ****************************************
00416                        * main valve feedback failure test 3    *
00417                        ****************************************
00418
00419  A 03d6 04   b10a  03e3 MV_TST3  BRSET MVIN,INCOPY1,RST_VLK3 if MV feedback present reset lockout
00420  A 03d9 b6   c5       A          LDA   MVTMR3   else get the MV feedback failure timer
00421  A 03db a1   08       A          CMP   #8       compare to max allowed failure time
00422  A 03dd 24   54   0433           BHS   RETRY    if exceeded then retry
00423  A 03df 3c   c5       A          INC   MVTMR3   else inc the timer
00424  A 03e1 20   02   03e5           BRA   IGNITE   continue ignition sequence
00425
00426  A 03e3 3f   c5       A RST_VLK3 CLR   MVTMR3   reset MV relay failed to close lockout tmr
00427
00428                        ****************************************
00429                        * start ignition                       *
00430                        ****************************************
00431
00432  A 03e5 1b   ba       A IGNITE   BCLR  FLSHLED,WFLGS only allow LED to flash once when...
00433                        *          ... flame detected
00434  A 03e7 00   ba1a  0404          BRSET FSTABFLG,WFLGS,FSTAB_PSR if flame stab. period go service
00435  A 03ea 16   ba       A          BSET  MVSAG,WFLGS set the MV causes pressure to sag flag
00436  A 03ec b6   d1       A          LDA   RETRYTMR else get retry timer
00437  A 03ee a1   14       A          CMP   #20      compare to desired HSI/MV on time
00438  A 03f0 24   05   03f7           BHS   IGN_PROOF if done turn HSI off and look for flame
00439
00440  A 03f2 3c   d1       A INC_RETRY INC  RETRYTMR else inc the retry timer
00441  A 03f4 cc   0469     A          JMP   IFAN_CTRL go to ignition fan control section
00442
00443  A 03f7 17   ba       A IGN_PROOF BCLR MVSAG,WFLGS reset the MV sag flag
```

```
09/17/96 59527-2..st page 12

M6805 Portable Cross Assembler  0.05  MAIN.ASM  Page 23
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00444  A 03f9 1b   b3       A          BCLR  HSI,OUTREQ clear igniter request
00445  A 03fb a1   1c       A          CMP   #28       compare retry timer to max allowed time
00446  A 03fd 24   34    0433          BHS   RETRY     if exceeded then retry ignition
00447  A 03ff 03   b1f0  03f2          BRCLR S1,INCOPY1,INC_RETRY else if flame not sensed inc the retry tmr
00448  A 0402 1a   ba       A          BSET  FLSHLED,WFLGS else signal flame sensed and start fstab
00449
00450                          ****************************************
00451                          * flame stabilization period            *
00452                          ****************************************
00453
00454  A 0404 10   ba       A FSTAB_PER BSET FSTABFLG,WFLGS set the flame stabilization period flag
00455  A 0406 1b   b3       A          BCLR  HSI,OUTREQ clear igniter request
00456  A 0408 02   ba19  0424          BRSET IGNFLG,WFLGS,IGN_DONE if ignition done go service
00457  A 040b 02   b10a  0414          BRSET S1,INCOPY1,RST_FSFL if flame sensed reset flame stab. fail tmr
00458  A 040e b6   d4       A          LDA   FSFAILTMR else get flame stabilization failure tmr
00459  A 0410 a3   07       A          CMP   #7        compare to max failure time
00460  A 0412 24   1f    0433          BHS   RETRY     if expired go retry ignition
00461  A 0414 3c   d4       A          INC   FSFAILTMR else inc the failure timer
00462  A 0416 20   02    041a          BRA   CHK_FSTAB go check flame stab period timer
00463
00464  A 0418 4f   d4       A RST_FSFL CLR   FSFAILTMR reset the flame stab failure timer
00465
00466  A 041a b6   d1       A CHK_FSTAB LDA  FSTARTMR get stabilization period timer
00467  A 041c a1   27       A          CMP   #39       compare to desired period
00468  A 041e 24   06    0424          BHS   IGN_DONE if expired then ignition done
00469  A 0420 3c   d1       A          INC   FSTARTMR else inc the flame stab period timer
00470  A 0422 20   0a    042e          BRA   HFAN_ON1 go request the heat fan
00471
00472                          ****************************************
00473                          * ignition done section                 *
00474                          ****************************************
00475
00476  A 0424 12   ba       A IGN_DONE BSET  IGNFLG,WFLGS set the ignition done flag
00477  A 0426 3f   d2       A          CLR   RETRYCNT reset retry counter
00478  A 0428 0c   501d  0448          BRSET FTSTFL,IFLGS,RECYCLE if flame circuit test fails recycle
00479  A 042b 03   b11a  0448          BRCLR S1,INCOPY1,RECYCLE else if flame sense lost recycle
00480
00481  A 042e cd   051a     A HFAN_ON1 JSR   REQ_HFAN go request HFAN
00482  A 0431 20   36    0469          BRA   IFAN_CTRL go to ignition fan control section
00483
00484                          ****************************************
00485                          * ignition retry section                *
00486                          ****************************************
00487
00488  A 0433 3c   d2       A RETRY    INC   RETRYCNT inc the retry counter
00489  A 0435 b6   d2       A          LDA   RETRYCNT get the retry counter
00490  A 0437 a1   03       A          CMP   #3        compare to max allowed retrys
00491  A 0439 25   04    043f          BLO   RETRY_1   if less then retry only
00492  A 043b 16   b8       A          BSET  RETRYFLG,LCKFLGS1 else set retry lockout flag
00493  A 043d 20   22    0461          BRA   I_LOCK1   go lockout ignition
00494
00495  A 043f a6   3c       A RETRY_1  LDA   #60       set the interpurge time
```

```
M6805 Portable Cross Assembler  0.05  MAIN.ASM  Page 24
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00496  A 0441 b7   cb       A          STA   PREVAL
00497  A 0443 cd   04ec     A          JSR   RST_WTMRS reset rest of W on timers
00498  A 0446 20   13    045b          BRA   EXT_HSI   go extend igniter warm up
00499
00500                          ****************************************
00501                          * ignition recycle section              *
00502                          ****************************************
00503
00504  A 0448 3c   d5       A RECYCLE  INC   RECYCCNT inc the recycle counter
00505  A 044a b6   d5       A          LDA   RECYCCNT get the recycle counter
00506  A 044c a1   05       A          CMP   #5        compare to max allowed recycles
00507  A 044e 25   04    0454          BLO   RECYC_1   if less then recycle only
00508  A 0450 18   b8       A          BSET  RECYCFLG,LCKFLGS1 else set recycle lockout flag
00509  A 0452 20   0d    0461          BRA   I_LOCK1   go lockout ignition
00510
00511  A 0454 cd   04ec     A RECYC_1  JSR   RST_WTMRS reset W on timers
00512  A 0457 b6   cb       A          LDA   PREVAL    force interpurge to be skipped
00513  A 0459 b7   cc       A          STA   PREIMR
00514
00515  A 045b a6   6c       A EXT_HSI  LDA   #108      set the 2nd pass igniter warm-up time
00516  A 045d b7   cd       A          STA   WARMVAL
00517  A 045f 20   08    0469          BRA   IFAN_CTRL go to ignition fan control section
00518
00519                          ****************************************
00520                          * ignition lockouts section             *
00521                          ****************************************
00522
00523  A 0461 a6   f1       A I_LOCK1  LDA   #241      lockout ignition for an hour
00524  A 0463 b7   bc       A          STA   ILOCKTMR
00525  A 0465 3f   bd       A          CLR   ILOCKTMR+1
00526
00527  A 0467 10   b8       A I_LOCK   BSET  ILOCK,LCKFLGS1 set the ignition lockout flag
00528
00529                          ************************************************************************
00530                          *                        IGNITION FANS CONTROL SECTION                 *
00531                          ************************************************************************
00532
00533  A 0469      0469     A IFAN_CTRL EQU  *
00534
00535                          ****************************************
00536                          * induced draft fan delay off section   *
00537                          ****************************************
00538
00539  A 0469 b6   cf       A          LDA   POSTTMR   else get the post purge timer
00540  A 046b 27   06    0473          BEQ   IDFAN_OFF if = 0 then check IDFAN spin down timer
00541  A 046d 3a   cf       A          DEC   POSTTMR   else dec the post purge timer
00542  A 046f 1c   b3       A          BSET  IDFAN,OUTREQ continue IDFAN req.
00543  A 0471 20   15    0488          BRA   HFAN_DLYS go check HFAN delays
00544
00545  A 0473 0c   b30e  0484 IDFAN_OFF BRSET IDFAN,OUTREQ,RST_IDOFF if IDFAN req. then reset spin down timer
00546  A 0476 b6   d0       A          LDA   IDOFFTMR  else get the IDFAN spin down timer
00547  A 0478 27   06    0480          BEQ   CLR_FLGS  if expired then reset the FS test flags
```

A40678

09/17/96 59527-2.lst page 13

M6805 Portable Cross Assembler 0.05 MAIN.ASM Page 25
Fri Aug 09 15:30:31 1996
Options - MD,MC,NOG,NOU,W,NOMEX,CL,FMT,O

```
LINE   S PC   OPCO OPERANDS S LABEL    MNEMO OPERANDS COMMENT
00548  A 047a 3a   dc       A          DEC   IDOFFTMR else dec the spin down timer
00549  A 047c 4f   c6       A          CLR   WONTMR   reset the W on timer to halt ignition
00550  A 047e 20   08    0488          BRA   HFAN_DLYS go check HFAN delays
00551
00552  A 0480 3f   bb       A CLR_FLGS CLR   PSFLGS   reset the PS test flags
00553  A 0482 20   04    0488          BRA   HFAN_DLYS go check HFAN delays
00554
00555  A 0484 a6   14       A RST_IDOFF LDA  #20      reset the IDFAN spin down timer
00556  A 0486 b7   d0       A          STA   IDOFFTMR
00557
00558                          ****************************************
00559                          * heat fan delay off/on section        *
00560                          ****************************************
00561
00562  A 0488 08   b112  049d HFAN_DLYS BRSET HFAN,OUTREQ,HFAN_ON2 if HFAN req go check delay on
00563  A 048b b6   c0       A          LDA   HFDLYOFF+1 else get delay off LSB
00564  A 048d 27   04    0493          BEQ   DEC_MSB  if = 0 then go dec MSB
00565  A 048f 3a   c0       A          DEC   HFDLYOFF+1 else dec the LSB
00566  A 0491 20   0a    049d          BRA   HFAN_ON2 go to the HFAN on section
00567
00568  A 0493 b6   bf       A DEC_MSB  LDA   HFDLYOFF get the delay off MSB
00569  A 0495 27   17    04ae          BEQ   RST_HFON if = 0 then reset the delay on
00570  A 0497 3a   bf       A          DEC   HFDLYOFF else dec the MSB
00571  A 0499 a6   78       A          LDA   #120     reset the LSB
00572  A 049b b7   c0       A          STA   HFDLYOFF+1
00573
00574  A 049d cd   053a     A HFAN_ON2 JSR   RD_JMPRS go read HFAN delay off jumpers
00575  A 04a0 18   b3       A          BSET  HFAN,OUTREQ req the HFAN
00576  A 04a2 b6   be       A          LDA   HFDLYON  get the delay on
00577  A 04a4 a1   77       A          CMP   #119     compare to desired delay on
00578  A 04a6 24   08    04b0          BHS   FAN_SW   if expired go to fan switcher
00579  A 04a8 3c   be       A          INC   HFDLYON  else inc the delay on
00580  A 04aa 19   b3       A          BCLR  HFAN,OUTREQ clear the HFAN req
00581  A 04ac 20   02    04b0          BRA   FAN_SW   go to fan switcher routine
00582
00583  A 04ae 3f   be       A RST_HFON CLR   HFDLYON  reset the HFAN dly on
00584
00585                          ************************************************************************
00586                          *                          FAN SWITCHER SECTION                        *
00587                          ************************************************************************
00588
00589  A 04b0      04b0     A FAN_SW   EQU   *
00590
00591                          ****************************************
00592                          * heat fan mode switching section      *
00593                          ****************************************
00594
00595  A 04b0 09   b30c  04bf CHK_HFAN BRCLR HFAN,OUTREQ,CHK_CFAN if heat fan not req. go check CFAN req.
00596  A 04b3 07   b404  04ba          BRCLR SPEED,OUTCOPY,PWR_CHK1 if speed relay off go check...
00597                          *                                        ... power relay status
00598  A 04b6 16   b3       A          BSET  SPEED,OUTREQ else keep speed relay on (heat fan on)
00599  A 04b8 20   0d    04c7          BRA   PWR_ON   go request power relay on
```

M6805 Portable Cross Assembler 0.05 MAIN.ASM Page 26
Fri Aug 09 15:30:31 1996
Options - MD,MC,NOG,NOU,W,NOMEX,CL,FMT,O

```
LINE   S PC   OPCO OPERANDS S LABEL    MNEMO OPERANDS COMMENT
00600
00601  A 04ba 08   b41d  04da PWR_CHK1 BRSET POWER,OUTCOPY,SOFF_POFF else if power relay on keep speed off...
00602                          *                                        ... and turn power off
00603  A 04bd 20   17    04d6          BRA   SON_POFF else keep power off and and turn speed...
00604                          *                                        ... on (heat fan on)
00605                          ****************************************
00606                          * cool fan mode switching section      *
00607                          ****************************************
00608
00609  A 04bf 07   b30c  04d0 CHK_CFAN BRCLR CFAN,OUTREQ,RST_RLYS if cool fan not req. go turn all relays off
00610  A 04c2 06   b400  04cb          BRSET SPEED,OUTCOPY,PWR_CHK2 else if speed relay on go check...
00611                          *                                        ... power relay status
00612  A 04c5 17   b3       A          BCLR  SPEED,OUTREQ else keep speed relay off (cool fan on)
00613
00614  A 04c7 18   b3       A PWR_ON   BSET  POWER,OUTREQ turn power relay on
00615  A 04c9 20   13    04de          BRA   OUT_DATA go request new output state
00616
00617  A 04cb 08   b408  04d6 PWR_CHK2 BRSET POWER,OUTCOPY,SON_POFF else if power relay on keep speed on...
00618                          *                                        ... and turn power off
00619  A 04ce 20   0a    04da          BRA   SOFF_POFF else keep power off and turn speed on...
00620                          *                                        ... (cool fan on)
00621  A 04d0 09   b407  04da RST_RLYS BRCLR POWER,OUTCOPY,SOFF_POFF if power relay off keep power off...
00622                          *                                        ... and turn twin and speed off
00623  A 04d3 07   b404  04da SPD_CHK1 BRCLR SPEED,OUTCOPY,SOFF_POFF else if speed off keep speed off...
00624                          *                                        ... and turn power off
00625  A 04d6 16   b3       A SON_POFF BSET  SPEED,OUTREQ else keep speed on
00626  A 04d8 20   02    04dc          BRA   PWR_OFF  and turn power off
00627
00628  A 04da 17   b3       A SOFF_POFF BCLR SPEED,OUTREQ turn speed off
00629
00630  A 04dc 19   b3       A PWR_OFF  BCLR  POWER,OUTREQ turn power off
00631
00632                          ************************************************************************
00633                          *                          COPY NEW OUTPUTS REQUEST                    *
00634                          ************************************************************************
00635
00636  A 04de b6   b3       A OUT_DATA LDA   OUTREQ   get the new output requests
00637  A 04e0 b7   b4       A          STA   OUTCOPY  save as new outputs status
00638  A 04e2 b1   b4       A          CMP   OUTCOPY  read back the outputs copy
00639  A 04e4 27   03    04e9          BEQ   JMP_STRT if the same as should be, do main again
00640  A 04e6 cc   01d8     A          JMP   GO_RESET else force reset
00641
00642  A 04e9 cc   020f     A JMP_STRT JMP   START_1  go start main loop over
00643
00644                          ****************************************
00645                          * reset W on timers sub.               *
00646                          ****************************************
00647
00648  A 04ec 3f   c9       A RST_WTMRS CLR  PSTMR    reset the PS test failure timer
00649  A 04ee 3f   cc       A          CLR   PRETMR   reset the pre-purge timer
00650  A 04f0 3f   ce       A          CLR   WARMTMR  reset the igniter warm-up timer
00651  A 04f2 3f   c5       A          CLR   MVTMR3   reset MV feedback failure mode 3 timer
```

```
09/17/96 59527-2.lst page 14

M6805 Portable Cross Assembler  0.05  MAIN.ASM  Page 27
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00052  A 04f4 3f   d1       A          CLR   RETRYTMR reset the retry timer
00053  A 04f6 3f   ba       A          CLR   WFLGS    reset the W on flags
00054  A 04f8 3f   d4       A          CLR   FSFAILTMR reset the flame stabilization failure timer
00055  A 04fa 3f   d3       A          CLR   FSTABTMR reset the flame stabilization period timer
00056  A 04fc 1d   90       A          BCLR  FTSTFL,FLGS reset flame circuit test failure flag
00057  A 04fe 81                       RTS            end reset W on timers sub.
00058
00059                          ****************************************
00060                          * safety mode fans on sub               *
00061                          ****************************************
00062
00063  A 04ff a6   3c       A SAFE_A   LDA   #60       load an IDFAN post purge
00064  A 0501 b7   cf       A          STA   POSTTMR
00065  A 0503 a6   77       A          LDA   #119      accelerate the HFAN delay on
00066  A 0505 b7   be       A          STA   HFDLYON
00067  A 0507 3f   b3       A          CLR   OUTREQ    turn all off except IDFAN and HFAN
00068  A 0509 cd   051a     A          JSR   REQ_HFAN go load HFAN delay off
00069
00070  A 050c 1c   b3       A SAFE_B   BSET  IDFAN,OUTREQ
00071  A 050e 09   bb06  0517          BRSET T10ONE,PSFLGS,END SAFE else check if PS test done
00072  A 0511 14   bb       A          BSET  UNTSTD,PSFLGS if not set the IDFAN on PS untested flag
00073  A 0513 a6   14       A          LDA   #20       reset the IDFAN spin down timer
00074  A 0515 b7   d0       A          STA   IDOFFTMR
00075
00076  A 0517 3f   c6       A END_SAFE CLR   WONTMR    halt ignition
00077  A 0519 81                       RTS            end the safety mode sub.
00078
00079                          ****************************************
00080                          * request heat fan on sub.        *
00081                          ****************************************
00082
00083  A 051a 18   b3       A REQ_HFAN BSET  HFAN,OUTREQ else request HFAN
00084  A 051c b6   c1       A          LDA   HFDLYFX  load HFAN delay off
00085  A 051e b7   bf       A          STA   HFDLYOFF
00086  A 0520 3f   c0       A          CLR   HFDLYOFF+1
00087  A 0522 81                       RTS
00092
00094                                  INCLUDE MISCSUB.ASM miscellaneous subroutines
00001                                  OPT   NOL
00014                                  OPT   L
00015
00016                          ************************************************************************
00017                          *                SYSTEM INITIALIZATION SET/REFRESH ROUTINE                *
00018                          ************************************************************************
00019
00020  A 0523 3f   04       A SYS_FRESH CLR  DDRA      init PORTA as all inputs
00021  A 0525 3f   0a       A          CLR   SCR       serial port not used
00022  A 0527 a6   20       A          LDA   #DDRBSET init PORTB as mixed I/O
00023  A 0529 b7   05       A          STA   DDRB
00024  A 052b a6   fc       A          LDA   #DDRCSET init PORTC as mixed I/O
00025  A 052d b7   06       A          STA   DDRC
00026  A 052f 3f   07       A          CLR   DDRD      init PORTD as all inputs
```

```
M6805 Portable Cross Assembler  0.05  MISCSUB.ASM  Page 28
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00027  A 0531 a6   60       A          LDA   #%01100000 re-initialize the TCR - TOIE and OCIE...
00028  A 0533 b7   12       A          STA   TCR       ... enabled, ICIE disabled
00029
00030                                  ************************************************************************
00031                                  *                     PET THE WATCH DOG SUBROUTINE                     *
00032                                  ************************************************************************
00033
00034  A 0535 5f                       PET_DOG CLRX
00035  A 0536 cf   1ff0     A          STX   WDOG      reset the watch dog timer
00036  A 0539 81                       RTS            return from subroutine
00037
00038                                  ************************************************************************
00039                                  *            READ THE HEAT FAN JUMPERS SUBROUTINE  *
00040                                  ************************************************************************
00041
00042  A 053a 0a   030e  054b RD_JMPRS BRSET DLYJMP1,PORTD,SET_120 if 120 sec jumper on go load 120 delay
00043  A 053d 0e   030f  054f          BRSET DLYJMP2,PORTD,SET_90 else if 90 sec jumper on go load 90 delay
00044  A 0540 1a   07       A          BSET  DLYJMP1,DDRD else turn jumper 1 input into output
00045  A 0542 1a   03       A          BSET  DLYJMP1,PORTD drive it high
00046  A 0544 0e   030c  0553          BRSET DLYJMP2,PORTD,SET_60 if jumper 2 high then load 60 delay...
00047                                  *                    ...else load 180 delay
00048  A 0547 a6   06       A SET_180  LDA   #6        load 180 sec. delay off value
00049  A 0549 20   0a    0555          BRA   SAV_VAL   go save delay value
00050
00051  A 054b a6   04       A SET_120  LDA   #4        load 120 sec. delay off value
00052  A 054d 20   06    0555          BRA   SAV_VAL   go save delay value
00053
00054  A 054f a6   03       A SET_90   LDA   #3        load 90 sec. delay off value
00055  A 0551 20   02    0555          BRA   SAV_VAL   go save delay value
00056
00057  A 0553 a6   02       A SET_60   LDA   #2        load 60 sec. delay off value
00058
00059  A 0555 b7   c1       A SAV_VAL  STA   HFDLYFX   save the delay off value
00060  A 0557 1b   07       A          BCLR  DLYJMP1,DDRD reset jumper 1 to be an input
00061                                  *                 go calc checksum
00062                                  ************************************************************************
00063                                  *                          CALCULATE A RAM CHECKSUM    *
00064                                  ************************************************************************
00065
00066  A 0559 3f   a1       A CALC_CSUM CLR  TEMPCSUM clear checksum accumulator
00067  A 055b 3f   a2       A          CLR   TEMPCSUM+1
00068  A 055d ae   b1       A          LDX   #CSUMSTRT load start point of memory to check
00069
00070  A 055f b6   a2       A CONT_CSUM LDA  TEMPCSUM+1 get current accumulator value
00071  A 0561 fb                       ADD   0,X       add next byte to current value
00072  A 0562 b7   a2       A          STA   TEMPCSUM+1 save
00073  A 0564 24   02    0568          BCC   INC_X     if register did not rollover then inc X only
00074  A 0566 3c   a1       A          INC   TEMPCSUM  else inc the hi byte
00075  A 0568 5c                  INC_X INCX            inc X to point to next address
00076  A 0569 a3   d8       A          CMPX  #CSUMEND  check if all addresses done
00077  A 056b 26   f2    055f          BNE   CONT_CSUM if not, continue checksum
00078  A 056d be   a1       A          LDX   TEMPCSUM  else get hi byte in X, lo byte is in A
```

```
M6805 Portable Cross Assembler  0.05  MISCSUB.ASM  Page 29
 Fri Aug 09 15:30:31 1996
Options - MD,MC,NOG,NOO,W,NOMEX,CL,PMT,O

LINE   S PC   OPCO OPERANDS S LABEL    MNEMO OPERANDS COMMENT
00079  A 056f 81                       RTS            end checksum routine
00094
00095                                  INCLUDE IRQ.ASM IRQ interrupt handler module
00021                                  OPT   NOL
00018                                  OPT   L
00019
00020                          ***********************************************************************
00021                          *                    INPUTS ROUTINE (IRQ INTERRUPT HANDLER)                    *
00022                          ***********************************************************************
00023
00024  A 0570 2e   31    0573 IRQV    BTL   IRQV1    if interrupt line is still low then...
00025  A 0572 80                       RTI            ... this may be a good interrupt...
00026                          *                                    ... else exit IRQ routine
00027                          ***********************************
00028                          *  Calculate the RTCLOCK value        *
00029                          ***********************************
00030
00031  A 0573 be   1a       A IRQV1    LDX   ALTCNTHI load and store the current RTC value...
00032  A 0575 b6   1b       A          LDA   ALTCNTLO ... this is now the start time
00033  A 0577 bf   a5       A          STX   TEMP     save this to be used as prev cal next cycle
00034  A 0579 b7   a6       A          STA   TEMP+1
00035  A 057b b0   97       A          SUB   PREVCAL+1 subtract the previous time to get duration
00036  A 057d 97                       TAX            put LSB in X for division
00037  A 057e b6   a5       A          LDA   TEMP     get MSB
00038  A 0580 b2   96       A          SBC   PREVCAL  subtract the previous MSB
00039  A 0582 44                       LSRA           divide the AC line period by 32 to get...
00040  A 0583 56                       RORX           ... the RTCLOCK value
00041  A 0584 44                       LSRA
00042  A 0585 56                       RORX
00043  A 0586 44                       LSRA
00044  A 0587 56                       RORX
00045  A 0588 44                       LSRA
00046  A 0589 56                       RORX
00047  A 058a 44                       LSRA
00048  A 058b 56                       RORX
00049  A 058c cd   0630     A          JSR   CHK_PEAK go check if the cal value is good
00050  A 058f 26   0e     059f         BNE   CAL_OK   if Z flag not set then value good
00051  A 0591 b6   94       A          LDA   RTCLOCK  else get current cal value
00052  A 0593 be   95       A          LDX   RTCLOCK+1
00053  A 0595 cd   0630     A          JSR   CHK_PEAK go check if the current cal value is good
00054  A 0598 26   0c     05a6         BNE   SAV_CAL  if Z flag not set then value good
00055  A 059a 4f                       CLRA           else load nominal (2.73 MHz) value...
00056  A 059b ae   b1       A          LDX   #$B1     ... so as to limp along
00057  A 059d 20   07     05a6         BRA   SAV_CAL
00058
00059  A 059f 1b   90       A CAL_OK   BCLR  PHSESWAP,IPLGS default to COM to NEUTRAL phasing
00060  A 05a1 0f   0102     05a6       BRCLR ROLLOUT2,PORTB,SAV_CAL if ROLLOUT 2 sense low then xfrmer...
00061                          *                    ... phased COM to NEUTRAL
00062  A 05a4 1a   90       A          BSET  PHSESWAP,IPLGS else xfrmer phased COM to L1
00063
00064  A 05a6 b7   94       A SAV_CAL  STA   RTCLOCK  save A:X as the RTCLOCK value
00065  A 05a8 bf   95       A          STX   RTCLOCK+1
```

```
M6805 Portable Cross Assembler  0.05  IRQ.ASM  Page 30
 Fri Aug 09 15:30:31 1996
Options - MD,MC,NOG,NOO,W,NOMEX,CL,PMT,O

LINE   S PC   OPCO OPERANDS S LABEL    MNEMO OPERANDS COMMENT
00066
00067  A 05aa be   a5       A SAV_PREV LDX   TEMP     get the temp saved entry time
00068  A 05ac b6   a6       A          LDA   TEMP+1
00069  A 05ae bf   96       A          STX   PREVCAL  save as previous val for next int...
00070  A 05b0 b7   97       A          STA   PREVCAL+1 ... and go calc OCF int value
00071
00072                          ***************************************
00073                          * prepare output compare int. to      *
00074                          * re-sync for inputs reads            *
00075                          ***************************************
00076
00077  A 05b2 cd   0646     A PREP_READ JSR  CALC_OCF use contents of A:X and TEMP to calc...
00078                          *                    ... next OCF interrupt
00079  A 05b5 3f   9b       A          CLR   OCFCNT   reset the OCF counter used in OCF int.
00080  A 05b7 cd   0810     A          JSR   PLSE_RLYS go to pulse relays sub.
00081
00082                          ***************************************
00083                          * AC line edge counter section        *
00084                          ***************************************
00085
00086  A 05ba 3c   8e       A EDGE_CNTR INC  EDGECNT  increment the count
00087  A 05bc 0d   8e03   05c2           BRCLR 6,EDGECNT,CNT_OK if count not reached fail val then ck
00088  A 05bf 3f   92       A          CLR   RAMCRC   else clear RAM CRC value and do a...
00089  A 05c1 83                       SWI            ... full reset
00090
00091  A 05c2      05c2     A CNT_OK   EQU   *
00092
00093                          ***************************************
00094                          * test mode check section   *
00095                          ***************************************
00096
00097  A 05c2 06   901b   05e0 TST_CHK  BRSET TESTDONE,IFLGS,TEST_DONE if test already done skip
00098  A 05c5 b6   ad       A          LDA   TSTTMR   else get test valid timer
00099  A 05c7 a1   3c       A          CMP   #60      compare to max allowed run time...
00100                          *                    ... before testing invalid
00101  A 05c9 24   15     05e0         BHS   NO_TEST  if expired then do not test
00102  A 05cb 3c   ad       A          INC   TSTTMR   else inc the timer
00103  A 05cd 0a   8701   05d1         BRSET TESTMODE,INPUTS2,TST_CHK1 if test mode input on check if...
00104                          *                    ... test mode or shorted I/O
00105  A 05d0 80                       RTI            else end interrupt
00106
00107  A 05d1 0a   030c   05e0 TST_CHK1 BRSET TESTMODE,PORTD,NO_TEST if input HI at this point then DC...
00108                          *                    ... on test input so no test
00109                          *                    else must be AC so check other req.
00110  A 05d4 b6   80       A          LDA   INPUTS1  verify if LIMIT and MVIN on, all...
00111  A 05d6 a1   14       A          CMP   #%00010100 ... others off
00112  A 05d8 26   06     05e0         BNE   NO_TEST  if not no test
00113  A 05da b6   87       A          LDA   INPUTS2  else verify TESTMODE on, ROLLOUT2 off
00114  A 05dc a1   20       A          CMP   #%00100000
00115  A 05de 27   03     05e3         BEQ   MFG_TST  if so then test
00116                          *                    ... else no test
00117  A 05e0      05e0     A TEST_DONE EQU  *
```

```
09/17/96 59527-2.lst page 16

M6805 Portable Cross Assembler  0.05  IRQ.ASM  Page 31
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00118
00119  A 05e0 16   90       A NO_TEST  BSET  TESTDONE,IFLGS set the test mode done/invalid flag
00120  A 05e2 80                       RTI            end the interrupt
00121
00122  A 05e3 16   90       A MPU_TST  BSET  TESTDONE,IFLGS set the test mode done/invalid flag
00123  A 05e5 1a   02       A          BSET  HSI,PORTC else signal tester data about to start
00124
00125  A 05e7 0f   01fd  05e7 SPI_SYNC BRCLR SERCLK,PORTB,SPI_SYNC wait for SPI clock line to go high...
00126                         *              ... (default) before turning SPI into SPI
00127
00128  A 05ea a6   40       A          LDA   #%01000000 turn SPI into SPI (slave mode)
00129  A 05ec b7   0a       A          STA   SCR
00130
00131  A 05ee cd   0535     A          JSR   PET_DOG  pet the watch dog
00132
00133  A 05f1 ae   09       A          LDX   #9       load the number of bytes to be xfered
00134
00135  A 05f3 5a              SERIAL_X DECX           dec the byte counter
00136  A 05f4 27   0f    0605          BEQ   END_XFER if = 0 then done
00137  A 05f6 e61f                     LDA   PNCPY-1,X else get PNCPY byte to xfer
00138  A 05f8 a3   03       A          CMPX  #3       compare byte count to see if PNCPY done
00139  A 05fa 24   02    05fe          BHS   DATA_OUT if not then xfer PNCPY byte
00140  A 05fc e691                     LDA   RAMCRC-1,X else get RAMCRC data
00141
00142  A 05fe b7   0c       A DATA_OUT STA   SDR      load serial data register
00143
00144  A 0600 0f   0bfd  0600 XFER_1  BRCLR SPIF,SSR,XFER_1 wait for xfer to complete
00145  A 0603 20   ee    05f3          BRA   SERIAL_X go xfer next byte
00146
00147  A 0605 3f   0a       A END_XFER CLR   SCR      turn SPI back into I/O
00148
00149  A 0607 cd   0535     A          JSR   PET_DOG  pet the watch dog
00150
00151  A 060a 01   02fd  060a IO_STRT  BRCLR Y,PORTC,IO_STRT check that PC0 high before...
00152                         *              ... starting I/O test
00153
00154  A 060d b6   00       A PA_CHK1  LDA   PORTA    get port A status
00155  A 060f a4   fd       A          AND   #%11111101 mask off unused I/O
00156  A 0611 a1   a4       A          CMP   #%10101000 check for proper I/O sequence...
00157                         *              ... W/ROLLOUT1/PSIN ON
00158                         *              ... G/RLIMIT/MVIN/FLAME/CONDSNSE OFF
00159  A 0613 26   f8    060d          BNE   PA_CHK1  if not correct keep checking
00160
00161  A 0615 cd   0535     A          JSR   PET_DOG  pet the watch dog
00162
00163  A 0618 a6   a8       A PC_CHK1  LDA   #%10101000 turn on specific outputs combination...
00164  A 061a b7   02       A          STA   PORTC    ... for tester to verify...
00165                         *              ... MV/HSI/SPEED ON
00166                         *              ... IDFAN/POWER/LED/TWIN/Y OFF
00167
00168  A 061c b6   00       A PA_CHK2  LDA   PORTA    get port A status
00169  A 061e a4   fd       A          AND   #%11111101 mask off unused I/O
```

```
M6805 Portable Cross Assembler  0.05  IRQ.ASM  Page 32
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00170  A 0620 a1   55       A          CMP   #%01010101 check for proper I/O sequence...
00171                         *              ... G/RLIMIT/MVIN/CONDSNSE ON
00172                         *              ... W/ROLLOUT1/PSIN/FLAME OFF
00173  A 0622 26   f8    061c          BNE   PA_CHK2  if not correct keep checking
00174
00175  A 0624 cd   0535     A          JSR   PET_DOG  pet the watch dog
00176
00177  A 0627 a6   54       A PC_CHK2  LDA   #%01010100 turn on specific outputs combination...
00178  A 0629 b7   02       A          STA   PORTC    ... for tester to verify...
00179                         *              ... IDFAN/POWER/LED ON
00180                         *              ... MV/HSI/SPEED/TWIN/Y OFF
00181
00182  A 062b cd   0535     A          JSR   PET_DOG  pet the watch dog
00183
00184  A 062e 20   fe    062e WAIT_DOG BRA   WAIT_DOG wait here for a watchdog timeout
00185
00186                         ************************************
00187                         *  Check the RTCLOCK value         *
00188                         ************************************
00189
00190  A 0630 a1   01       A CHK_PEAK CMPA  #$01     compare MSB to 50 Hz 4% @ 4.1 MHz value
00191  A 0632 25   08    063c          BLO   CHK_LOW  if less check if clock value is too low
00192  A 0634 22   0b    0641          BHI   CLK_BAD  else if greater then clock is bad
00193  A 0636 a3   4e       A          CMPX  #$4E     else if equal check LSB
00194  A 0638 25   06    0640          BLO   CLK_GOOD if less then clock good
00195  A 063a 20   05    0641          BRA   CLK_BAD  else clock is bad
00196
00197  A 063c a3   54       A CHK_LOW  CMPX  #$54     compare to 60 hz+4% @ 1.36 mhz value
00198  A 063e 23   01    0641          BLS   CLK_BAD  if less then clock is bad
00199
00200  A 0640 81              CLK_GOOD RTS
00201
00202  A 0641 4f              CLK_BAD  CLRA           clear A to set Z flag (fail signal)
00203  A 0642 81                       RTS
00204
00205                         ************************************
00206                         *  Calculate the next OCF interrupt    *
00207                         ************************************
00208
00209  A 0643 bb   95       A CALC_OCF ADD   RTCLOCK+1 add LO count for next int.
00210  A 0645 97                       TAX            temp save in X
00211  A 0646 b6   a5       A          LDA   TEMP     get temp saved HI byte
00212  A 0648 b9   94       A          ADC   RTCLOCK  add HI count for next int.
00213  A 064a b7   16       A          STA   TCMPHI   load HI byte of compare
00214  A 064c 3d   13       A          TST   TSR      reset compare int.
00215  A 064e bf   17       A          STX   TCMPLO   load LO byte of compare
00216  A 0650 81                       RTS
00096
00097                                  INCLUDE TIMER.ASM timer interrupt handler module
00001                                  OPT   NOL
00021                                  OPT   L
00022
```

```
M6805 Portable Cross Assembler  0.05  TIMER.ASM  Page 33
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00023                        ****************************************************************************
00024                        *                    OUTPUTS ROUTINE (TIMER INTERRUPT HANDLER)                *
00025                        ****************************************************************************
00026
00027  A 0651 0c   1331  0685 TIMERV   BRSET OCF,TSR,OCF_INT if OCF set then handle OCF int.
00028  A 0654 0a   1307  065e          BRSET TOF,TSR,TOF_INT else if TOF set then handle TOF int.
00029  A 0657 3d   15      A           TST   TCMPLO  clear the TOF in case this is the int source
00030  A 0659 a6   60      A           LDA   #%01100000 re-initialize the TCR - TOIE and OCIE...
00031  A 065b b7   12      A           STA   TCR        ... enabled, iClk disabled
00032  A 065d 80                        RTI            else int. error
00033
00034                        ****************************************
00035                        * timer overflow int. handler           *
00036                        ****************************************
00037
00038
00039  A 065e 3d   19      A TOF_INT   TST   TCNTLO   clear the TOF int. flag
00040
00041                        ****************************************
00042                        * write new outputs                     *
00043                        ****************************************
00044
00045  A 0660 b6   b4      A           LDA   OUTCOPY  get the output state to be set
00046  A 0662 a4   f8      A           AND   #%11111000 mask off all unused output bits
00047  A 0664 b7   a5      A           STA   TEMP     temp save
00048  A 0666 b1   ae      A           CMP   PLSECPY  compare to previous output status
00049  A 0668 27   10    067a          BEQ   NO_CHG   if equal then no change occurred
00050  A 066a b7   ae      A           STA   PLSECPY  else save as new output status for pulsing
00051  A 066c b1   ae      A           CMP   PLSECPY  read back the pulsed outputs copy
00052  A 066e 26   11    0681          BNE   TOF_RST  if not the same as should be, reset
00053  A 0670 3f   a7      A           CLR   PLSECNT1 reset the pulse counter, force a long pulse
00054  A 0672 b6   02      A           LDA   PORTC    get current PORTC state
00055  A 0674 a4   04      A           AND   #%00000100 mask off all outputs except LRD
00056  A 0676 ba   a5      A           ORA   TEMP     OR with temp saved new state
00057  A 0678 b7   02      A           STA   PORTC    set new output state
00058
00059  A 067a 1f   8e      A NO_CHG    CLR   EDGECNT  reset the edge interrupt flag which...
00060                        *                ... provides handshaking among int.
00061                        ****************************************
00062                        * periodic interrupt counter section    *
00063                        ****************************************
00064
00065  A 067c 3c   8f      A TOF_CNTR  INC   PERIODCNT inc the periodic int. counter
00066  A 067e 07   8f03    0684          BRCLR 3,PERIODCNT,END_TOI if count not reached fail val then ok
00067
00068  A 0681 3f   92      A TOF_RST   CLR   RAMCRC   else clear RAM CRC value and do a...
00069  A 0683 83                        SWI            ... full reset
00070
00071  A 0684 80                END_TOI RTI            end the timer overflow int.
00072
00073                        ****************************************
00074                        * output compare int. handler           *
```

```
M6805 Portable Cross Assembler  0.05  TIMER.ASM  Page 34
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00075                                  ****************************************
00076
00077  A 0685 b6   9b      A OCF_INT   LDA   OCFCNT   get OCF count from previous int.
00078  A 0687 a1   1e      A           CMP   #30      compare to max allowed before disabling
00079  A 0689 25   06    0691          BLO   MORE_OCFS if less then allow more OCF's
00080  A 068b 3d   13      A           TST   TSR      else reset the OCF int.
00081  A 068d 3d   17      A           TST   TCMPLO
00082  A 068f 20   09    069a          BRA   NO_MORE  bypass loading for next OCF
00083
00084  A 0691 be   16      A MORE_OCFS LDX   TCMPHI   get current compare count Hi byte
00085  A 0693 bf   a5      A           STX   TEMP     temp save for later
00086  A 0695 b6   17      A           LDA   TCMPLO   get current compare count LO byte
00087  A 0697 cd   0843    A           JSR   CALC_OCF use contents of A:X and TEMP to calc...
00088                                  *          ... next OCF interrupt
00089
00090  A 069a b6   01      A NO_MORE   LDA   PORTB    freeze current status of PORTB..
00091  A 069c b7   b0      A           STA   TEMPB    ... for use in rollout detection
00092
00093  A 069e cd   0810    A           JSR   PLSE_RLYS go to pulse relays sub.
00094
00095                                  ****************************************
00096                                  * OCF counter section                  *
00097                                  ****************************************
00098
00099  A 06a1 3c   9b      A OCF_CNTR  INC   OCFCNT   inc OCF counter
00100  A 06a3 b6   9b      A           LDA   OCFCNT   get OCF counter
00101  A 06a5 0a   900a    06b2        BRSET PHSESWAP,IFLGS,CHG_READ if xfrmr phased COM to L1 then...
00102                                  *          ... change where to look for pulses
00103  A 06a8 a1   04      A           CMP   #4       else compare to desired count to check...
00104                                  *          ... rollout
00105  A 06aa 27   17    06c3          BEQ   READ_ROLL if equal read rollout
00106  A 06ac a1   0c      A           CMP   #12      else compare to desired input to check...
00107                                  *          ... rollout wiring/line polarity
00108  A 06ae 27   1a    06ca          BEQ   CHK_WIRNG if equal check wiring
00109  A 06b0 20   08    06ba          BRA   INP_CHK  go see if time to check inputs
00110
00111  A 06b2 a1   14      A CHG_READ  CMP   #20      compare to desired count to check
00112                                  *          ... rollout
00113  A 06b4 27   0d    06c3          BEQ   READ_ROLL if equal read rollout
00114  A 06b6 a1   1c      A           CMP   #28      else compare to desired input to check...
00115                                  *          ... rollout wiring/line polarity
00116  A 06b8 27   10    06ca          BEQ   CHK_WIRNG if equal check wiring
00117
00118  A 06ba a1   16      A INP_CHK   CMP   #24      else compare to desired count to read inputs
00119  A 06bc 27   23    06e1          BEQ   READ_INS if equal read inputs
00120  A 06be a1   c8      A           CMP   #200     else compare to max counts without reset
00121  A 06c0 24   bf    0681          BHS   TOF_RST  if expired then reset
00122  A 06c2 80                        RTI            else end OCF int.
00123
00124                                  ****************************************
00125                                  * read ROLLOUT input                   *
00126                                  ****************************************
```

```
09/17/94 59927-2.lst page 18

M6805 Portable Cross Assembler  0.05  TIMER.ASM  Page 35
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00127
00128  A 06c3 b6   b0       A READ_ROLL LDA   TEMPA    get PORTB status
00129  A 06c5 a4   80       A           AND   #%10000000 mask off all unused PORTB inputs
00130  A 06c7 b7   88       A           STA   INPUTS2+TEMPINS save temporarily
00131  A 06c9 80                         RTI             end interrupt
00132
00133                          ****************************************
00134                          * check ROLLOUT wiring/line polarity   *
00135                          ****************************************
00136
00137  A 06ca 02   aa0c  06d9 CHK_WIRNG BRSET BRKNWIRE,LCKFLGS3,WIRE_BRK if wire determined to be broken...
00138                          *                  ... then latch lockout
00139  A 06cd 0e   b00c  06dc           BRSET ROLLOUT2,TEMPB,WIRE_OK else if rollout line pulsing then...
00140                          *                    ... wiring/polarity ok
00141  A 06d0 b6   a9       A           LDA   ROLLCNT  else get failure counter
00142  A 06d2 a1   f0       A           CMP   #240     compare to max pulses lost
00143  A 06d4 24   03   06d9            BHS   WIRE_BRK if exceeded then wiring broke or...
00144                          *                  ... line polarity wrong
00145  A 06d6 3c   a9       A           INC   ROLLCNT  else inc failure counter
00146  A 06d8 80                         RTI             end interrupt
00147
00148  A 06d9 12   aa       A WIRE_BRK  BSET  BRKNWIRE,LCKFLGS3 set ROLLOUT broken wire lockout
00149  A 06db 80                         RTI             end interrupt
00150
00151  A 06dc 11   aa       A WIRE_OK   BCLR  ROLLOCK,LCKFLGS3 reset line polarity check lockout flg
00152  A 06de 3f   a9       A           CLR   ROLLCNT  reset the broken wire failure counter
00153  A 06e0 80                         RTI             end interrupt
00154
00155                          ****************************************
00156                          * read inputs status                   *
00157                          ****************************************
00158
00159  A 06e1 b6   00       A READ_INS LDA   PORTA    get PORTA status
00160  A 06e3 b7   81       A           STA   INPUTS1+TEMPINS save temporarily
00161  A 06e5 b6   02       A           LDA   PORTC    get PORTC status
00162  A 06e7 a4   01       A           AND   #%00000001 mask off all unused PORTC inputs
00163  A 06e9 ba   88       A           ORA   INPUTS2+TEMPINS OR with ROLLOUT status
00164  A 06eb b7   88       A           STA   INPUTS2+TEMPINS save temporarily
00165  A 06ed b6   03       A           LDA   PORTD    get PORTD status
00166  A 06ef a4   20       A           AND   #%00100000 mask off all unused PORTD inputs
00167  A 06f1 ba   88       A           ORA   INPUTS2+TEMPINS OR with ROLLOUT/PORTC inputs
00168  A 06f3 b7   88       A           STA   INPUTS2+TEMPINS save temporarily
00169
00170                          ****************************************
00171                          * flame circuit test                   *
00172                          ****************************************
00173
00174  A 06f5 0d   ba26  071e FL_TST    BRCLR IGNFLG,WFLGS,RST_FTST if not in ignition then do not test circ.
00175  A 06f8 0a   3114  070f           BRSET FTSTPIN,PORTB,OFF_CHK else if flame test pin on do off check
00176  A 06fb 3c   ab       A           INC   FTSTCNT  else inc the test performance counter
00177  A 06fd b6   ab       A           LDA   FTSTCNT  get the counter
00178  A 06ff a1   0f       A           CMP   #15      if less than desired time to indicate...
```

```
M6805 Portable Cross Assembler  0.05  TIMER.ASM  Page 36
 Fri Aug 09 15:30:31 1996
Options - MD,MC,NOG,NOU,W,NOMEX,CL,FMT,O

LINE   S PC   OPCO OPERANDS S LABEL    MNEMO OPERANDS COMMENT
00179  A 0701 25   02   0705           BLO   FL_TST2  ... low flame current level then don't
00180  A 0703 1e   90       A           BSET  SISTAT,IFLGS allow low flame current indication
00181
00182  A 0705 a1   3c       A FL_TST2   CMP   #60      compare to desired test interval time
00183  A 0707 25   19   0722            BLO   FTST_OFF if less do not test yet
00184  A 0709 3f   ab       A           CLR   FTSTCNT  reset flame test performance counter
00185  A 070b 1a   01       A           BSET  FTSTPIN,PORTB turn the flame test pin on
00186  A 070d 20   15   0724            BRA   GET_INS  continue processing inputs
00187
00188  A 070f 12   81       A OFF_CHK   BSET  S1,INPUTS1+TEMPINS set flame sense on in temple since we...
00189                          *                  ... turned it off
00190  A 0711 03   300a 071e            BRCLR S1,PORTA,RST_FTST if flame sense lo then test OK
00191  A 0714 3c   ac       A           INC   FAILCNT  inc the failure count
00192  A 0716 b6   ac       A           LDA   FAILCNT  else get the failure count
00193  A 0718 a1   03       A           CMP   #3       compare to max allowed failures out of tests
00194  A 071a 25   04   0720            BLO   RST_STAT if not exceeded only turn flame test off...
00195                          *                  ... and reset low flame current indicator
00196  A 071c 1c   90       A           BSET  FTSTFL,IFLGS else circuit fails so set failure flag
00197
00198  A 071e 3f   ac       A RST_FTST  CLR   FAILCNT  reset flame test failure counter
00199
00200  A 0720 1f   90       A RST_STAT  BCLR  SISTAT,IFLGS inhibit low flame current indication
00201
00202  A 0722 1b   01       A FTST_OFF  BCLR  FTSTPIN,PORTB restore flame test pin to off
00203
00204  A 0724 ae   86       A GET_INS   LDX   #INPUTS1 load the index register with inputs 1...
00205                          *                                  ... pointer to debounce
00206  A 0726 cd   07e2     A           JSR   DEBOUNCE go debounce the inputs
00207  A 0729 ae   87       A           LDX   #INPUTS2 load the index register with inputs 2...
00208                          *                                  ... pointer to debounce
00209  A 072b cd   07e2     A           JSR   DEBOUNCE go debounce the inputs
00210
00211                          ****************************************
00212                          * Realtime clock section               *
00213                          ****************************************
00214
00215  A 072e 3c   91       A CLOCK     INC   PULSES   increment pulse count
00216  A 0730 b6   91       A           LDA   PULSES   get pulse count
00217  A 0732 a1   0f       A           CMP   #15      compare it to 15 pulses
00218  A 0734 25   04   073a            BLO   FLASH_LED if not equal then go to the flash LED
00219  A 0736 3f   91       A           CLR   PULSES   else 1/4 second has elapsed, clear pulses...
00220  A 0738 12   90       A           BSET  QTRSEC,IFLGS ... and set half second elapsed flag
00221
00222                          ****************************************
00223                          * LED flasher section                  *
00224                          ****************************************
00225
00226  A 073a a6   78       A FLASH_LED LDA   #120     load default off time value
00227  A 073c b7   9d       A           STA   OFFTIME
00228  A 073e a6   0f       A           LDA   #15      load default toggle point value
00229  A 0740 b7   a0       A           STA   TOGGLEVAL
00230  A 0742 be   9e       A           LDX   FLSHTMR  get the current flash timer value
```

```
05/17/96 59527-2.lst page 19

M6805 Portable Cross Assembler  0.05  TIMER.ASM  Page 37
 Fri Aug 09 15:30:31 1996
Options - MD,MC,NOG,NOU,W,NOMEX,CL,FMT,O

LINE   S PC   OPCO OPERANDS S LABEL     MNEMO OPERANDS COMMENT
00231  A 0744 04   b931  0778           BRSET S1LOCK,LCKFLGS2,FLSH_PLSE flash proper code for each lockout
00232  A 0747 02   b9bd  07a7           BRSET ROLLFLG,LCKFLGS2,FLSH_5
00233  A 074a 00   b95e  07ab           BRSET LMTFLG,LCKFLGS2,FLSH_4
00234  A 074d 00   8a47  0797           BRSET POLLOCK,LCKFLGS3,FLSH_9
00235  A 0750 02   aa2f  0782           BRSET BRKNMTRE,LCKFLGS4,FLSH_11
00236  A 0753 0c   b81f  0775           BRSET MVLOCK,LCKFLGS1,STDY_ON
00237  A 0756 0e   b82e  0787           BRSET CONDFLG,LCKFLGS1,FLSH_10
00238  A 0759 0a   b847  07a3           BRSET PSLOCK4,LCKFLGS1,FLSH_6
00239  A 075c 08   b83c  079b           BRSET RECYCFLG,LCKFLGS1,FLSH_8
00240  A 075f 06   b83d  079f           BRSET RETRYFLG,LCKFLGS1,FLSH_7
00241  A 0762 04   b84a  07af           BRSET PSLOCK2,LCKFLGS1,FLSH_3
00242  A 0765 02   b84b  07b3           BRSET PSLOCK1,LCKFLGS1,FLSH_2
00243  A 0768 0a   ba0a  0775           BRSET FLSHLED,WFLGS,STDY_ON
00244  A 076b 0e   9004  077a           BRSET S1STAT,IFLGS,FLAM_STAT
00245
00246  A 076c 15   02       A STDY_OFF BCLR  LED,PORTC turn the LED off steady
00247  A 077c 20   69    07db           BRA  RST_FLASH
00248
00249  A 077e 02   81f9  076e FLAM_STAT BRSET S1,INPUTS1+TEMPINS,STDY_OFF if flame present then keep LED off
00250
00251  A 0775 14   02       A STDY_ON  BSET  LED,PORTC else if fluttering show status
00252  A 0777 80                       RTI             end interrupt
00253
00254  A 0778 a6   3c       A FLSH_PLSE LDA  #60        flash at pulse rate of 1s.on/off
00255  A 077a b7   5d       A          STA   OFFTIME
00256  A 077c b7   a0       A          STA   TOGGLEVAL
00257  A 077e a3   3c       A          CMPX  #60
00258  A 0780 20   37    07b9          BRA   CHK_FLSH go check flash count
00259
00260  A 0782 08   902a  07af FLSH_11  BRSET EXTFLSH,IFLGS,FLSH_3 if extra flash time then do so
00261  A 0785 20   03    078a          BRA   EXT_FLSH else check pre-extra flash count
00262
00263  A 0787 08   9029  07b3 FLSH_10  BRSET EXTFLSH,IFLGS,FLSH_2 if extra flash time then do so
00264
00265  A 078a a3   ff       A EXT_FLSH CMPX  #255      else compare flash count to terminate val
00266  A 078c 26   2b    07b9          BNE   CHK_FLSH if not done then check flash count
00267  A 078e 18   9c       A          BSET  EXTFLSH,IFLGS else set extra flash flag
00268  A 0790 5f                       CLRX            clear index reg.
00269  A 0791 3f   9e       A          CLR   FLSHTMR  reset the flash counter
00270  A 0793 3f   9f       A          CLR   TOGGLEPNT reset toggle point counter
00271  A 0795 20   20    07b7          BRA   FLSH_1
00272
00273  A 0797 a3   ff       A FLSH_9   CMPX  #255      compare flash count to terminate value
00274  A 0799 20   1e    07b9          BRA   CHK_FLSH go check flash count
00275
00276  A 079b a3   e1       A FLSH_8   CMPX  #225      compare flash count to terminate value
00277  A 079d 20   1a    07b9          BRA   CHK_FLSH go check flash count
00278
00279  A 079f a3   c3       A FLSH_7   CMPX  #195      compare flash count to terminate value
00280  A 07a1 20   16    07b9          BRA   CHK_FLSH go check flash count
00281
00282  A 07a3 a3   a5       A FLSH_6   CMPX  #165      compare flash count to terminate value
```

```
M6805 Portable Cross Assembler  0.05  TIMER.ASM  Page 38
 Fri Aug 09 15:30:31 1996
Options - MD,MC,NOG,NOU,W,NOMEX,CL,FMT,O

LINE   S PC   OPCO OPERANDS S LABEL     MNEMO OPERANDS COMMENT
00283  A 07a5 20   12    07b9          BRA   CHK_FLSH go check flash count
00284
00285  A 07a7 a3   87       A FLSH_5   CMPX  #135      compare flash count to terminate value
00286  A 07a9 20   0e    07b9          BRA   CHK_FLSH go check flash count
00287
00288  A 07ab a3   69       A FLSH_4   CMPX  #105      compare flash count to terminate value
00289  A 07ad 20   0a    07b9          BRA   CHK_FLSH go check flash count
00290
00291  A 07af a3   4b       A FLSH_3   CMPX  #75       compare flash count to terminate value
00292  A 07b1 20   06    07b9          BRA   CHK_FLSH go check flash count
00293
00294  A 07b3 a3   2d       A FLSH_2   CMPX  #45       compare flash count to terminate value
00295  A 07b5 20   02    07b9          BRA   CHK_FLSH go check flash count
00296
00297  A 07b7 a3   0f       A FLSH_1   CMPX  #15       compare flash count to terminate value
00298
00299  A 07b9 24   15    07d0 CHK_FLSH BHS   LED_OFF  if higher or equal 1: is LED off time
00300  A 07bb b3   9f       A          CMPX  TOGGLEPNT else check if toggle point
00301  A 07bd 25   0c    07cb          BLO   INC_FLSH if less then do not toggle
00302  A 07bf b6   9f       A          LDA   TOGGLEPNT else setup next toggle point and toggle LED
00303  A 07c1 bb   a0       A          ADD   TOGGLEVAL
00304  A 07c3 b7   5f       A          STA   TOGGLEPNT
00305  A 07c5 b6   02       A          LDA   PORTC    get PORTA status
00306  A 07c7 a8   04       A          EOR   #%00000100 toggle LED state
00307  A 07c9 b7   02       A          STA   PORTC    save as new PORTA status
00308
00309  A 07cb 3c   9e       A INC_FLSH INC   FLSHTMR  inc the flash counter
00310  A 07cd 3f   9c       A          CLR   OFFTMR   reset the off timer
00311  A 07cf 80                       RTI            end interrupt
00312
00313  A 07d0 b6   9c       A LED_OFF  LDA   OFFTMR   get the off timer
00314  A 07d2 b1   9d       A          CMP   OFFTIME  compare to desired off time
00315  A 07d4 24   05    07db          BHS   RST_FLASH if done reset flash count
00316  A 07d6 3c   9c       A          INC   OFFTMR   else inc timer
00317  A 07d8 15   02       A          BCLR  LED,PORTC turn LED off
00318  A 07da 80                       RTI            end interrupt
00319
00320  A 07db 3f   9e       A RST_FLASH CLR  FLSHTMR  reset the flash counter
00321  A 07dd 3f   9f       A          CLR   TOGGLEPNT reset the toggle point counter
00322  A 07df 19   90       A          BCLR  EXTFLSH,IFLGS reset the extra flash counter
00323  A 07e1 80                       RTI            end interrupt
00324
00325                          ****************************************
00326                          * debounce inputs subroutine           *
00327                          ****************************************
00328
00329  A 07e2 e601            DEBOUNCE LDA  TEMPINS,X get temporary inputs
00330  A 07e4 e102                     CMP   LASTIN1,X current inputs = last inputs
00331  A 07e6 26   07    07ef          BNE   NEWIN1   if not go to new input routine 1
00332  A 07e8 6a04                     DEC   CYCLEFT,X else decrement the number of cycles left...
00333                                                  ... to consider the input debounced
00334  A 07ea 26   23    080f          BNE   END_DBNCE if not = 0 then go end debounce sub.
```

```
09/17/96 59527-2.1st page 20

M6805 Portable Cross Assembler  0.05  TIMER.ASM  Page 39
 Fri Aug 09 15:30:31 1996
Options - MD,MC,NOG,NOU,W,NOMEX,CL,FMT,O

LINE   S PC   OPCO OPERANDS S LABEL     MNEMO OPERANDS COMMENT
00335  A 07ec f7                        STA   INPUTS,X else save as debounced valid inputs
00336  A 07ed 20   14    0803           BRA   RST_WIN  go reset the input window
00337
00338  A 07ef 6a05            NEWIN1    DEC   NEWCNT,X decrement the new inputs counter
00339  A 07f1 27   15    0803           BEQ   RST_WIN  if = 0 then go reset the input window...
00340                         *                                  ... too many bad reads have occurred
00341  A 07f3 e103                      CMP   LASTIN2,X else are these the same as the previous...
00342                         *                                  ... last inputs
00343  A 07f5 26   08    07ff           BNE   NEWIN2   if not then go to new inputs routine 2
00344  A 07f7 6a06                      DEC   NEWSAME,X else decrement the newsame counter
00345  A 07f9 26   14    080f           BNE   END_DBNCE if not = 0 then go end dbounce sub.
00346  A 07fb e702                      STA   LASTIN1,X else save these inputs as the new last input
00347  A 07fd 20   04    0803           BRA   RST_WIN  go reset the input window
00348
00349  A 07ff e703            NEWIN2    STA   LASTIN2,X save this input as new input to check for...
00350                         *                                  ... consecutive reads
00351  A 0801 20   08    080b           BRA   LDNWSAME go load consecutive read counter
00352
00353  A 0803 a6   1a       A RST_WIN   LDA   #GOODREADS re-load cycles left till valid read counter
00354  A 0805 e704                      STA   CYCLEFT,X
00355  A 0807 a6   0c       A           LDA   #BADREADS re-load number of bad reads allowed...
00356  A 0809 e705                      STA   NEWCNT,X ... before sliding read window
00357
00358  A 080b a6   04       A LDNWSAME  LDA   #CONCNT  re-load number of consecutive reads till...
00359  A 080d e706                      STA   NEWSAME,X ... saving as new input value
00360
00361  A 080f 81              END_DBNCE RTS            end debounce inputs subroutine
00362
00363                         ****************************************
00364                         * pulsed relays pulsing subroutine     *
00365                         ****************************************
00366
00367  A 0810 b6   ae       A PLSE_RLYS LDA   PLSECPY  get copy of outputs to pulse
00368  A 0812 a4   f8       A           AND   #%11111000 mask off all unused output bits
00369  A 0814 b7   a5       A           STA   TEMP     temp save
00370  A 0816 3c   a7       A           INC   PLSECNT1 inc the pulse counter
00371  A 0818 b6   a7       A           LDA   PLSECNT1 get the pulse counter
00372  A 081a a1   20       A           CMP   #32      compare to desired boost pulse
00373  A 081c 25   0d    082b           BLO   LD_MASK  if les reload pulse mask
00374  A 081e b6   a5       A           LDA   TEMP     else get temp saved pulsed outputs
00375  A 0820 b4   af       A           AND   PLSEMASK pulse according to pulse mask
00376  A 0822 b7   a5       A           STA   TEMP     temp save
00377  A 0824 b6   af       A           LDA   PLSEMASK get pulse mask
00378  A 0826 48                        LSLA           shift pulse mask
00379  A 0827 a1   6c       A           CMP   #%01100000 check if mask needs to be reloaded
00380  A 0829 26   02    082d           BNE   SAV_MASK if not then save shifted mask
00381
00382  A 082b a6   6c       A LD_MASK   LDA   #%01101100 else reload pulse mask
00383
00384  A 082d b7   af       A SAV_MASK  STA   PLSEMASK
00385  A 0831 a4   04       A           LDA   PORTC    get current PORTC state
00386  A 0831 a4   04       A           AND   #%00000100 mask off all outputs except LED
```

```
M6805 Portable Cross Assembler  0.05  TIMER.ASM  Page 40
 Fri Aug 09 15:30:31 1996
Options - MD,MC,NOG,NOU,W,NOMEX,CL,FMT,O

LINE   S PC   OPCO OPERANDS S LABEL     MNEMO OPERANDS COMMENT
00387  A 0833 ba   a5       A           ORA   TEMP     OR with temp saved new state
00388  A 0835 b7   02       A           STA   PORTC    set new output state
00389  A 0837 81                        RTS
00098
00099  A 0838      0838     A ZZROMEND EQU   *        log end of system ROM
00100
00101  A 0838      c8       A           DCB   ROMEND **1,$83 fill remaining ROM locations with SWI's
00102
00103                         ****************************************************************************
00104                         ****************                                             *****************
00105                         ****************                VECTORS SECTION              *****************
00106                         ****************                                             *****************
00107                         ****************************************************************************
00108
00109  A 0900                           ORG   MOR
00110
00111  A 0900      01       A           FCB   $01      enable COP
00112
00113  A 1ff8                           ORG   VECTORS
00114
00115  A 1ff8      0651     A           FDB   TIMERV   timer vector
00116  A 1ffa      0570     A           FDB   IRQV     interrupt request vector
00117  A 1ffc      0100     A           FDB   RESETV   software interrupt vector
00118  A 1ffe      0100     A           FDB   RESETV   reset interrupt vector
00119
00120  A 2000      0063     A ZZRAMLGTH EQU  ZZRAMEND ZZRAMBEG calc length of system RAM
00121  A 2000      0029     A ZZAUXLGTH EQU  ZZAUXEND-ZZAUXBEG calc length of system AUXROM
00122  A 2000      0738     A ZZROMLGTH EQU  ZZROMEND-ZZROMBEG calc length of system ROM
00123  A 2000      001c     A ZZRAMLEFT EQU  RAMEND-ZZRAMEND calc amount of unused system RAM
00124  A 2000      0006     A ZZAUXLEFT EQU  AUXROMEND-ZZAUXEND calc amount of unused system AUXROM
00125  A 2000      00c7     A ZZROMLEFT EQU  ROMEND-ZZROMEND calc amount of unused system ROM
00126
00127                            END


Total number of errors: 0
Total number of warnings: 0
Total number of lines: 2168


Number of bytes in section ASCT: 2204

Number of bytes in program: 2204

          CROSS REFERENCE TABLE
NAME    ATTRB S VALUE P:LINE LINE1....N

ALTCNTH1 EQU  A 001a  3:64          31
ALTCNTLO EQU  A 001b  3:65          32
AUXROM   EQU  A 0020  3:71          61
AUXROMEN EQU  A 0b4f  3:72          71  124
```

```
09/17/96 59527-2.lst page 21

M6805 Portable Cross Assembler  0.05      Page 41
 Fri Aug 09 15:30:31 1996

            CROSS REFERENCE TABLE
NAME     ATTRB S VALUE P:LINE LINE1....N

BADREADS EQU  A 000c  4:24          127  355
BITCNT        A 00d8  9:106          50   63
BRKNWIRE EQU  A 0001  6:138         172  137  148  235
CALC_CSU      A 0559 28:66           60
CAL_OK        A 059f 29:59           50
CFAN     EQU  A 0003  5:98          217  260  609
CFAN_OFF      A 0309 15:257          241
CFDLYOFF      A 00c2  8:75           244  257  259
CHG_READ      A 06b2  2:111          101
CHK_CFAN      A 04bf 26:609          595
CHK_FAIL      A 0141 11:43            27   32   36
CHK_FLSH      A 07b9  6:295          258  266  274  277  280  283  286  289  292  295
CHK_FSTA      A 041a 23:466          462
CHK_G         A 02df 18:205
CHK_HFAN      A 04b0 25:595
CHK_HIX       A 0182 12:102
CHK_IDOF      A 035f 20:335
CHK_ILOK      A 0311 19:272
CHK_ITMR      A 0314 19:274
CHK_ROM       A 0187 12:110           95
CHK_W         A 0330 20:296          272
CHK_WIRN      A 06ca  3:137          108  116
CHK_Y         A 02f4 18:231          215  218
CLOCK         A 072e  4:225
CLR_FLGS      A 0480 25:552          547
CNT_OK   EQU  A 05c2 30:91            87
CONCNT   EQU  A 0004  4:28           130  358
CONDFLG  EQU  A 0007  5:117           99  105  237
CONDSNSE EQU  A 0000  5:77            86
CONDTMR1      A 0006  8:95            87   90  103
CONDTMR2      A 0007  8:96            94   96   98
COND_CHK      A 0250 16:86
COND_OK       A 0251 16:96            86
CONT_CSU      A 055f 28:70            77
CONT_LOC      A 032e 20:290          277
COOL_CTR EQU  A 02df 18:199          188
COPY_IN       A 0242 15:68
CRC_FAIL EQU  A 01d7 13:76            71
CRC_GEN2      A 01af 13:53            64
CRC_GEN3      A 01c1 13:63            55
CSUMEND  EQU  A 00d8  8:97            76
CSUMSTRT EQU  A 00b1  8:59            68
CYCLEPT  EQU  A 0004  4:53           134  135  332  354
DATA_OUT      A 05fe 31:142          139
DCOL     EQU  A 0006  3:37
DDRA     EQU  A 0004  2:26            51   20
DDRASET  EQU  A 0000  6:162
DDRB     EQU  A 0005  2:27            52   23
DDRBSET  EQU  A 0020  6:163           22
DDRC     EQU  A 0006  2:28            54   25
DDRCSET  EQU  A 001c  6:164           24
DDRD     EQU  A 0007  2:29            56   26   44   60
```

```
M6805 Portable Cross Assembler  0.05      Page 42
 Fri Aug 09 15:30:31 1996

            CROSS REFERENCE TABLE
NAME     ATTRB S VALUE P:LINE LINE1....N

DDRDSET  EQU  A 0000  6:165
DEBOUNCE      A 07e2  6:329          206  209
DEC_MSB       A 0493 25:568          564
DEC_MSH1      A 031c 19:279          275
DLYJMP1  EQU  A 0005  5:110          111   42   44   45   60
DLYJMP2  EQU  A 0007  5:109           43   46
DOGTMR1       A 0098  7:31            29   33
DOGTMR2       A 0099  7:32            30   36
DOGTMR3       A 009a  7:33            31   39   40
EDGECNT       A 008e  7:21            86   87   59
EDGE_CNT      A 05ba 30:86
END_CHK  EQU  A 0144 11:45            41
END_DBNC      A 080f  7:361          334  345
END_SAFE      A 0517 27:676          671
END_TOI       A 0684  1:71            66
END_XFER      A 0605 31:147          186
EXTFLSH  EQU  A 0004  4:37           260  263  267  322
EXT_FLSH      A 078a  5:265          261
EXT_HSI       A 04bb 24:515          498
FAILCNT       A 00ac  7:48           191  192  198
FAN_SW   EQU  A 04b0 25:589          166  174  191  578  581
FLAM_STA      A 0772  5:249          244
FLASH_LE      A 073a  4:226          218
FLSHLED  EQU  A 0005  6:153          432  448  243
FLSHTMR       A 009e  7:37           230  269  309  320
FLSH_1        A 07b7  6:297          271
FLSH_10       A 0787  5:263          237
FLSH_11       A 0782  5:260          235
FLSH_2        A 07b3  6:294          242  263
FLSH_3        A 07af  6:291          241  260
FLSH_4        A 07ab  6:288          233
FLSH_5        A 07a7  6:285          232
FLSH_6        A 07a3  5:282          238
FLSH_7        A 079f  5:279          240
FLSH_8        A 079b  5:276          239
FLSH_9        A 0797  5:273          234
FLSH_PLS      A 0778  5:254          231
FL_TST        A 0615  3:174
FL_TST2       A 0705  4:182          179
FSFAILTM      A 00d4  8:93           458  461  464  654
FSTABFLG EQU  A 0000  6:156          434  454
FSTABTMR      A 00d3  8:92           466  469  655
FSTAB_PE      A 0404 23:454          434
FTSTCNT       A 00ab  7:47           176  177  184
FTSTFL   EQU  A 0006  4:35           478  656  196
FTSTPIN  EQU  A 0005  5:87           175  185  202
FTST_OFF      A 0722  4:202          183
FULL_INI EQU  A 0117 10:41            30   33   34
G        EQU  A 0006  5:71           205
GEN_CRC       A 019e 13:44            32
GEN_CRC1      A 0182 13:46            67
GET_INS       A 0724  4:204          186
```

09/17/96 59527 2.lst page 22

M6805 Portable Cross Assembler 0.05 Page 43
Fri Aug 09 15:30:31 1996

CROSS REFERENCE TABLE

```
NAME      ATTRB S VALUE P:LINE LINE1....N

GFAN_ON         A 02ec 18:217        213
GONTMR          A 00c7  8:80         211  214  224
GOODREAD  EQU   A 001a  4:26         133  353
GO_RESET        A 01d8 13:118         42   64   66   70  303  643
G_OFF           A 0210 18:224        205
HFAN      EQU   A 0004  5:96         562  575  580  595  683
HFAN_DLY        A 0488 25:562        543  550  553
HFAN_ON1        A 042e 23:481        470
HFAN_ON2        A 049d 25:574        562  566
HFDLYFX         A 00c1  8:74         684   59
HFDLYOFF        A 00bf  8:73         563  565  568  570  572  685  686
HFDLYON         A 00be  8:72         576  579  583  666
HIPLSE    EQU   A 0000  4:41          73  102
HI_WAIT         A 0164 12:86         97  100
HI_WAIT1        A 0178 12:97         87
HSI       EQU   A 0005  5:95         400  444  455  123
ICF       EQU   A 0007  3:53
ICIE      EQU   A 0007  3:48
IDFAN     EQU   A 0006  5:94         342  345  542  545  670
IDFAN_OF        A 0473 24:545        540
IDOFFTMR        A 00d0  8:89         546  548  556  674
IEDG      EQU   A 0001  3:44
IFAN_CTR  EQU   A 0469 24:531        321  336  347  351  377  380  394  405  441  482  517
IFLGS           A 0090  7:25          34   73  102  140   47   53  478  656   59   62   97  119  122  101  180  196  200  220  2
44
                                     260  261  267  322
IGNFLG    EQU   A 0001  6:155        456  476  174
IGNITE          A 03e5 22:432        424
IGN_CTRL  EQU   A 0311 19:266        245  258
IGN_DONE        A 0424 23:476        456  468
IGN_PROG        A 03ff 22:443        438
ILOCK     EQU   A 0000  6:124        272  302  527
ILOCKTMR        A 00bc  8:71         274  276  279  286  288  524  525
INCOPY1         A 00b1  8:60          72   86  111  112  118  127  147  182  205  296  344  353  419  447  457  479
INCOPY2         A 00b2  8:61          74  149  231
INC_FLSH        A 07cb  6:309        301
INC_FS1         A 039e 21:370        358
INC_RETR        A 0312 22:440        447
INC_T2          A 0220 15:36
INC_T3          A 0224 15:39
INC_X           A 0568 28:75          73
INITDONE  EQU   A 0002  4:39          34  140
INPUTS    EQU   A 0000  4:49          79  335
INPUTS1         A 0080  7:19         126  128  131  134   71  120  160  188  204  249
INPUTS2         A 0087  7:20         129  132  135   73  103  113  130  163  164  167  168  207
INP_CHK         A 06ba  2:118        109
IO_STRT         A 060a 31:151        151
IRQV            A 0570 29:24         116
IRQV1           A 0573 29:31          24
I_LOCK          A 0467 24:527
I_LOCK1         A 0461 24:523        368  493  509
JMP_STRT        A 04e0 26:642        639
LASTIN1   EQU   A 0002  4:51         330  346
```

M6805 Portable Cross Assembler 0.05 Page 44
Fri Aug 09 15:30:31 1996

CROSS REFERENCE TABLE

```
NAME      ATTRB S VALUE P:LINE LINE1....N

LASTIN2   EQU   A 0003  4:52         341  349
LCKFLGS1        A 00b8  8:67          95  105  180  190  272  302  308  310  346  350  364  467  379  383  492  508  527  236  2
37
                                     238  239  240  241  242
LCKFLGS2        A 00b9  8:68         114  120  134  139  145  157  231  232  233
LCKFLGS3        A 00aa  7:46         104  164  172  137  148  151  234  235
LDNWSAME        A 080b  7:358        351
LD_MASK         A 082b  7:382        373
LED       EQU   A 0002  5:100         55  246  251  317
LED_OFF         A 07d0  6:313        299
LIMIT     EQU   A 0004  5:73         112  118
LMTFLG    EQU   A 0000  6:132        114  120  233
LMT_CHK         A 0272 16:111        101
LMT_CHK1        A 027f 16:118        111
LMT_FAIL        A 0278 16:114        118
LMT_OK          A 0282 16:120        112
LO_WAIT         A 0148 11:70          74   77   92
LO_WAIT2        A 014e 11:73
MAIN_LOO        A 0233 15:53
MEM_CHK         A 0237 15:60
MFG_TST         A 05e3 31:122        115
MOR       EQU   A 0090  3:80         109
MORE_OCF        A 0691  2:84          79
MSTR      EQU   A 0004  2:33
MV        EQU   A 0007  5:93         126  181  411
MVIN      EQU   A 0002  5:75         182  419
MVLOCK    EQU   A 0006  5:118        180  190  236
MVSAG     EQU   A 0003  6:154        355  435  443
MVTMR1          A 00c4  8:77         184  187  193
MVTMR3          A 00c5  8:78         420  423  426  651
MV_LCK1         A 02d8 18:190        180  186
MV_ON           A 03d0 22:411        403
MV_TST1         A 02c5 17:180        172
MV_TST3         A 03d6 22:419
NEWCNT    EQU   A 0005  4:54         128  129  338  356
NEWIN1          A 07ef  7:338        331
NEWIN2          A 07fc  7:349        343
NEWSAME   EQU   A 0006  4:56         131  132  344  359
NO_CHG          A 067a  1:59          49
NO_FAIL         A 01db 14:125         74
NO_FRCE   EQU   A 034d 20:316
NO_HARD         A 0339 20:305        302
NO_MORE         A 069a  2:90          82
NO_PRGE         A 032a 19:286        282
NO_RST          A 034d 20:318
NO_TEST         A 05e0 31:119        101  107  112
NXT_BYTE        A 0188 12:27          31
OCF       EQU   A 0006  3:52          27
OCFCNT          A 009b  7:34          79   77   99  106
OCF_CNTR        A 0681  2:95
OCF_INT         A 0686  2:77          27
OCIE      EQU   A 0006  3:47
OFFTIME         A 009d  7:36         227  255  314
```

09/17/96 59527-2.lst page 23

M6805 Portable Cross Assembler 0.05 Page 45
Fri Aug 09 15:30:31 1996

CROSS REFERENCE TABLE

```
NAME     ATTRB S VALUE P:LINE LINE1....N

OFFTMR         A 009c  7:35        310  313  316
OFF_CHK        A 070f  4:188       175
OLVL     EQU   A 0000  3:43
OUTVOFF        A 00b4  8:63        149  126  181  596  601  610  617  621  623  637  638   45
OUTREQ         A 00b3  8:62         64   69  217  260  342  385  403  411  444  455  542  545  562  575  580  595  598  609  6
12
                                   614  625  628  630  636  667  670  683
OUT_DATA       A 04de 26:636       615
P7RAM    EQU   A 0080  3:68         76
P7ROM    EQU   A 0100  3:69         77
P7VCTRS  EQU   A 1ff8  3:73         79
P9MOR    EQU   A 0900  3:70         80
PA_CHK1        A 060d 31:154       159
PA_CHK2        A 061c 31:168       173
PC1      EQU   A 0001  5:101        94
PC_CHK1        A 061a 31:163
PERIODCN       A 008f  7:23         54   65   66
PET_DOG        A 0535 28:34         22   70   86   51  153  131  149  161  175  182
PHSESWAP EQU   A 0005  4:36         59   62  101
PH_LCK1        A 0185 12:104
PLSECNT1       A 00a7  7:43         53  370  371
PLSECNT2       A 00a8  7:44
PLSECPY        A 00ae  7:50         48   50   51  367
PLSEMASK       A 00af  7:51        375  377  384
PLSE_RLY       A 0810  7:367        80   93
PNCPY          A 0022  9:20        137
POLCNT         A 00b5  8:64         89   90
POLLOCK  EQU   A 0000  6:139        104  164  151  234
POLTMR         A 00b6  8:65         76   77   84   88   99  100
POL_CHK        A 02b6 17:164       152  155
POL_OK         A 0174 12:94         82  102
PORTA    EQU   A 0000  2:20         47   71   87  154  168  159  190
PORTB    EQU   A 0001  2:21         48   60  125   90  175  185  202
PORTC    EQU   A 0002  2:22         49   55   94  147  150  123  151  164  178   54   57  161  246  251  305  307  317  385  3
88
PORTD    EQU   A 0003  2:23         50   42   43   45   46  107  165
POSTTMR        A 00cf  8:88        284  413  539  542  664
POWER    EQU   A 0004  5:97        601  614  617  621  630
PREP_REA       A 05b2 30:77
PRETMR         A 00cc  8:85        390  393  513  649
PREVAL         A 00cb  8:84        137  312  391  496  512
PREVCAL        A 0096  7:30         35   38   69   70
PREVCSUM       A 00a3  7:41         26   27   62   65
PRE_PRGE       A 03b8 21:390       371
PRTL_INI       A 01fb 14:146        35
PS       EQU   A 0003  5:74        344  353
PSFLCNT        A 00ca  8:83        307  360  363
PSFLGS         A 00bb  8:70        335  343  349  354  359  382  552  671  672
PSLOCK1  EQU   A 0001  6:123       346  350  242
PSLOCK2  EQU   A 0002  6:122       364  379  383  241
PSLOCK3  EQU   A 0005  5:119       367  238
PSOK     EQU   A 0001  6:146       354  359  382
PSTMR          A 00c9  8:82        356  370  373  376  384  648
PS_LCK2        A 03ad 21:379       375
```

M6805 Portable Cross Assembler 0.05 Page 46
Fri Aug 09 15:30:31 1996

CROSS REFERENCE TABLE

```
NAME     ATTRB S VALUE P:LINE LINE1....N

PS_LCK3        A 0399 21:367       362
PS_MON         A 037b 21:353       343
PS_MON1        A 03a2 21:373       354
PS_OK          A 03b2 21:382       353  355
PS_TST         A 0365 21:342       335
PS_TST1        A 0374 21:349       344
PULSES         A 0091  7:26        215  216  219
PWR_CHK1       A 04ba 26:601       596
PWR_CHK2       A 04cb 26:617       610
PWR_OFF        A 04dc 26:630       626
PWR_ON         A 04c7 26:614       599
QTRSEC   EQU   A 0001  4:40         47   53  220
RAM      EQU   A 0080  3:76         40   22
RAMCRC         A 0092  7:27         28   31   44   45   47   48   53   54   57   58   60   61   70   73  118   88  140   68
RAMEND   EQU   A 00ff  3:74        123
RAM_CHK        A 012d 11:24         39
RAM_IMG        A 0194 13:34         27
RAM_IMG1       A 019d 13:38         36
RD_JMPRS       A 053a 28:42         21  574
READ_INS       A 06e1  3:159       119
READ_ROL       A 06c3  3:128       105  113
RECYCCNT       A 00d5  8:94        306  504  505
RECYCFLG EQU   A 0004  5:120       508  239
RECYCLK        A 0448 24:504       478  479
RECYC_1        A 0454 24:511       365  507
REQ_HFAN       A 051a 27:683       481  668
RESETV         A 0100 10:20        117  118
RETRY          A 0433 23:488       422  446  460
RETRYCNT       A 00d2  8:91        305  477  488  489
RETRYFLG EQU   A 0003  6:121       492  240
RETRYTMR       A 00d1  8:90        436  440  652
RETRY_1        A 043f 23:495       491
RMRSEND  EQU   A 00e3  9:108
ROLL1_CH       A 029f 17:145       132  136
ROLL2_CH       A 02bc 17:172       164
ROLLCNT        A 00a9  7:45        141  145  152
ROLLFLG  EQU   A 0001  6:131       145  157  232
ROLLOUT1 EQU   A 0005  5:72        147
ROLLOUT2 EQU   A 0007  5:86        149   60  139
ROLLTMR        A 00b7  8:66        151  154  155
ROLL_FAI       A 02ac 17:154       149
ROLL_LCK       A 02b1 17:157       145  147
ROM      EQU   A 0100  3:77         79   34
ROMCRC         A 0020  9:16         29   32   69   72
ROMEND   EQU   A 08ff  3:75        101  125
ROMWRAP  EQU   A 0009  3:78         66
RROMBYTE       A 00d9  9:107        28   35   37   46   65
RST_COND       A 0290 16:105        91
RST_FLAS       A 07db  6:320       247  315
RST_FSFL       A 0418 23:464       457
RST_FTST       A 071e  4:198       174  190
RST_HFON       A 04a8 25:583       569
```

09/17/96 59527-2.lst page 24

```
M6805 Portable Cross Assembler  0.05      Page 47
 Fri Aug 09 15:30:31 1996

            CROSS REFERENCE TABLE
NAME     ATTRB S VALUE P:LINE LINE1....N

RST_IDOF        A 0484 25:555        545
RST_RDYS        A 04d0 26:621        609
RST_S1LK        A 029b 17:138        126  127
RST_STAT        A 0720  4:200        194
RST_TMR1        A 0206 16:103         97
RST_TMR2        A 025d 16:93          89
RST_TST         A 0162 12:84          7:
RST_VLK1        A 02dd 18:193        181  182
RST_VLK3        A 04e3 22:426        419
RST_WIN         A 0803  7:353        336  339  347
RST_WTMR        A 04cc 26:648        320  497  511
RTCLOCK         A 0094  7:29          51   52   64   65  209  212
S1        EQU   A 0001  5:76          71   79   87  127  447  457  479  188  190  249
S1LOCK    EQU   A 0002  6:130        134  139  231
S1STAT    EQU   A 0007  4:34         180  200  244
S1TMR           A 00c3  8:76          81  128  131  138
S1_LCK          A 0294 17:134        130
S1_TST          A 0284 16:126        116
SAFE_A          A 04ff 27:663        115  135  358  173
SAFE_B          A 050c 27:670        100
SAFTY_OV  EQU   A 0250 15:80
SAV_CAL         A 05a6 29:64          54   57   60
SAV_MASK        A 082d  7:384        380
SAV_PREV        A 05aa 30:67
SAV_VAL         A 0555 28:59          49   52   55
SCR       EQU   A 000a  2:32          21  129  147
SDR       EQU   A 000c  3:40         142
SERCLK    EQU   A 0007  5:83          86  125
SERIAL_X        A 05f3 31:135        145
SERIN     EQU   A 0006  5:84
SEROUT    EQU   A 0005  5:85          87
SET_120         A 054b 28:51          42
SET_180         A 0547 28:48
SET_60          A 0553 28:57          46
SET_90          A 054f 28:54          43
SOFF_POF        A 04da 26:628        601  619  621  623
SON_POFF        A 04d6 26:625        603  617
SPD_CHK1        A 04d3 26:623
SPE       EQU   A 0006  2:34
SPEED     EQU   A 0003  5:99         590  598  610  612  623  625  628
SPIF      EQU   A 0007  3:38         144
SPI_SYNC        A 05e7 31:125        125
SSR       EQU   A 000b  3:36         144
START_1         A 020f 14:21         642
START_2         A 021c 15:33          47
START_3         A 022c 15:44          34   37
STDY_OFF        A 076e  5:246        249
STDY_ON         A 0775  5:251        236  243
SYS_FRES        A 0523 27:20         146   45
T1DONE    EQU   A 0000  6:147        343  349  671
TCAP      EQU   A 0007  5:108
TCAPHI    EQU   A 0014  3:55
```

```
M6805 Portable Cross Assembler  0.05      Page 48
 Fri Aug 09 15:30:31 1996

            CROSS REFERENCE TABLE
NAME     ATTRB S VALUE P:LINE LINE1....N

TCAPLO    EQU   A 0015  3:56          29
TCMPHI    EQU   A 0016  3:58         213   84
TCMPLO    EQU   A 0017  3:59         215   81   86
TCNTHI    EQU   A 0018  3:61
TCNTLO    EQU   A 0019  3:62          69   75   98   39
TCR       EQU   A 0012  3:42         152   28   31
TEMP            A 00a5  7:42          33   34   37   67   68  211   47   56   85  369  374  376  387
TEMPB           A 00b0  8:52          91  128  139
TEMPCSUM        A 00a1  7:40          66   67   70   72   74   78
TEMPINS   EQU   A 0001  4:50         130  160  163  164  167  168  188  249  329
TESTDONE  EQU   A 0003  4:38          97  119  122
TESTMODE  EQU   A 0005  5:111        103  107
TEST_DON  EQU   A 05e0 30:117         97
TIMERV          A 0651  1:27         115
TOF       EQU   A 0005  3:51          74   97   28
TOF_CNTR        A 067c  1:65
TOF_INT         A 065e  1:39          28
TOF_RST         A 0681  1:68          52  121
TOGGLEPN        A 009f  7:38         270  300  302  304  321
TOGGLEVA        A 00a0  7:39         229  256  303
TOIE      EQU   A 0005  3:46
TSR       EQU   A 0013  3:50          68   74   97  214   27   28   80
TSTTMR          A 00ad  7:45          98  102
TST_CHK         A 05c2 30:97
TST_CHK1        A 05d1 30:107        103
TST_FAIL        A 01d7 13:116         43
UNTSTD    EQU   A 0002  6:145        335  672
VECTORS   EQU   A 1ff8  3:79         113
W         EQU   A 0007  5:70         111  296
WARMTMR         A 00ce  8:87         401  404  650
WARMVAL         A 00cd  8:86         139  314  402  516
WARM_UP         A 03c3 22:400        392
WDOG      EQU   A 1ff0  3:67          35
WFLGS           A 00ba  8:69         355  432  434  435  443  448  454  456  476  653  174  243
WIRE_BRK        A 06d9  3:148        137  143
WIRE_OK         A 06dc  3:151        139
WONTMR          A 00c6  8:75         290  318  327  330  549  676
W_OFF           A 0333 20:302        280
W_OFF1          A 034f 20:320        331
W_ON            A 0355 20:327        296
W_ON1     EQU   A 035f 20:333        329
XFER_I          A 0600 31:144        144
Y         EQU   A 0000  5:102        231  151
YFAN_ON         A 0301 19:243        239
YONTMR          A 00c8  8:81         237  240  251
Y_OFF           A 0307 19:251        225  231
ZZAUXBEG  EQU   A 0020  9:63         121
ZZAUXEND  EQU   A 0049  9:69         121  124
ZZAUXLEF  EQU   A 0006  8:124
ZZAUXLGT  EQU   A 0029  8:121
ZZRAMBEG  EQU   A 0080  7:48         120
ZZRAMEND  EQU   A 00e3  9:52         120  123
```

```
09/17/96 59527-2.lst page 25

M6805 Portable Cross Assembler  0.05      Page 49
 Fri Aug 09 15:30:43 1996

            CROSS REFERENCE TABLE
NAME     ATTRB S VALUE P:LINE LINE1....N

ZZRAMLEF EQU  A 001c  8:123
ZZRAMLGT EQU  A 0063  8:120
ZZRCMBEQ EQU  A 0100 10:87          122
ZZROMEND EQU  A 0838  8:99          122  125
ZZROMLEF EQU  A 03c7  8:125
ZZROMLGT EQU  A 0738  8:122
```

What is claimed:

1. Control apparatus for use in a furnace comprising:

a microcontroller having input and output parts, an AC voltage source and a DC voltage source, an elongated, electrically conductive flame roll-out sensing member forming a loop around a selected area of said furnace and having first and second terminals, a first roll-out flame capacitor and resistor connected between the AC voltage source and the first terminal of the sensing member, a roll-out flame change of state device having an input and an output, the output connected to an input port of the microcontroller, a second roll-out flame capacitor connected between the input of the change of state device and earth ground, resistor means forming a voltage divider having a junction, the junction connected to the input of the change of state device, the voltage divider connected between the DC voltage source and the second terminal of the sensing member, the second roll-out flame capacitor selected to cause a phase shift of the AC voltage signal, the second roll-out flame capacitor alternately charging and discharging in response to the change in polarity of the AC voltage when no roll-out flame is present thereby causing the change of state device to provide a series of pulses to the microcontroller, the second roll-out flame capacitor being discharged through the flame when a roll-out flame is present causing the change of state device to provide a continuous single input to the microcontroller.

2. Control apparatus according to claim 1 in which the change of state device is a CMOS inverter.

3. Control apparatus according to claim 1 further comprising a condensate sensor for placement in a condensate collection box, the condensate sensor comprising an elongated electrically conductive condensate member, a second AC voltage source, a condensate sense line comprising a first condensate capacitor connected to the second AC voltage source, a diode and a resistor serially connected between the first condensate capacitor and the condensate sensor member, a condensate change of state device having an input and an output, the output connected to the microcontroller, a second condensate capacitor between the input to the condensate change of state device and earth ground, the DC voltage source and the condensate sense line connected to the input of the condensate change of state device, the second condensate capacitor selected to remove the Hz component from the second AC voltage source, when no condensate is present the second condensate capacitor is in the charged state causing the change of state device to provide a first input signal to the microcontroller and when sufficient condensate is present the positive portion of the second AC voltage source is shunted to ground through the condensate member and voltage stored in the second condensate capacitor is discharged causing the change of state device to provide a second, different, input signal to the microcontroller and the microcontroller providing an output signal in response to the second input signal.

4. Control apparatus according to claim 3 in which the condensate change of state device is a CMOS inverter.

5. Control apparatus according to claim 3 further comprising time delay means to delay the issuance of the output control signal for a selected period of time following the second input signal.

6. Control apparatus according to claim 3 in which the condensate sensor member is a stainless steel rod.

7. Control apparatus according to claim 3 in which the second AC voltage source is a 24 VAC source.

8. Control apparatus for use in a furnace comprising:

a microcontroller having input and output ports, an AC voltage source and a DC voltage source, a condensate sensor for placement in a condensate collection box, the condensate sensor comprising an elongated electrically conductive condensate sensor member, a condensate sense line comprising a first condensate capacitor serially connected to the AC voltage source, a diode and a resistor serially connected between the first condensate capacitor and the condensate sense member, a condensate change of state device having an input and an output, the output connected to the microcontroller, a second condensate capacitor connected between the input to the condensate change of state device and earth ground, the DC voltage source and the condensate sense line connected to the input of the condensate change of state device, the second condensate capacitor selected to remove the Hz components from the AC voltage source, when no condensate is present the second condensate capacitor is in the charged state causing the change of state device to provide a first input signal to the microcontroller and when sufficient condensate is present the positive portion of the AC voltage source is shunted to ground and voltage stored in the first condensate capacitor is discharged causing the change of state device to provide a second, different, input signal to the microcontroller and the microcontroller providing an output control signal in response to the second input signal.

9. Control apparatus according to claim 8 in which the condensate change of state device is a CMOS inverter.

10. Control apparatus according to claim 8 further comprising time delay means to delay the issuance of the control signal for a selected period of time following the second input signal.

11. Control apparatus according to claim 8 in which the condensate sensor member is a stainless steel rod.

12. Control apparatus according to claim 8 in which the AC voltage source is a 24 VAC source.

* * * * *